US012163323B2

(12) United States Patent
Grover et al.

(10) Patent No.: US 12,163,323 B2
(45) Date of Patent: Dec. 10, 2024

(54) PRIMED JET TOILET

(71) Applicant: AS America, Inc., Piscataway, NJ (US)

(72) Inventors: David Grover, Stockton, NJ (US); Daigo Ishiyama, Summit, NJ (US); Christophe Bucher, Hillsborough, NJ (US); Tuan Le, Fountain Valley, CA (US); James McHale, Hillsborough, NJ (US)

(73) Assignee: AS America, Inc., Piscataway, NJ (US)

( * ) Notice: Subject to any disclaimer, the term of this patent is extended or adjusted under 35 U.S.C. 154(b) by 475 days.

(21) Appl. No.: 17/516,152

(22) Filed: Nov. 1, 2021

(65) Prior Publication Data

US 2022/0049484 A1 Feb. 17, 2022

Related U.S. Application Data

(60) Division of application No. 16/257,540, filed on Jan. 25, 2019, now Pat. No. 11,193,265, which is a division of application No. 14/853,984, filed on Sep. 14, 2015, now Pat. No. 10,246,865, which is a continuation-in-part of application No. 14/619,989, filed on Feb. 11, 2015, now Pat. No. 10,145,097, which is a continuation of application No. PCT/US2013/069961, filed on Nov. 13, 2013.

(Continued)

(51) Int. Cl.

| | |
|---|---|
| ***E03D 11/08*** | (2006.01) |
| ***E03D 1/14*** | (2006.01) |
| ***E03D 1/30*** | (2006.01) |
| ***E03D 11/06*** | (2006.01) |

(52) U.S. Cl.

CPC ..... *E03D 11/08* (2013.01); *E03D 1/145* (2013.01); *E03D 1/306* (2013.01); *E03D 11/06* (2013.01); *E03D 2201/30* (2013.01); *E03D 2201/40* (2013.01)

(58) Field of Classification Search

CPC ..... E03D 1/145
USPC ..... 4/326, 324
See application file for complete search history.

(56) References Cited

U.S. PATENT DOCUMENTS 4,128,906 A * 12/1978 Raz ..... E03D 1/144 4/340
4,173,801 A * 11/1979 Bresnyan ..... E03D 1/145 4/405
2008/0022443 A1* 1/2008 Jones ..... E03D 5/092 4/326

FOREIGN PATENT DOCUMENTS

CN 201363467 Y 12/2009

* cited by examiner

*Primary Examiner* — Lauren A Crane
(74) *Attorney, Agent, or Firm* — Tyler A. Stevenson; Anna-Lisa L. Gallo

(57) ABSTRACT

A siphonic flush toilet system and method of priming the same having a toilet bowl assembly comprising at least one jet flush valve assembly and at least one rim valve; and bowl having a rim and a jet defining at least one jet channel. The bowl has a closed jet pathway to maintain the jet channel in a primed state with fluid from the jet flush valve assembly to prevent air from entering the closed jet pathway. Flush valves may have back-flow preventer mechanisms and/or at least partly flexible valve covers, including specific valve cover structures. Flush activation assemblies may have a flush activation bar connected to the pivot rod and/or an adjustable flush connector located between the pivot rod and the flush activation bar. A kit providing one or more flush (Continued)

activation elements is included. The kit elements may be usable with the toilet systems and methods described.

9 Claims, 64 Drawing Sheets

Related U.S. Application Data

(60) Provisional application No. 62/049,736, filed on Sep. 12, 2014, provisional application No. 61/810,664, filed on Apr. 10, 2013, provisional application No. 61/725,832, filed on Nov. 13, 2012.

PRIMED JET TOILET

BACKGROUND OF THE INVENTION

Field of the Invention

The present invention relates to the field of gravity-powered toilets for removal of human and other waste. The present invention further relates to the field of toilets that operate by a primed water delivery system to improve performance.

Description of Related Art

Toilets for removing waste products, such as human waste, are well known. Gravity powered toilets generally have two main parts: a tank and a bowl. The tank and bowl can be separate pieces which are coupled together to form the toilet system (commonly referred to as a two-piece toilet) or can be combined into one integral unit (typically referred to as a one-piece toilet).

The tank, which is usually positioned over the back of the bowl, contains water that is used for initiating flushing of waste from the bowl to the sewage line, as well as refilling the bowl with fresh water. When a user desires to flush the toilet, he pushes down on a flush lever on the outside of the tank, which is connected on the inside of the tank to a movable chain or lever. When the flush lever is depressed, it moves a chain or lever on the inside of the tank which acts to lift and open the flush valve, causing water to flow from the tank and into the bowl, thus initiating the toilet flush.

There are three general purposes that must be served in a flush cycle. The first is the removal of solid and other waste to the drain line. The second is cleansing of the bowl to remove any solid or liquid waste which was deposited or adhered to the surfaces of the bowl, and the third is exchanging the pre-flush water volume in the bowl so that relatively clean water remains in the bowl between uses. The second requirement, cleansing of the bowl, is usually achieved by way of a hollow rim that extends around the upper perimeter of the toilet bowl. Some or all of the flush water is directed through this rim channel and flows through openings positioned therein to disperse water over the entire surface of the bowl and accomplish the required cleansing. The third requirement is to refill the bowl with clean water, restoring the seal depth against backflow of sewer gas, and readying it for the next usage and flush.

Gravity powered toilets can be classified in two general categories: wash down and siphonic. In a wash-down toilet, the water level within the bowl of the toilet remains relatively constant at all times. When a flush cycle is initiated, water flows from the tank and spills into the bowl. This causes a rapid rise in water level and the excess water spills over the weir of the trapway, carrying liquid and solid waste along with it. At the conclusion of the flush cycle, the water level in the bowl naturally returns to the equilibrium level determined by the height of the weir.

In a siphonic toilet, the trapway and other hydraulic channels are designed such that a siphon is initiated in the trapway upon addition of water to the bowl. The siphon tube itself is an upside down U-shaped tube that draws water from the toilet bowl to the wastewater line. When the flush cycle is initiated, water flows into the bowl and spills over the weir in the trapway faster than it can exit the outlet to the sewer line. Sufficient air is eventually removed from the down leg of the trapway to initiate a siphon which in turn pulls the remaining water out of the bowl. The water level in the bowl when the siphon breaks is consequently well below the level of the weir, and a separate mechanism needs to be provided to refill the bowl of the toilet at the end of a siphonic flush cycle to reestablish the original water level and protective "seal" against back flow of sewer gas.

Siphonic and wash-down toilets have inherent advantages and disadvantages. Siphonic toilets, due to the requirement that most of the air be removed from the down leg of the trapway in order to initiate a siphon, tend to have smaller trapways which can result in clogging. Wash-down toilets can function with large trapways but generally require a smaller amount of pre-flush water in the bowl to achieve the 100:1 dilution level required by plumbing codes in most countries (i.e., 99% of the pre-flush water volume in the bowl must be removed from the bowl and replaced with fresh water during the flush cycle). This small pre-flush volume manifests itself as a small "water spot." The water spot, or surface area of the pre-flush water in the bowl, plays an important role in maintaining the cleanliness of a toilet. A large water spot increases the probability that waste matter will contact water before contacting the ceramic surface of the toilet. This reduces adhesion of waste matter to the ceramic surface making it easier for the toilet to clean itself via the flush cycle. Wash-down toilets with their small water spots therefore frequently require manual cleaning of the bowl after use.

Siphonic toilets have the advantage of being able to function with a greater pre-flush water volume in the bowl and greater water spot. This is possible because the siphon action pulls the majority of the pre-flush water volume from the bowl at the end of the flush cycle. As the tank refills, a portion of the refill water can be directed into the bowl to return the pre-flush water volume to its original level. In this manner, the 100:1 dilution level required by many plumbing codes is achieved even though the starting volume of water in the bowl is significantly greater relative to the flush water exited from the tank. In the North American markets, siphonic toilets have gained widespread acceptance and are now viewed as the standard, accepted form of toilet. In European markets, wash-down toilets are still more accepted and popular, whereas both versions are common in the Asian markets.

Gravity powered siphonic toilets can be further classified into three general categories depending on the design of the hydraulic channels used to achieve the flushing action. These categories are: non-jetted, rim jetted, and direct jetted.

In non-jetted bowls, all of the flush water exits the tank into a bowl inlet area and flows through a primary manifold into the rim channel. The water is dispersed around the perimeter of the bowl via a series of holes positioned underneath the rim. Some of the holes may be designed to be larger in size to allow greater flow of water into the bowl. A relatively high flow rate is needed to spill water over the weir of the trapway rapidly enough to displace sufficient air in the down leg and initiate a siphon. Non-jetted bowls typically have adequate to good performance with respect to cleansing of the bowl and exchange of the pre-flush water, but are relatively poor in performance in terms of bulk removal. The feed of water to the trapway is inefficient and turbulent, which makes it more difficult to sufficiently fill the down leg of the trapway and initiate a strong siphon. Consequently, the trapway of a non-jetted toilet is typically smaller in diameter and contains bends and constrictions designed to impede flow of water. Without the smaller size, bends, and constrictions, a strong siphon would not be achieved. Unfortunately, the smaller size, bends, and constrictions result in poor performance in terms of bulk waste removal and frequent clogging, conditions that are extremely dissatisfying to end users.

Designers and engineers of toilets have improved the bulk waste removal of siphonic toilets by incorporating "siphon jets." In a rim-jetted toilet bowl, the flush water exits the tank, flows through the toilet inlet area and through the primary manifold into the rim channel. A portion of the water is dispersed around the perimeter of the bowl via a series of holes positioned underneath the rim. The remaining portion of water flows through a jet channel positioned at the front of the rim. This jet channel connects the rim channel to a jet opening positioned in the sump of the bowl. The jet opening is sized and positioned to send a powerful stream of water directly at the opening of the trapway. When water flows through the jet opening, it serves to fill the trapway more efficiently and rapidly than can be achieved in a non-jetted bowl. This more energetic and rapid flow of water to the trapway enables toilets to be designed with larger trapway diameters and fewer bends and constrictions, which, in turn, improves the performance in bulk waste removal relative to non-jetted bowls. Although a smaller volume of water flows out of the rim of a rim jetted toilet, the bowl cleansing function is generally acceptable as the water that flows through the rim channel is pressurized by the upstream flow of water from the tank. This allows the water to exit the rim holes with higher energy and do a more effective job of cleansing the bowl.

Although rim-jetted bowls are generally superior to non-jetted, the long pathway that the water must travel through the rim to the jet opening dissipates and wastes much of the available energy. Direct-jetted bowls improve on this concept and can deliver even greater performance in terms of bulk removal of waste. In a direct-jetted bowl, the flush water exits the tank and flows through the bowl inlet and through the primary manifold. At this point, the water divides into two portions: a portion that flows through a rim inlet port to the rim channel with the primary purpose of achieving the desired bowl cleansing, and a portion that flows through a jet inlet port to a "direct-jet channel" that connects the primary manifold to a jet opening in the sump of the toilet bowl. The direct jet channel can take different forms, sometimes being unidirectional around one side of the toilet, or being "dual fed," wherein symmetrical channels travel down both sides connecting the manifold to the jet opening. As with the rim jetted bowls, the jet opening is sized and positioned to send a powerful stream of water directly at the opening of the trapway. When water flows through the jet opening, it serves to fill the trapway more efficiently and rapidly than can be achieved in a non-jetted or rim jetted bowl. This more energetic and rapid flow of water to the trapway enables toilets to be designed with even larger trapway diameters and minimal bends and constrictions, which, in turn, improves the performance in bulk waste removal relative to non-jetted and rim jetted bowls.

Although direct-fed jet bowls currently represent a large portion of the state of the art for bulk removal of waste, there are still major areas for improvement in toilet performance. Government agencies have continually demanded that municipal water users reduce the amount of water they use. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 now mandates that toilets sold in the United States can use water in an amount of only 1.6 gallons/flush (6 liters/flush). Regulations have recently been passed in the State of California which require water usage to be lowered ever further to 1.28 gallons/flush. The 1.6 gallons/flush toilets currently described in the patent literature and available commercially lose the ability to consistently siphon when pushed to these lower levels of water consumption. Thus, manufacturers are being and will continue to be forced to reduce trapway diameters and sacrifice performance without development of improved technology and toilet designs.

Several inventions have been aimed at improving the performance of siphonic toilets through optimization of the direct jetted concept. For example, in U.S. Pat. No. 5,918,325, performance of a siphonic toilet is improved by improving the shape of the trapway. In U.S. Pat. No. 6,715,162, performance is improved by the use of a flush valve with a radiused inlet and asymmetrical flow of the water into the bowl.

U.S. Pat. No. 8,316,475 B2 demonstrates a pressurized rim and direct fed jet configuration that enables enhanced washing and adequate siphon for use with low volume water meeting current environmental water-use standards.

U.S. Patent Publication No. 2012/0198610 A1 also shows a high performance toilet achieved by a control element in the primary manifold that divides the flow of flush water entering the toilet manifold from the tank inlet into the inlet port of the rim and the inlet port of the direct-fed jet. U.S. Pat. No. 2,122,834 shows a toilet with an air manifold and a hydraulic manifold for introducing air into the toilet flush cycle to terminate siphonic action and prevent back flow into the system. Other inventions attempt to address performance between the rim and the jet by dividing the toilet tank into separate sections. See U.S. Pat. No. 1,939,118.

When flush volumes are pushed below about 6.0 liters, minimization of turbulence and flow restriction in the internal channels of a toilet is of paramount importance. One of the most significant factors in minimizing turbulence and restriction to flow is management of the air that occupies the rim and jet channels prior to initiation of the flush cycle. If the air is not able to escape the system ahead of the oncoming rush of flush water, it will continue to occupy space in the channels and restrict flow. U.S. Pat. No. 5,918,325 describes a toilet with jet channels that include an air discharging means, a passageway that connects the jet channel to the rim, allowing air to escape from the jet channels into the rim during the flush. U.S. Patent Publication No. 2012/0198610 A1 discloses a toilet with a downstream communication port that likewise enables air and/or water to pass between the jet channel and the rim channel.

A need in the art remains to further improve siphonic toilet performance, and in particular, to manage the pre-flush air that occupies the jet channel(s). There is also a need in the art for a toilet which improves on the above noted deficiencies in prior art toilets, by resisting clogging and allowing for significantly improved cleansing during flushing without sacrifice to flush performance. Such toilets should also still comply with water conservation standards and government guidelines while providing an adequate siphon for low water consumption for a variety of trapway geometries.

BRIEF SUMMARY OF THE INVENTION

Included within the scope of the invention is a siphonic flush toilet bowl assembly, comprising at least one jet flush valve assembly having a jet flush valve inlet and a jet flush valve outlet, the jet flush valve assembly configured for delivery of fluid from the jet flush valve outlet to a closed jet fluid pathway; at least one rim valve having a rim valve inlet and a rim valve outlet, the rim valve configured for delivery of fluid from the outlet of the rim valve to a rim inlet port; and a bowl having an interior surface defining an interior bowl area and comprising (a) at least one rim inlet port for introducing water to an upper perimeter area of the bowl; (b) a jet defining at least one jet channel, the jet having an inlet port in fluid communication with the outlet of the jet flush valve and a jet outlet port positioned in a lower portion of the bowl and configured for discharging fluid to a sump area of the bowl, wherein the sump area is in fluid communication with an inlet to a trapway having a weir and the closed jet fluid pathway comprises the jet channel; wherein the jet flush valve is positioned above the weir of the trapway and wherein the closed jet fluid pathway comprising the jet channel extends from the outlet of the jet flush valve to the outlet of the jet and once primed, the closed jet fluid pathway is capable of remaining primed with fluid and assisting in preventing air from entering the closed jet fluid pathway before actuation of and after completion of a flush cycle.

The toilet bowl assembly may, in one embodiment further comprise a rim manifold, wherein the rim manifold has a rim manifold inlet opening for receiving fluid from the outlet of the rim flush valve assembly and a rim manifold outlet opening for delivery of fluid to the rim inlet port. In such an embodiment, the bowl may also comprise a rim that extends at least partially around an upper perimeter of the bowl, the rim defining a rim channel extending from the rim inlet port around the upper perimeter of the bowl and having at least one rim outlet port in fluid communication with an interior area of the bowl, and wherein the rim inlet port is in fluid communication with the rim manifold outlet opening.

In another embodiment of the assembly, bowl may have a rim that comprises a rim shelf extending transversely along an interior surface of the bowl in an upper perimeter area thereof from the rim inlet port at least partially around the bowl so that fluid is able to travel along the rim shelf and enter the interior space of the bowl in at least one location displaced from the rim inlet port.

The assembly may also include a tank configured for receiving fluid from a source of fluid, the tank containing at least one fill valve. The tank may include at least one jet reservoir and at least one a rim reservoir, the jet reservoir comprising a jet fill valve and the at least one jet flush valve assembly, and the rim reservoir comprising the at least one rim valve. In such an embodiment, the rim reservoir may further comprise a rim fill valve, the rim valve is a rim flush valve assembly and the rim flush valve assembly comprises an overflow tube.

At least a portion of an interior wall of the toilet bowl in the sump area may also be configured to upwardly incline from the jet outlet port toward the inlet of the trapway.

The toilet assembly is preferably capable of operating at a flush volume of no greater than about 6.0 liters, more preferably no greater than about 4.8 liters and in some embodiments no greater than about 2.0 liters.

The at least one jet channel may also be configured so as to be positioned to extend at least partially around a lower portion of an exterior surface of the bowl.

The sump area of the bowl in one embodiment has a jet trap defined by the interior surface of the bowl and having an inlet end and an outlet end, wherein the inlet end of the jet trap receives fluid from the jet outlet port and the interior area of the bowl and the outlet end of the jet trap is in fluid communication with the inlet to the trapway; and wherein the jet trap has a seal depth. The surface of the jet outlet port may be within the jet trap and positioned at a seal depth below an upper surface of the inlet to the trapway as measured longitudinally through the sump area. The jet trap seal depth may be about 1 cm to about 15 cm, and preferably about 2 cm to about 12 cm, and further may be about 3 cm to about 9 cm.

The rim valve in one embodiment of the assembly may be a rim flush valve assembly having a rim flush valve body extending from the rim flush valve inlet to the rim flush valve outlet and a rim flush valve cover, such as a flapper cover.

The at least one jet channel may also be positioned so as to pass at least partially under the bowl. The jet flush valve assembly in one embodiment comprises a jet flush valve body extending from the jet flush valve inlet to the jet flush valve outlet and a flush valve cover, and wherein the jet flush valve also comprises a back-flow preventer mechanism.

The flush valve covers herein on either a jet flush valve assembly or optional rim flush valve assembly may be formed so as to be at least partly flexible and to be able to be peeled upwardly upon opening.

If a back-flow preventer mechanism is provided, it may be one or more of a hold-down linkage mechanism, a hook and catch mechanism, a poppet mechanism, and a check valve.

The jet flush valve assembly may also comprise a jet flush valve body extending from the jet flush valve inlet to the jet flush valve outlet and a flush valve cover. In such an embodiment, the flush valve cover may be formed so as to be at least partly flexible and to be able to be peeled upwardly upon opening. The jet flush valve cover may also further comprise hinged mounts and/or at least one grommet for attachment of a chain having a float thereon. In such an embodiment having a cover that is at least partly flexible, the assembly may also comprise a back-flow preventer mechanism.

Also within the invention is a method of maintaining a siphonic flush toilet assembly in a primed state, the method comprising, (a) providing a toilet bowl assembly, comprising at least one jet flush valve assembly having an jet flush valve inlet and a jet flush valve outlet, the jet flush valve assembly configured for delivery of fluid from the jet flush valve outlet to a closed jet fluid pathway; at least one rim valve having a rim valve inlet and a rim valve outlet, the rim valve configured for delivery of fluid from the outlet of the rim valve to a rim inlet port; and a bowl having an interior surface defining an interior bowl area and comprising (i) at least one rim inlet port for introducing water to an upper perimeter area of the bowl; (ii) a jet defining at least one jet channel, the jet having an inlet port in fluid communication with the outlet of the jet flush valve and a jet outlet port positioned in a lower portion of the bowl and configured for discharging fluid to a sump area of the bowl, wherein the sump area is in fluid communication with an inlet to a trapway having a weir and the closed jet fluid pathway comprises the jet channel; the jet flush valve is positioned above the weir of the trapway and the closed jet fluid pathway comprising the jet channel extends from the jet flush valve outlet to the outlet port of the jet and, once primed, the closed jet fluid pathway is capable of remaining primed with fluid and assisting in preventing air from entering the closed jet fluid pathway before actuation of and after completion of a flush cycle; (b) actuating a flush cycle; (c) providing fluid through the at least one jet flush valve assembly and the at least one rim valve; and (d) maintaining the closed jet fluid pathway in a primed state after completion of a flush cycle. In a preferred embodiment, flow is continued until the level in the sump is above the jet outlet port.

In the method noted above, the toilet bowl assembly may further comprise a rim manifold, wherein the rim manifold has a rim manifold inlet opening configured for receiving fluid from the outlet of the rim valve and a rim manifold outlet opening for delivery of fluid to the rim inlet port; and wherein the bowl comprises a rim around the upper perimeter of the bowl and the rim defines a rim channel extending from the rim inlet port at least partially around the upper perimeter of the bowl and having at least one rim outlet port in fluid communication with an interior area of the bowl; and the rim inlet port is in fluid communication with the rim channel and with the rim manifold outlet opening, and the method further comprises introducing fluid from the outlet of the rim valve into the interior area of the toilet bowl through the rim manifold inlet, the rim manifold outlet, the rim inlet port, the rim channel and the at least one rim channel outlet port.

In an embodiment of the method, the rim may also comprises a rim shelf extending transversely along an interior surface of the bowl in an upper perimeter area thereof from the rim inlet port at least partially around the interior surface of the bowl, and the method may further comprise introducing fluid from the rim shelf inlet port so that it travels along the rim shelf and enters the interior space of the bowl in at least one location displaced from the rim inlet port.

The toilet bowl assembly in the method may further comprise a tank configured to receive fluid from a source of fluid, the tank having at least one fill valve, and the method further comprises filling the tank using the at least one fill valve and providing fluid from the tank to the bowl through the at least one jet flush valve assembly and the at least one rim valve. The tank may include at least one jet reservoir and at least one rim reservoir, the jet reservoir comprising a jet fill valve and the at least one jet flush valve assembly configured for delivery of fluid to the jet inlet port, and the rim reservoir comprising the at least one rim valve and configured for delivery of fluid to the rim inlet port through the at least one rim valve, and the method further comprises filling the at least one jet reservoir with fluid from the at least one fill valve before actuating the flush cycle. The at least one rim reservoir may further comprise a rim fill valve and the method further comprises filling the at least one rim reservoir with the rim fill valve.

The method may also further comprise maintaining the level of fluid in the at least one jet reservoir above a jet flush valve assembly inlet from the at least one fill valve of the tank after completion of a flush cycle.

In another embodiment of the method, in the jet trap, an upper surface of the jet outlet port may be configured to be positioned at a seal depth below an upper surface of the inlet to the trapway as measured longitudinally through the sump area, and the method may further comprise maintaining the seal depth to facilitate the closed jet fluid pathway being primed with fluid from the jet flush valve assembly before actuation of and after completion of a flush cycle.

Also included in the invention herein is a siphonic flush toilet bowl assembly, comprising at least one jet flush valve assembly configured for delivery of fluid to a direct-fed jet and at least one rim valve configured for delivery of fluid to a rim; a rim manifold, wherein the rim manifold has a rim manifold inlet opening configured for receiving fluid from the rim valve and a rim manifold outlet opening for delivery of fluid to a rim inlet port; a bowl having an interior surface defining an interior bowl area and (a) a rim provided around an upper perimeter thereof and defining a rim channel, the rim channel having an inlet port in fluid communication with the rim manifold outlet opening and at least one rim outlet port in fluid communication with an interior area of the bowl, (b) a jet defining at least one jet channel, the jet having an inlet port in fluid communication with the jet flush valve assembly outlet for receiving fluid from the jet flush valve assembly and a jet outlet port configured for discharging fluid to a sump area in a bottom portion of the bowl, wherein the sump area is in fluid communication with an inlet of a trapway, and (c) the sump area of the bowl has a jet trap defined by an interior wall of the bowl and having an inlet end and an outlet end, wherein the inlet end of the jet trap receives fluid from the jet outlet port and the interior of the bowl and the outlet end of the jet trap is in communication with the inlet to the trapway; and wherein the jet trap has a seal depth sufficient to maintain the jet channel and the jet manifold primed with fluid from the jet flush valve assembly before actuation of and after completion of a flush cycle so as to assist in preventing air from entering the closed jet fluid pathway before actuation of and after completion of a flush cycle.

The invention further includes a siphonic flush toilet bowl assembly, comprising at least one jet flush valve assembly configured for delivery of fluid to a direct-fed jet and at least one rim valve configured for delivery of fluid to a rim inlet port in an upper peripheral portion of a bowl; the bowl having an interior surface defining an interior area of the bowl and (a) the upper peripheral portion around an upper perimeter of the bowl configured to direct fluid from the rim inlet port at least partially around the upper peripheral portion of the bowl and into a sump area, (b) a jet defining at least one jet channel, the jet having an inlet port in fluid communication with the outlet of the jet flush valve assembly and a jet outlet port in a lower portion of the bowl configured for discharging fluid to the sump area, wherein the sump area is in fluid communication with an inlet of a trapway, and (c) the sump area in the bottom portion of the bowl has a jet trap defined by an interior surface of the bowl and having an inlet end and an outlet end, wherein the inlet end of the jet trap receives fluid from the jet outlet port and the interior of the bowl and the outlet end of the jet trap is in fluid communication with the inlet to the trapway; and wherein the jet trap is configured to have a seal depth sufficient to maintain the jet channel and jet manifold primed with fluid from the jet flush valve assembly before actuation of and after completion of a flush cycle so as to assist in preventing air from entering the closed jet fluid pathway before actuation of and after completion of a flush cycle.

The invention further encompasses a method of maintaining a siphonic flush toilet bowl assembly in a primed state, the method comprising (a) providing a toilet bowl assembly, having at least one jet flush valve assembly having a jet flush valve inlet and a jet flush valve outlet, the jet flush valve assembly configured for delivery of fluid from the jet flush valve outlet to a closed jet fluid pathway; at least one rim valve having a valve inlet and a rim valve outlet, the rim valve configured for delivery of fluid from the outlet of the rim valve to a rim inlet port; and a bowl having an interior surface defining an interior bowl area and wherein (i) the rim inlet port is configured for introducing water to one of (A) a rim provided around an upper perimeter of the bowl and defining a rim channel extending from the rim inlet port around the upper perimeter of the bowl and having at least one rim outlet port in fluid communication with an interior area of the bowl or (B) a rim shelf extending transversely along the interior surface of the bowl in the upper perimeter area thereof from the rim inlet at least partially around the bowl, and (ii) a jet defining at least one jet channel, the jet having an inlet port in fluid communication with the outlet of the jet flush valve assembly and a jet outlet port positioned in a lower portion of the bowl and configured for discharging fluid to a sump area of the bowl, wherein the sump area is in fluid communication with an inlet to a trapway having a weir and the closed jet fluid pathway comprises the jet channel; wherein the jet flush valve is positioned above the weir of the trapway and wherein the closed jet fluid pathway comprising the jet channel extends from the outlet of the jet flush valve to the outlet of the jet so that once primed, the closed jet fluid pathway is capable of remaining primed with fluid to assist in preventing air from entering the closed jet fluid pathway before actuation of and after completion of a flush cycle; (b) actuating a flush cycle; (c) providing fluid through the at least one jet flush valve assembly at a flow rate sufficient to keep air from entering the jet outlet and to generate a siphon in the trapway; and (d) lowering the flow rate of fluid through the jet channel for about 1 second to about 5 seconds until the siphon breaks.

The method of priming may also include, step (c) further comprising providing fluid through the at least one rim valve during the flush cycle. The method may also further comprise initial priming of the bowl upon installation by providing a flow rate through the jet flush valve assembly outlet sufficient to keep air from entering the jet outlet port until the sump fills with fluid.

The invention also includes a flush valve for use in a siphonic flush toilet bowl, wherein the flush valve has a flush valve body extending from a flush valve inlet to a flush valve outlet and a flapper cover configured to extend over the flush valve inlet, wherein the flush valve further comprises a back-flow preventer mechanism. The back-flow preventer mechanism may be one or more of a hold-down linkage mechanism, a hook and catch mechanism, a poppet mechanism, and a check valve. The flush valve may also comprise a flush valve cover that is at least partly flexible and is able to be peeled upwardly upon opening. The flush valve cover may also further comprise hinged mounts to assist in lifting the cover and/or at least one grommet for attachment of a chain having a float.

Also within the invention is a flush valve for use in a siphonic flush toilet bowl assembly, comprising a flush valve body extending from a flush valve inlet to a flush valve outlet and a flapper cover configured to extend over the flush valve inlet, wherein the flapper cover is at least partly flexible and is able to be peeled upward upon opening. In this embodiment, the flush valve may further comprise a back-flow preventer mechanism as described above and elsewhere herein.

Another embodiment of the invention includes an adjustable flush connector for a flush toilet comprising, a first section having a first rotatable connector, a second section and an adjustable connector. The adjustable connector having a second rotatable connector and being longitudinally movable along the second section and rotationally positionable. The adjustable flush connector may be used with a flush toilet, and preferably a siphonic flush toilet.

The adjustable flush connector having a second section wherein a portion of the surface of the second section and an interior surface of the adjustable connector, defining a passage therethrough, are each threaded to allow the adjustable connector to be longitudinally adjustable along the second section and rotationally positionable about the second section.

In another embodiment of the adjustable flush connector, the first rotatable connector may be configured so as to be connectable to a pivot rod. The second rotatable connector may be configured so as to be connectable to a flush activation bar. The flush activation bar may comprise a first portion connected to a first valve assembly and a second portion connected to a second valve assembly.

A further embodiment of the invention includes a flush activation assembly for use in a flush toilet comprising, a flush activation bar comprising a first portion and a second portion, the first portion configured to be connected to a first valve assembly and the second portion configured to be connected to a second valve assembly; and a pivot rod. The flush activation bar is connected to the pivot rod using a connector. In another embodiment, the connector of the flush activation assembly is an adjustable flush connector positioned so as to operably connect the pivot rod and the flush activation bar. The adjustable flush connector comprises a first section, a second section and an adjustable connector, wherein the adjustable connector comprises a second rotatable connector and the adjustable connector is longitudinally movable along the second section of the adjustable flush connector and rotationally positionable. The adjustable flush connector is connected to the pivot rod using a first rotatable connector located on the first section of the adjustable flush connector, and the adjustable flush connector is connected to the flush activation bar using the second rotatable connector of the adjustable connector.

A portion of the surface of the second section of the adjustable flush connector and an interior surface of the adjustable connector, defining a passage therethrough, may be each threaded to allow the adjustable connector to longitudinally adjust along and rotationally adjust about the second section of the adjustable flush connector. The first portion of the flush activation bar may also be configured to be connected to a rim valve assembly. The second portion of the flush activation bar may be configured to be connected to a jet valve assembly.

At least one of the first portion of the flush activation bar and the second portion of the flush activation bar may be configured to connect to a valve assembly having a valve body and a valve cover comprising a seal and a rigid cover configured to be capable of bending the seal to gradually open the valve. The seal may comprise a sealing surface and a locking surface, wherein the locking surface comprises a plurality of locking lugs positioned on the locking surface so as to engage a plurality of corresponding openings in the rigid cover. Also, the seal may comprise a sealing surface and a locking surface, and at least the sealing surface may comprise silicone.

Another embodiment of the invention includes a valve cover for a flush valve assembly having a flush valve comprising a valve body, wherein the valve cover is positioned over the valve body. The valve cover comprises a seal and a rigid cover configured to be capable of bending with the seal for gradual opening of the valve cover.

The seal may comprise a sealing surface and a locking surface, wherein the locking surface may comprise a plurality of locking lugs positioned on the locking surface so as to engage a plurality of corresponding openings in the rigid cover. Each locking lug may comprise a head and a neck, wherein a distance measured along a transverse line across a cross-section of the top surface of the neck may be smaller than a distance measured along a transverse line across a cross-section of the bottom surface of the head. The plurality of locking lugs may be arranged in a first row, a second row, and a third row. The first row may be located about 5 mm to about 15 mm from a point on a front edge of the cover on a central vertical longitudinal plane through the valve cover, the second row may be located about 40 mm to about 50 mm from the point, and the third row may be located about 60 mm to about 80 mm from the point.

Each of the first row, the second row and the third row of locking lugs on the locking surface may comprise at least one locking lug. Each locking lug may comprise a head and a neck, wherein the neck may have a generally cylindrical shape, and the head may be generally cone-shaped having a rounded top surface. The head of the first row of locking lugs and the head of the second row of locking lugs may be generally flat along a side facing a central vertical longitudinal plane of the valve cover. In one embodiment at least the sealing surface of the valve cover may comprise silicone.

In another embodiment of the valve cover, the rigid cover may comprise a peeling section and a lifting section. There may be a transverse separation between a back edge of the peeling section and a front edge of the lifting section, and the back edge of the peeling section and the front edge of the lifting section can be substantially parallel to each other and substantially perpendicular to a central longitudinal plane, and a transverse distance measured from the back edge of the peeling section to the front edge of the lifting section may be about 10 mm to about 20 mm. The peeling section may comprise at least one hinged mount, the hinged mount configured to connect with the lifting section.

The seal of the valve cover may be positioned in facing engagement with the peeling section and the lifting section of the rigid cover. The seal may also be connected to the peeling section and the lifting section through the use of a plurality of locking lugs and/or through the use of an adhesive. The peeling section may be configured so as to interact with a flush activation bar and/or may comprise a float attachment.

Another embodiment of the invention is a valve assembly for a flush toilet. The valve assembly comprises a valve body comprising a link for associating the valve body with a second valve body of a second valve assembly, and a valve cover.

In the valve assembly included above, the valve cover may comprise a flush valve body, wherein the valve cover is positioned over the valve body, the valve cover comprising, a seal; and a rigid cover configured to be capable of bending with the seal for gradual opening of the valve cover. The seal may comprise a sealing surface and a locking surface, wherein the locking surface may comprise a plurality of locking lugs positioned on the locking surface so as to engage a plurality of corresponding openings in the rigid cover.

Further included in the invention is a multiple flush valve assembly comprising a first valve assembly comprising a first valve body, a first link, and a first valve cover; and a second valve assembly comprising a second valve body, a second link, and a second valve cover, wherein the first valve assembly and the second valve assembly are configured so as to associate with each other through interlocking the first link and the second link.

The first link of the multiple flush valve assembly may have a downward hook shape and the second link may have an upward protrusion, the upward protrusion configured to interlock with the downward hook shape to maintain alignment of the first valve assembly with the second valve assembly.

Another embodiment within the invention is a siphonic flush toilet comprising, a toilet; a first valve assembly; a second valve assembly; and a flush activation assembly comprising, a flush activation bar comprising a first portion and a second portion, the first portion configured to be connected to the first valve assembly and the second portion configured to be connected to the second valve assembly; a pivot rod; and an adjustable flush connector positioned so as to operably connect the pivot rod and the flush activation bar, the adjustable flush connector comprising a first section, a second section and an adjustable connector, wherein the adjustable connector comprises a second rotatable connector and the adjustable connector is longitudinally movable along the second section and rotationally positionable, and the adjustable flush connector is connected to the pivot rod using a first rotatable connector located on the first section of the adjustable flush connector, and the adjustable flush connector is connected to the flush activation bar using the second rotatable connector of the adjustable connector.

Within the siphonic toilet, the first valve assembly may be a rim flush valve assembly. Also within the toilet, the second valve assembly may be a jet flush valve assembly.

In one embodiment, a flush toilet is provided that comprises a toilet; a flush activation assembly; and a multiple flush valve assembly comprising a first valve assembly comprising, a first valve body comprising a first link, and a first valve cover; and a second valve assembly comprising a second valve body comprising a second link, and a second valve cover, wherein the first valve assembly and the second valve assembly are configured so as to associate with each other through interlocking the first link and the second link.

The first link of this embodiment of a toilet assembly may have a downward hook shape and the second link may have an upward protrusion, the upward protrusion configured to interlock with the downward hook shape to maintain alignment of the first valve assembly with the second valve assembly.

Yet another embodiment of the present invention includes an assembly kit for use in a flush toilet comprising, a first valve assembly; a second valve assembly; and a flush activation assembly comprising, a flush activation bar comprising a first portion and a second portion; a pivot rod; and an adjustable flush connector positioned so as to operably connect the pivot rod and the flush activation bar, the adjustable flush connector comprising a first section, a second section and an adjustable connector, wherein the adjustable connector comprises a second rotatable connector and the adjustable connector is longitudinally movable along the second section and rotationally positionable, and the adjustable flush connector is connected to the pivot rod using a first rotatable connector located on the first section of the adjustable flush connector and the adjustable flush connector is connected to the flush activation bar using the second rotatable connector of the adjustable connector. The second valve assembly may also have a float attachment. The float attachment may be selected from the group consisting of a float assembly, a chain, a string, a cord, a rope, a stainless steel cable, a rigid rod or a wire.

Another embodiment of the present invention includes, an embodiment of an assembly kit for use in a toilet comprising, a flush activation assembly; and a multiple flush valve assembly, wherein the multiple flush valve assembly comprises a first valve assembly comprising a first valve body comprising a first link, and a first valve cover; and a second valve assembly comprising a second valve body comprising a second link, and a second valve cover, wherein the first valve assembly and the second valve assembly are associated with each other through interlocking the first link and the second link.

In the embodiment of the assembly kit discussed above, the kit may further comprise a tank to bowl gasket tool, wherein the multiple flush valve assembly may comprise a first tank to bowl gasket and a second tank to bowl gasket, the first and second tank to bowl gaskets comprising an outer edge and the tank to bowl gasket tool may be configured to fit the outer edge of the tank to bowl gaskets and may be used as a wrench to attached the tank to bowl gaskets to a toilet tank.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
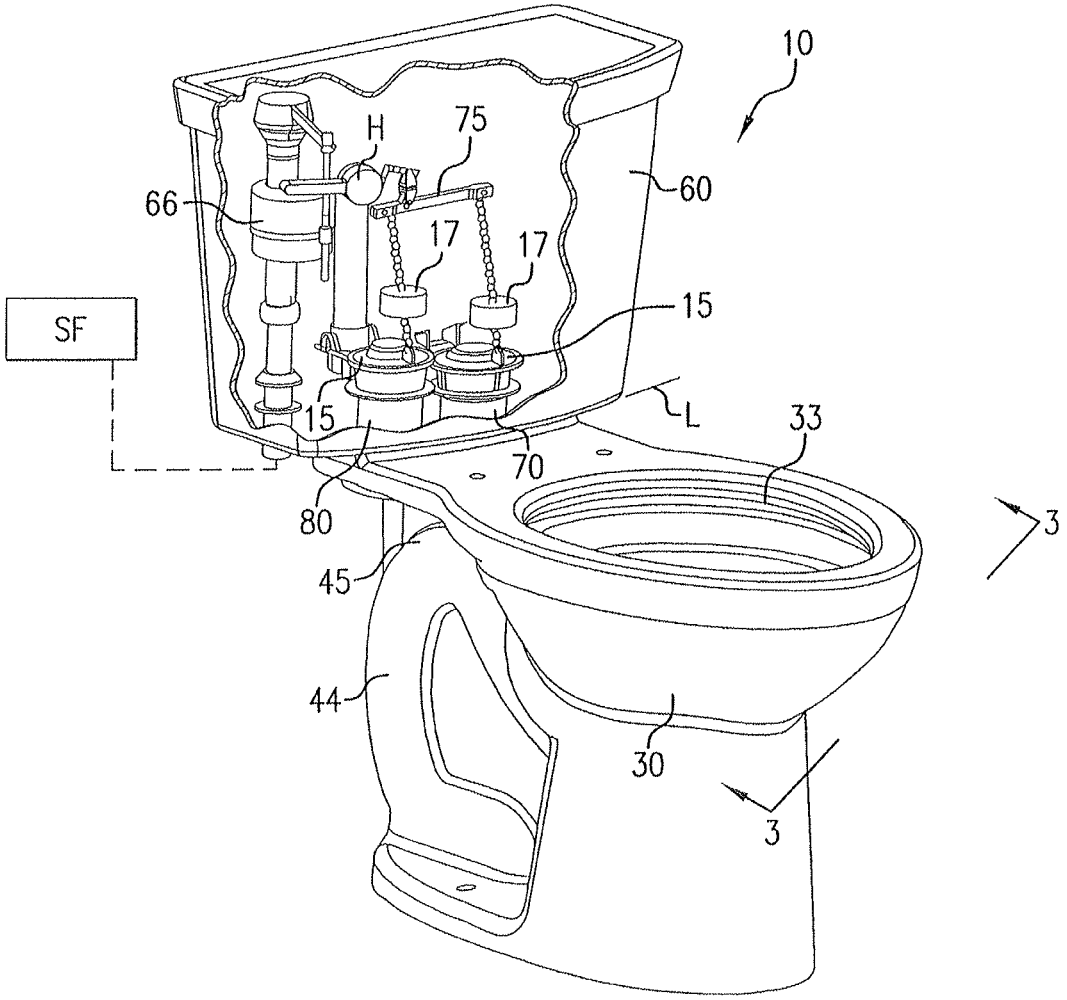
FIG. 1 is a perspective view of a siphonic toilet bowl assembly according to one embodiment of the invention showing an interior of the tank having a jet flush valve assembly and a rim flush valve assembly.
Figure 2:
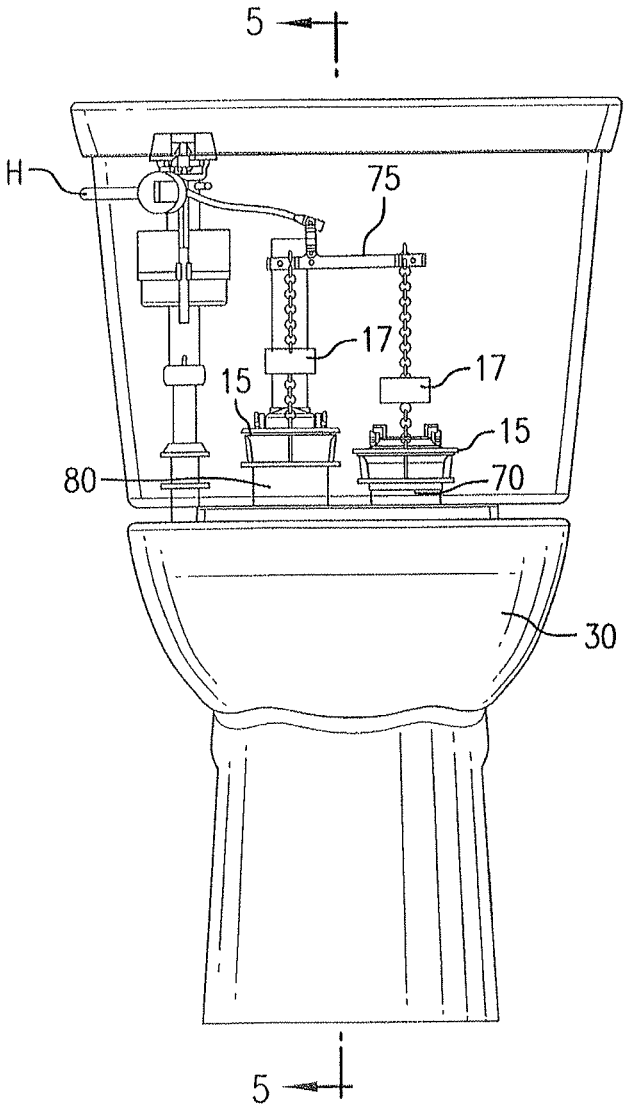
FIG. 2 is a front elevational view of the toilet bowl assembly of FIG. 1 showing the interior of the tank.

As used herein, words such as "inner" and "outer," "upper" and "lower," "forward" and "backward," "front" and "back," "left" and "right," "upward" and "downward" and words of similar import are intended to assist in understanding the preferred embodiment of the invention with reference to the accompanying drawing Figures with respect to the orientation of the toilet assembly as shown, and are not intended to be limiting to the scope of the invention or to limit the invention scope to the preferred embodiment as shown in the Figures. The embodiments 10, 1010, 110, 210, 310 and 410, etc. herein each use like reference numbers to refer to analogous features of the invention as described herein and as shown in the drawings, such that absent language to the contrary describing an alternative configuration for a particular feature, one skilled in the art would understand based on this disclosure and the drawings attached hereto that description of one such feature should be applicable in another embodiment describing an analogous feature.

In the present invention, a siphonic flush toilet assembly is provided which can operate to maintain a primed closed jet fluid pathway including a jet channel by isolating the fluid flow introduced into the bowl assembly so as to deliver different fluid volumes from a jet flush valve and a rim valve, such as a rim flush valve, preferably through a separate closed jet fluid path. This provides a more powerful performance in comparison to standard, gravity flush siphonic toilets that operate with air-filled jet channels and must expel the air to minimize turbulence and flow restriction.

The toilet bowl assembly of the present invention has a closed jet fluid path that includes a jet channel(s) within the toilet assembly exterior to the bowl. The jet channel(s) may have various configurations and extension areas, additional ports or side-channels, and the like depending on the bowl mold geometry, including an optional jet manifold so long as the closed jet fluid path receives fluid from the jet valve outlet into a jet inlet port and into and through a jet channel to a jet outlet port. The closed jet fluid path maintains the jet channel in a perpetually primed state, and substantially isolates it thereby assisting in preventing air from entering into the jet channel. This is accomplished by (1) isolating the jet channel from rim flow or other pathways open to the atmosphere, (2) closing the jet channel flush valve before the level of water in the tank falls to the level of the opening of the flush valve, (3) helping to prevent air flow from entering the jet channel(s) and any other jet paths, areas, or an optional jet manifold if used, which in one embodiment may include establishing a seal depth in a jet trap in the sump area to assist in blocking air from entering the jet channel outlet and/or (4) configuring and operating the assembly to ensure that the water level in the jet trap does not fall to a level that enables air to travel back up and into the jet channel.

In general, the ratio of the volume of fluid to the rim to the volume of fluid to the jet also affects toilet performance. In typical prior art siphonic jetted toilets, about 70% of the flush water is required to power the jet and initiate the siphon, leaving only about 30% to cleanse the bowl through the rim. In the primed toilet herein, much less water is required to initiate the siphon, which allows more water to be used in cleaning the bowl. Applicants have determined that more than about 50% or more of the flush water can be directed to the rim for significant improvement in bowl cleaning. In preferred embodiments, more than about 60% and as great as more than about 70% of the water can be directed to the rim.

In addition to the above-noted factors, another method for maintaining a sufficient seal depth of water in the sump area and/or for preventing backflow of air into the jet channels from the sump is to maintain a slower flow of water through and from the jet channels after breaking the siphon. For example, with a bowl filled to the weir (i.e., an excess of water present to contribute to the siphon), initiating and maintaining a siphon in a trapway of roughly about 54 mm in diameter requires a volumetric flow rate from the jet of more than about 950 ml/s. This translates to a linear flow rate of 127 cm/s across a jet outlet port area of 7.47 $cm^2$. Larger trapway sizes will require higher flow rates to initiate and maintain siphon and smaller trapways will require smaller values. When the flow rate from the jet is reduced below about 950 ml/s, the siphon will break. Maintaining the volumetric flow rate from the jet below about 950 ml/s but above about 175 ml/s (i.e., a linear flow rate of 23.4 cm/s through the 7.47 $cm^2$ area of the jet outlet port) will prevent air from entering the closed jet channel. When the bowl is completely filled to the level of the trapway weir, the flow from the jet can be stopped without losing the prime, as long as the top of the jet channel is located below the weir of the trapway.

Controlling such flush valve actuation for the jet flush valve and the rim flush valve can be done in a number of ways. One way is through the use of electromagnetic valves, as disclosed in U.S. Patent Application Publication No. 2009/0313750 and U.S. Pat. No. 6,823,535, which are incorporated herein by reference in relevant part. This valve control method can also be accomplished through purely mechanical methods, such as by modifications to dual inlet flush valves like those disclosed in U.S. Pat. No. 6,704,945, which is also incorporated herein by reference in relevant part. Alternatively, a flush actuation bar balanced for optimal performance of the two flush valves in sequence as shown herein may be used.

The flush activation bar may be connected to the pivot rod and handle, or other flush activator using an adjustable flush connector. The adjustable flush connector providing an adjustable connection to compensate for differences in the location of the pivot rod in relation to valve assemblies within a toilet. The compensation allows for most valve assemblies, flush activation bars and/or pivot rods to be compatible with each other. Adjustments provided by the adjustable flush connector may include longitudinal movement along its length, rotation about its longitudinal axis and/or rotation about its transverse axis.

Further, as discussed in more detail below, system performance can be enhanced by providing a "peel-back" valve cover to facilitate self-priming of the jet. The cover acts to reduce the activation force needed to open the jet flapper. In the present invention, where the jet channel(s) are primed, more than two times the force is needed than in a conventional flapper valve because of the weight of the water both above and below the flapper. By peeling the cover open, the seal breaks and some water comes through while air moves back so that the cover opens easier. In addition, during initial priming, when the valve is closed, the jet is full of air, and if the flapper opens all at once, flush water rushes in too quickly and air in the jet channel(s) may become trapped and not be sufficiently expelled depending on the geometry of the toilet and its jet channel(s). Further, as the embodiments herein provide a primed and closed jet-path, when the toilet requires plunging, an optional back-flow prevention device as described further hereinbelow may be provided to the jet flush valve.

Preferable valve cover structures for use with the "peel-back" valve cover may optimize the valve performance. Specifically, locking elements may be provided on the seal to prevent dislocation of the seal from the valve cover. Further, to maintain consistent flush performance, valve assemblies may be provided that are associated with each other using a linking device. Such valve assemblies may be used to ensure proper and consistent alignment between the valve bodies over time.

Sufficient post-flush depth in the sump area and/or stopping water from entering the closed jet fluid pathway through the jet outlet port can also be achieved by maintaining flow of water to a rim shelf in a rimless toilet or through a rim channel in more traditional toilet design while the siphon is breaking. As the toilet system described herein includes separate channels and valve mechanisms for controlling flow to the rim and jet, the system can be designed to continue flow through the rim inlet port during the siphon break. The flow of water to the rim inlet port is preferably sufficient to maintain the level of water in the sump area above the height of the jet outlet port, yet insufficient to maintain the siphon in the trapway. In this manner, added security can be provided for maintaining the jet channel free of air, reducing the dependence on a seal depth in the sump area. It should be noted that the flow through the jet and rim can also be utilized together to maintain sufficient post-flush depth in the sump area.

A related area in which the present invention provides an improvement over the prior art is in high efficiency siphonic toilets with flush volumes below 6.0 liters, and preferably below 4.8 liters. The embodiments of the toilet bowl assembly of the present invention herein described are able to maintain resistance to clogging consistent with today's toilets having no greater than about 6.0 liters/flush, and preferably no greater than about 4.8 liters/flush in a single flush toilet and or dual-flush toilet assembly while still delivering superior bowl cleanliness at reduced water usages. As much less water is required through the jet channel to initiate the siphon, the primed toilet assembly embodiments herein enable production of ultra high efficiency toilets that can function up to no greater than about 4.8 liters per flush, and preferably can function at or below about 3.0 liters per flush and as low as about 2.0 liters per flush.

Moreover, a second related area in which the present invention provides an improvement over the prior art is in siphonic toilets with larger trapways. By altering the size of the trapway, water consumption and toilet performance are significantly affected. In the present invention, the toilet bowl assembly is able to stay primed in siphonic toilets of various trapway sizes and volumes because of the reduction in turbulence and restriction to flow achieved through the closed jet fluid pathway, including in preferred embodiments, the primed jet manifold and primed jet channel, which permits the toilet bowl assembly to maintain excellent flushing and cleansing capabilities.

To achieve the maximum potential performance of the inventive toilet system, the closed fluid jet path must be "primed," that is, it should be filled with water and contain little or no air. When the closed fluid jet path and jet channel contains significant quantities of air, as would be the case after initial installation of a toilet or after a major repair or maintenance, the closed jet channel must be primed before the full potential performance of the system will be achieved. For priming to occur, two basic requirements must be met: (1) water must be allowed to flow into the closed fluid jet path faster than it can exit the closed jet channel, and (2) air contained in the jet channel and closed jet fluid path must be provided a route of escape through, with, or against the flow of water into the closed jet channel.

The simplest way to prime the closed jet channel, which can be referred to as "manual priming," is to open the jet flush valve assembly described herein while leaving the rim valve closed and blocking or partially blocking flow from the jet outlet port(s). The jet flush valve should be held open until bubbles of air are no longer seen escaping from the channel into the tank, at which point the jet flush valve can be closed and the jet outlet ports unblocked. Upon refilling of the tank, the system should then be completely primed and ready for use at full performance potential. In preferred embodiments the system is designed to "self-prime" over the first several flushes after installation or loss of prime for other unforeseen reasons (maintenance, repair, etc.). To self-prime, the same two requirements must be met, but are made inherent to the system. Ensuring a self-priming system is largely a function of geometry and design of the jet flush valve, closed fluid jet path including the jet channel, and jet outlet port. As will be discussed in more detail below, the jet flush valve preferably enables a high flow rate into the closed jet channel, and radiused flush valves may be used that increase flow velocity (such as that described in U.S. Pat. No. 8,266,723, incorporated herein by reference). In most closed jet channel designs, the last portion of air entrapped in the jet channel is likely to rise to the space immediately below the flapper (or other opening mechanism) of the jet flush valve. The valve design, therefore, must also facilitate the escape of this remaining air. As will be discussed below, valves that open gradually, such as a flapper that can peel back, can confine the flow of water to one side of the valve and facilitate escape of air around the flow. Certain patterns or ribs in the throat of the flush valve can facilitate this escape of air, as well.

FIGS. 1-15, 17-19 and 29-34 show a first embodiment of a toilet bowl assembly, generally referred to herein as assembly 10. The assembly 10 includes at least one jet flush valve assembly 70 having a jet flush valve inlet 71 and a jet flush valve outlet 13. A jet flush valve body 21 extends between the inlet 71 and outlet 13 defining an interior flow path. The jet flush valve assembly may have a variety of configurations and may be any suitable flush valve assembly known or to be developed in the art. Preferably, it is configured to be similar to that described in co-pending U.S. Patent Application Publication No. 2014/0090158, incorporated herein in relevant part by reference for description of such valves and the use of a cover having a float as well as with respect to the various embodiments of jet flush valves described hereinbelow and shown in FIGS. 35-68. As shown in FIGS. 1-2 and 7-11, the jet flush valve assembly 70 has a shorter valve height profile than the rim flush valve assembly 80 (wherein the rim valve is herein described with respect to the assembly 80), for controlling flow through the jet flush valve assembly. Each of the rim flush valve assembly 80 and the jet flush valve assembly 70 preferably has a cover 115 preferably having a float 117 attached thereto via a chain 119 or other linkage. As described in co-pending U.S. Patent Application Publication No. 2014/0090158, such features help provide advanced performance and control of buoyancy in the particular flush valve design. However, it should be understood that other flush valve assemblies can be used operating on the principles of the invention and provide improved flushing capability.

The jet flush valve assembly 70 delivers fluid from its jet flush valve outlet 13 to a closed jet fluid pathway 1. The closed jet fluid pathway 1 includes at least one jet channel(s). As shown herein, a single jet path may be used (see, e.g., the arrows shown in FIG. 3 highlighting only one leg of the dual jet path of assembly 10) or multiple channels. As shown in this embodiment, two such channels 38 are provided stemming from one inlet and joining at one outlet while each of the channels flows around the bowl on its underside as illustrated by the flow paths shown in FIG. 3A. A jet manifold may optionally be provided.

At least one rim valve is used. The rim flush valve may be a variety of valves, including a solenoid valve, an in-line valve, electronic valve or water may simply be provided by an electronically controlled valve through an inlet tube. As shown herein, a rim flush valve assembly 80 is provided as shown in FIGS. 1-2, 7-8 and 12-14. Each rim valve assembly has a run flush valve inlet 83 and a rim flush valve outlet 81, and a rim flush valve body 31 extending from the inlet 83 to the outlet 81. The rim flush valve 80 or any other suitable rim valve may be any suitable flush valve assembly or rim valve as noted above so long as it is configured for delivery of fluid from the outlet of the rim valve to a rim inlet, also known herein as a rim inlet port 28.

In the embodiment shown, the rim 32 is of a "rimless" design in that fluid is introduced into the bowl 30 through a rim inlet port 28 and travels along a contour or geometric feature(s) formed into the interior surface 36 of the bowl 30. That is, the contour may be one or more shelf(s) 27 or similar features formed along an upper perimeter portion 33 of the bowl 30. As shown, the shelf is inset into the bowl's chinaware as best shown in FIGS. 29-34. The shelf(s) also referred to herein as a rim shelf 27 extend generally transversely along the interior surface 39 of the bowl 30 in an upper perimeter portion 33 thereof from the rim inlet port 28 at least partially around the bowl and, as shown best in FIGS. 30-34 in an inset contour of the interior surface 36 of the bowl 30. The toilet bowl 30 may be of a variety of shapes and configurations, and may have a variety of toilet seat lids and/or lid hinge assemblies. As such lids and are optional they are not shown in the drawings, and there are many such lids and assemblies known in the art, so that and any suitable lid known or to be developed may be used with the invention.

Figure 3:
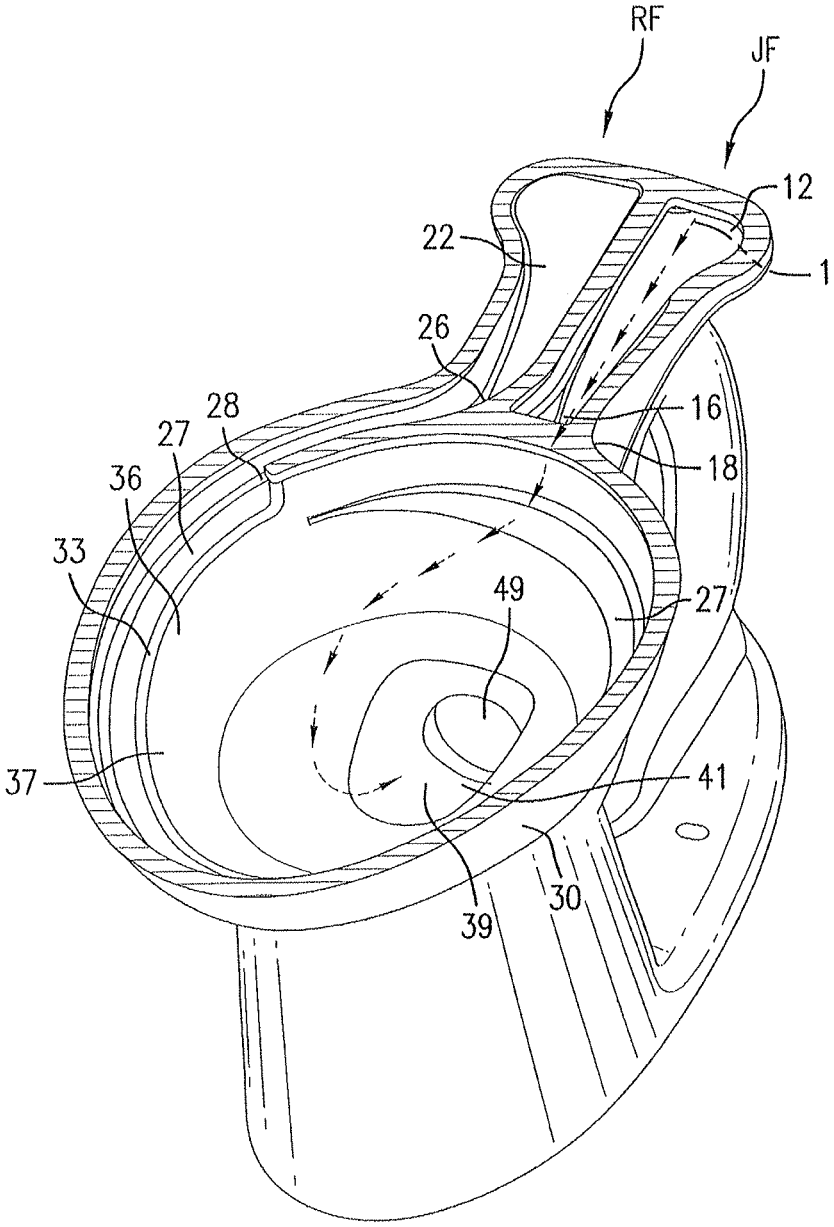
FIG. 3 is a perspective transverse cross-sectional view of the toilet assembly of FIGS. 1-2 taken along line 3-3.
Figure 3A:
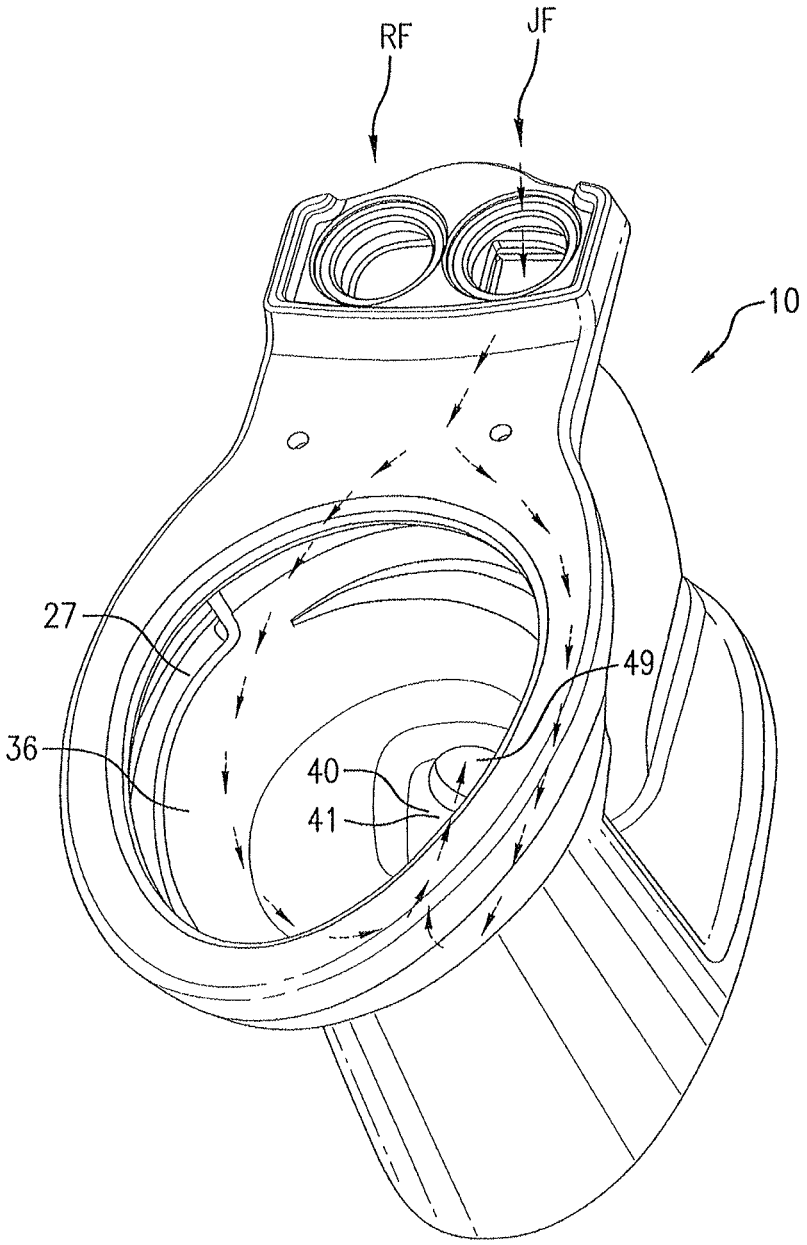
FIG. 3A is a perspective view of the bowl in the embodiment of FIG. 1 showing a rim jet flow path in a jet channel that curves around the bottom of the exterior surface of the bowl.
Figure 3B:
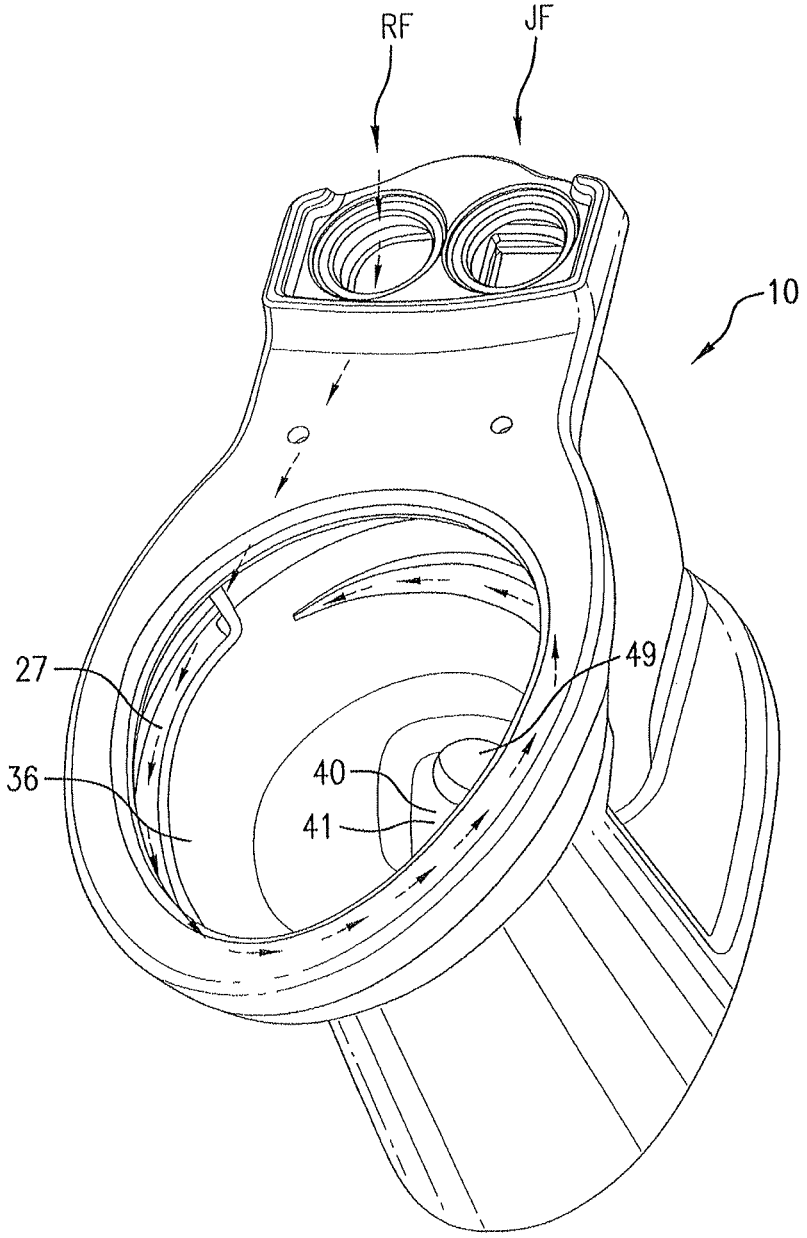
FIG. 3B is a perspective view of the bowl in the embodiment of FIG. 1 showing a rim shelf flow path.
Figure 3D:
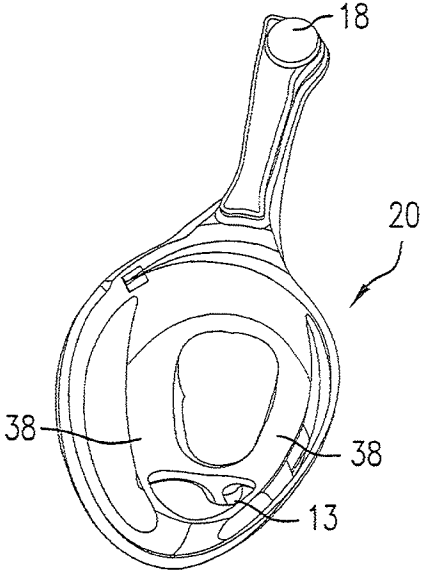
FIGS. 3C-3G are schematic views of the interior space that is primed in the embodiment of FIG. 1 within the closed jet flow path that includes the dual jet channels having dual flow paths as in FIG. 3A.
Figure 3G:
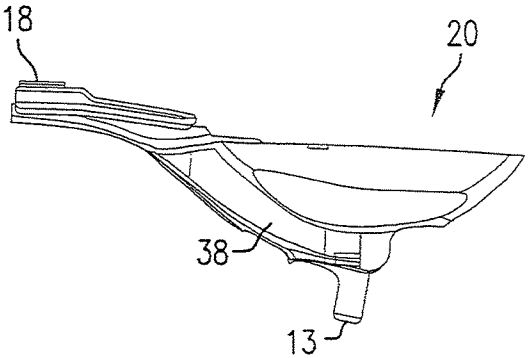
Figure 3F:
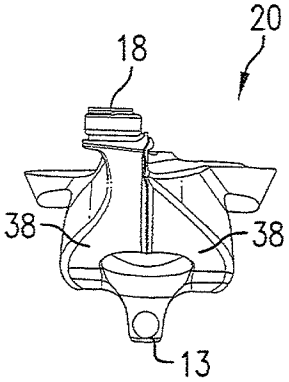
Figure 3C:
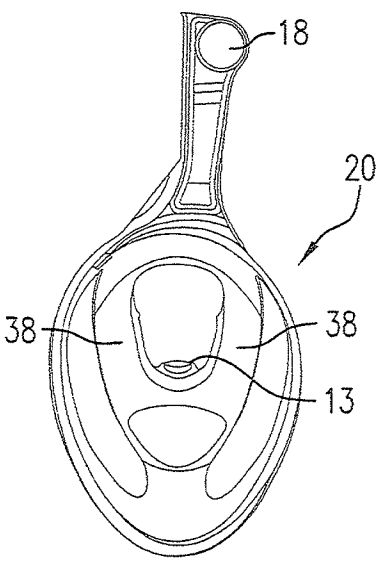
Figure 3E:
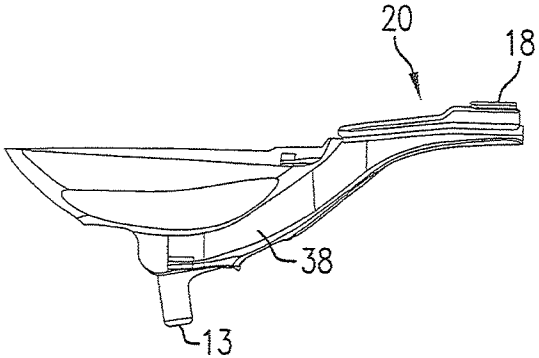
Figure 4A:
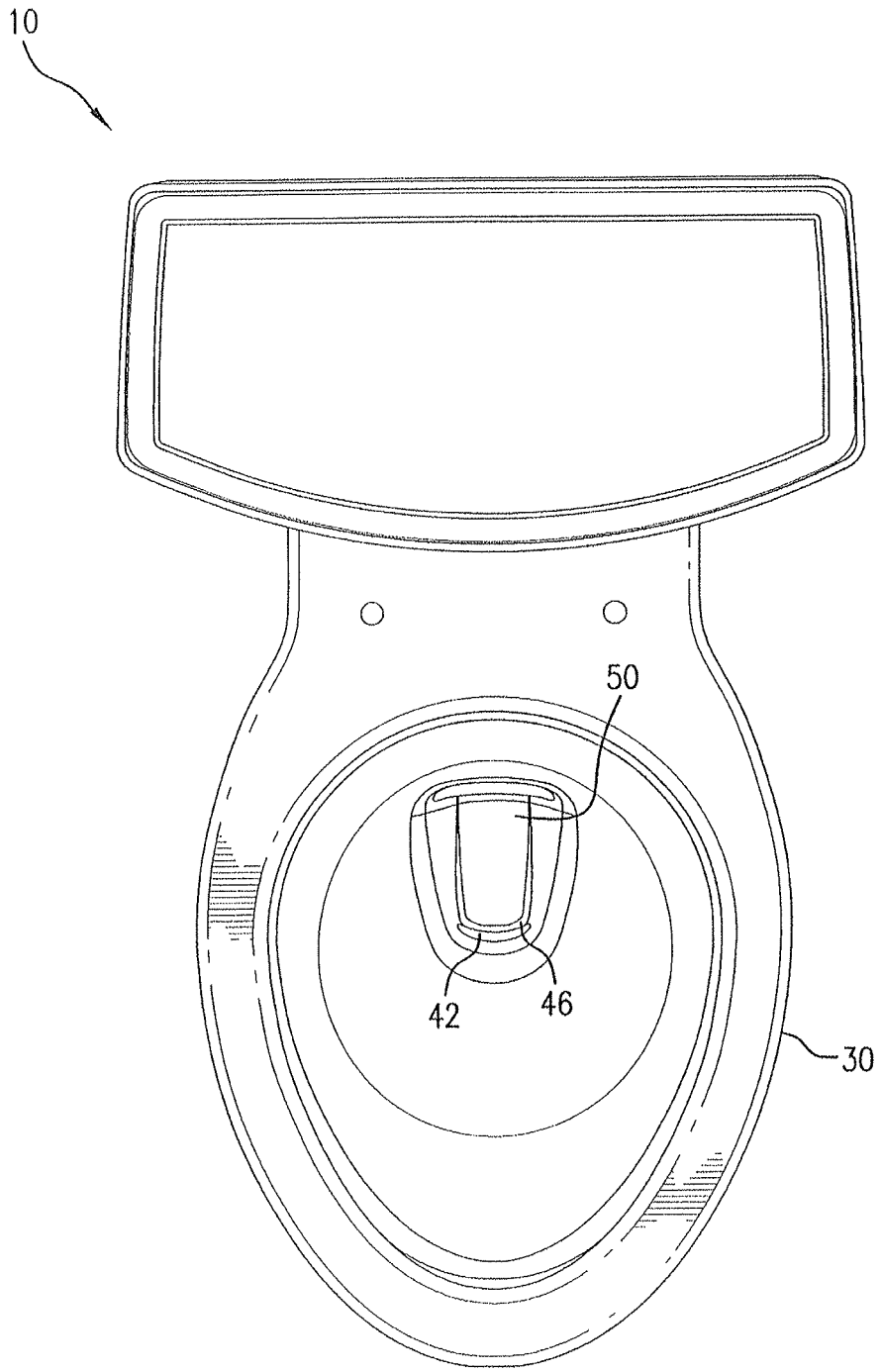
FIG. 4A is a top elevational view of the toilet assembly of FIG. 1.
Figure 4B:
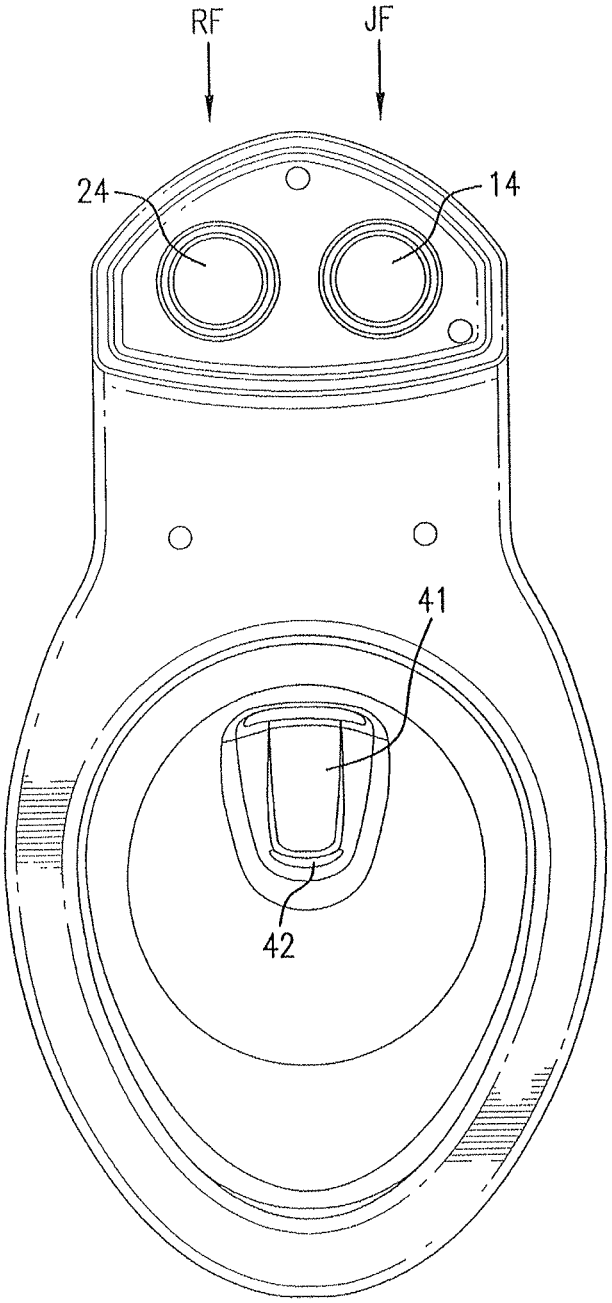
FIG. 4B is a top elevational view of the bowl portion of the toilet assembly showing the jet manifold opening and the rim manifold opening.
Figure 5:
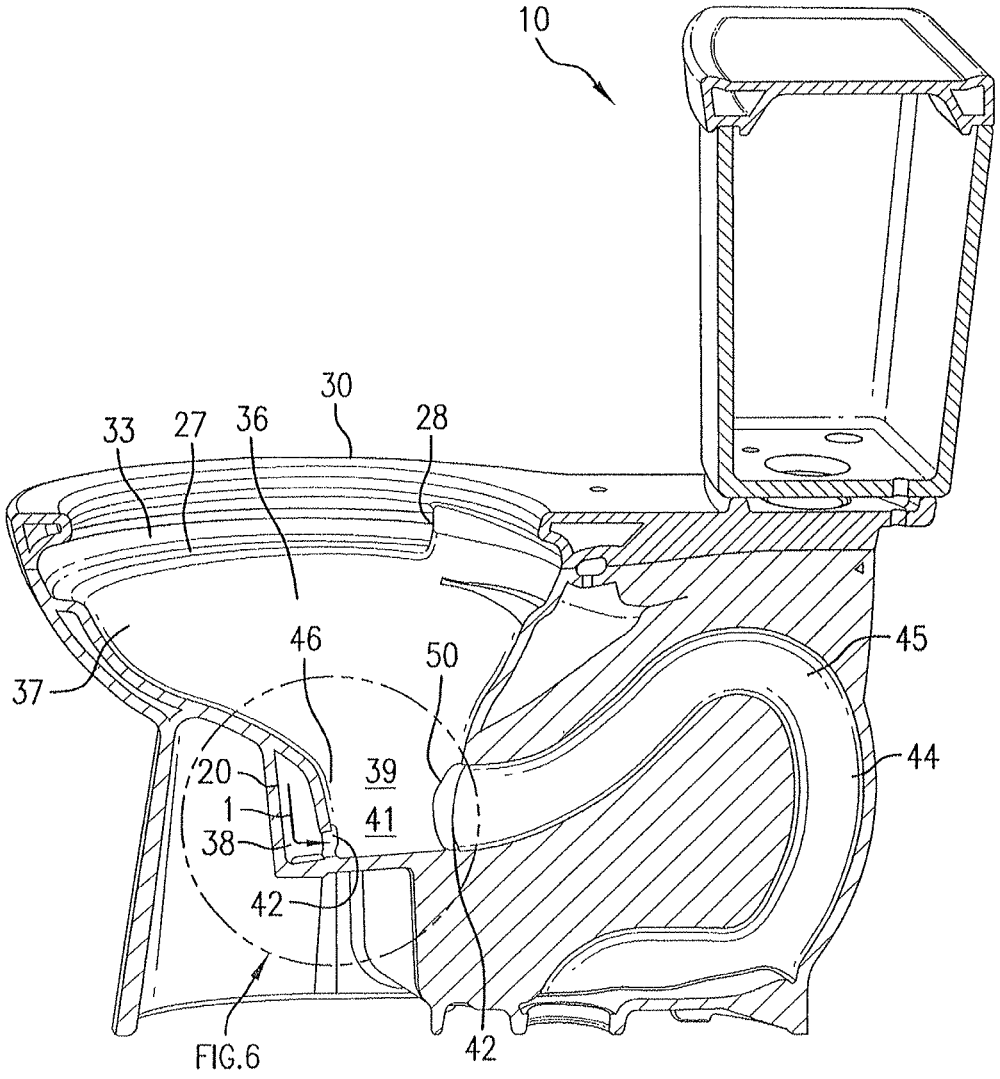
FIG. 5 is a longitudinal cross-sectional view of the toilet assembly of FIG. 1 taken along line 5-5 of FIG. 2 with the flush valves omitted.
Figure 6:
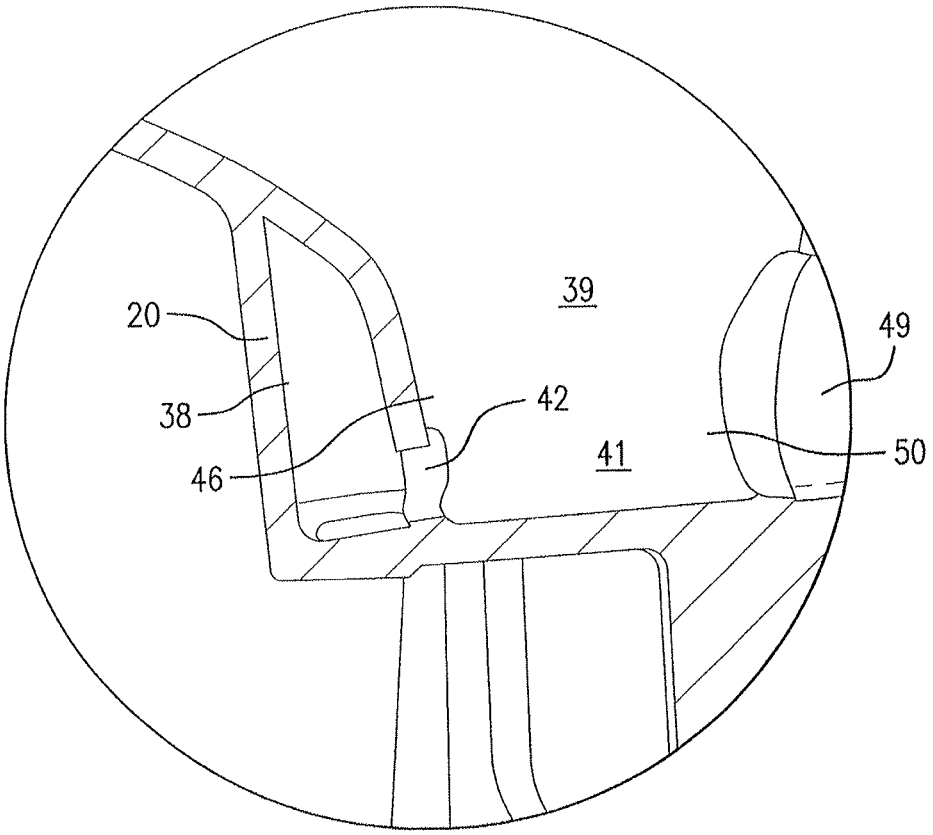
FIG. 6 is a greatly enlarged portion of the toilet assembly of FIG. 5 showing the jet outlet.
Figure 7:
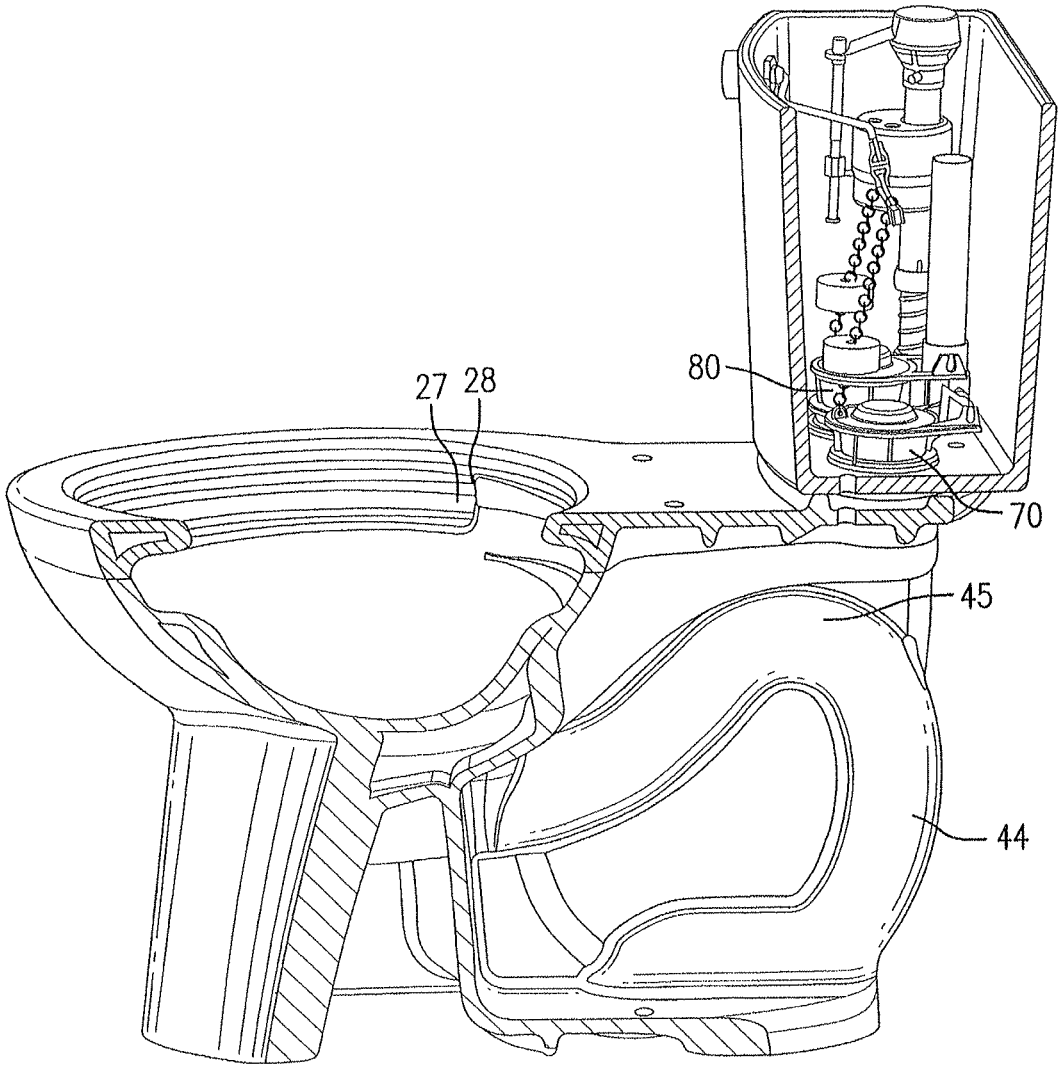
FIG. 7 is a longitudinal cross-sectional view of FIG. 8 taken along line 7-7.
Figure 8:
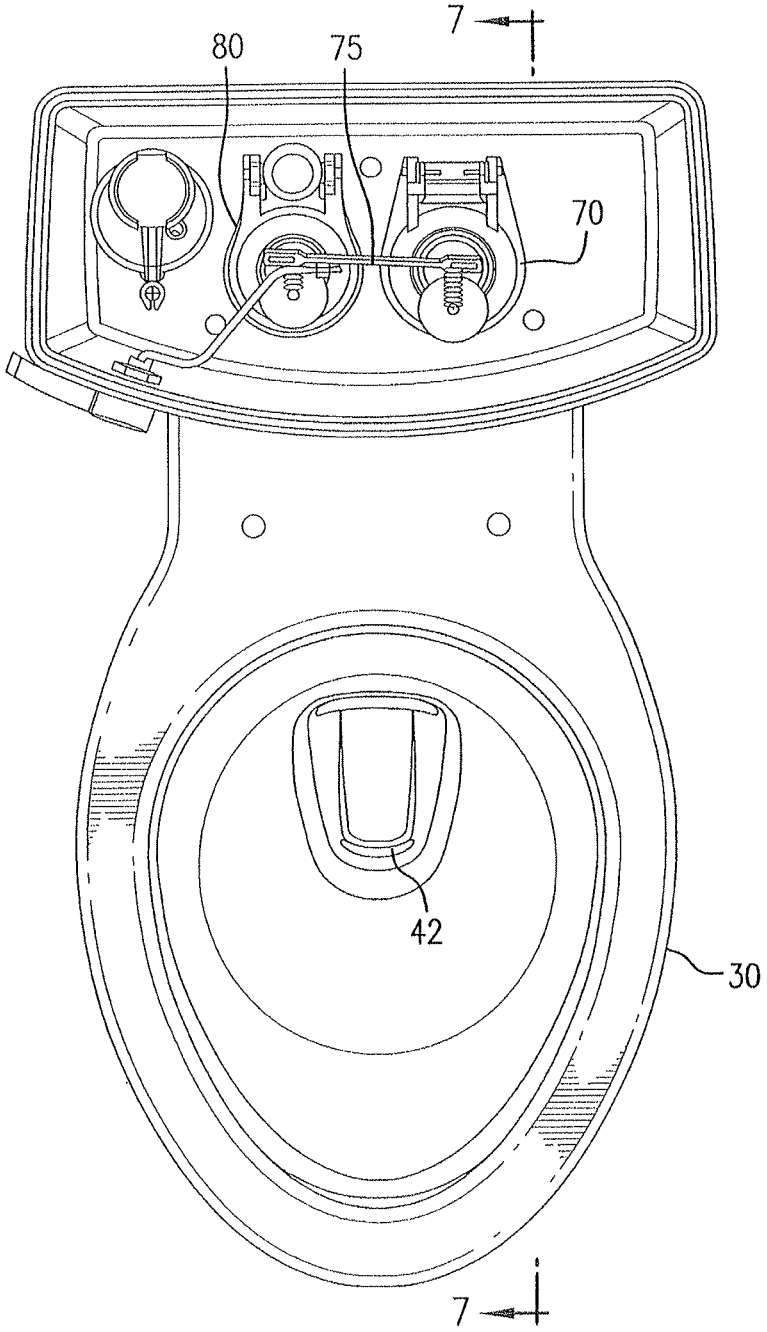
FIG. 8 is a top plan view of the toilet assembly of FIG. 1 having the lid removed from the tank.
Figure 9:
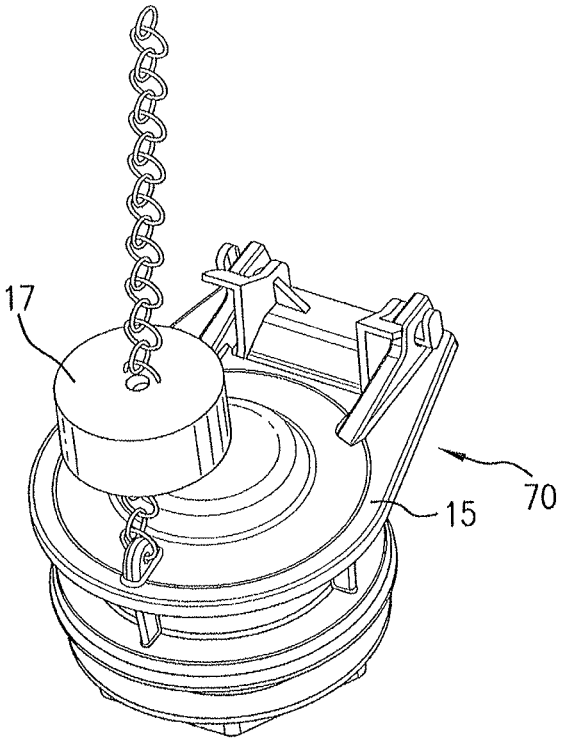
FIG. 9 is a perspective view of the jet flush valve of the toilet assembly of FIG. 1.
Figure 10:
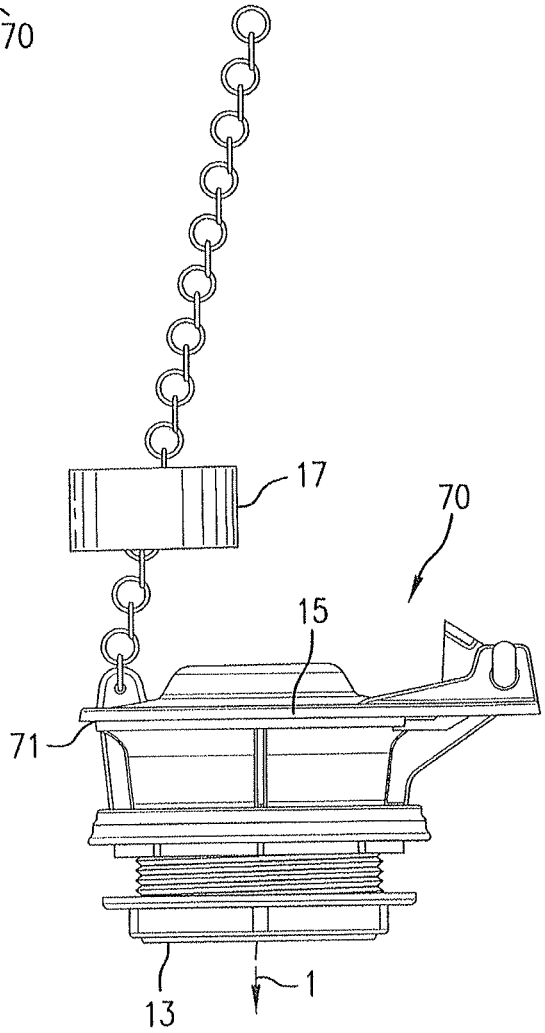
FIG. 10 is a side elevational view of the jet flush valve of the toilet assembly of FIG. 9.
Figure 11:
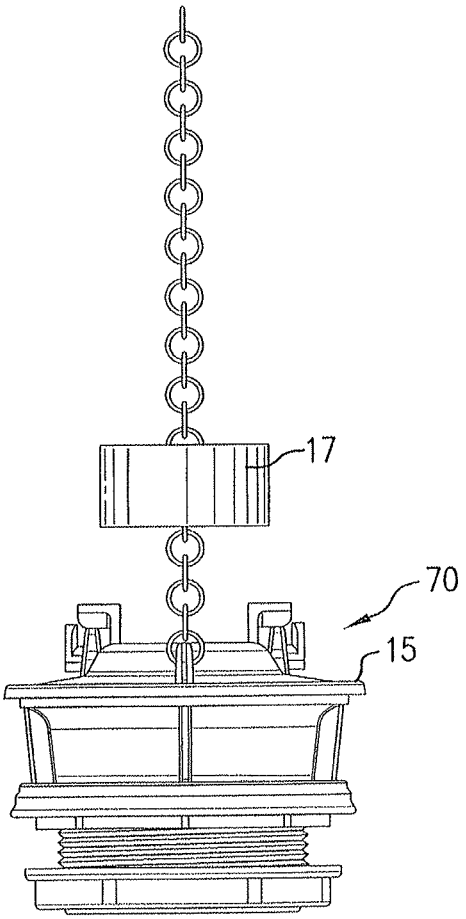
FIG. 11 is a front elevational view of the jet flush valve of the toilet assembly of FIG. 9.
Figure 12:
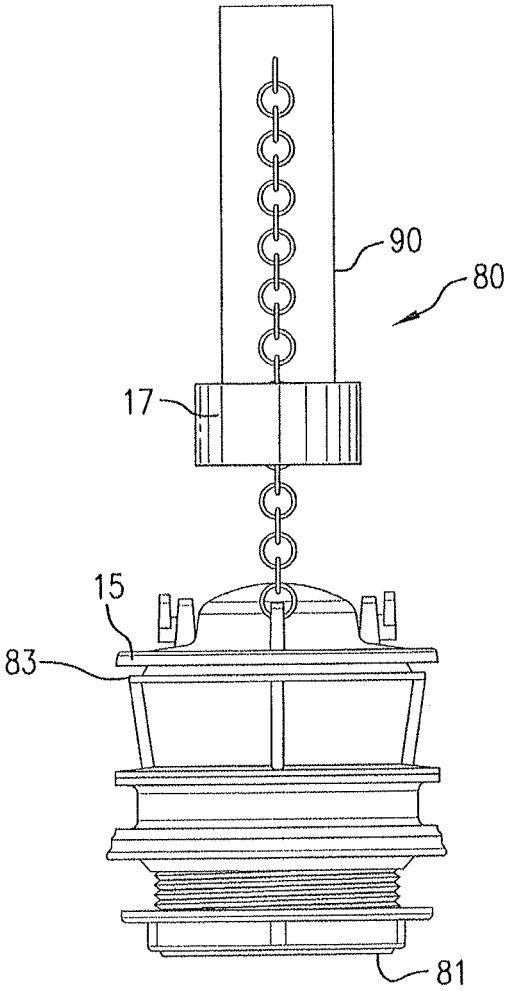
FIG. 12 is a front elevational view of the rim flush valve of the toilet assembly of FIG. 1 having an overflow tube.
Figure 13:
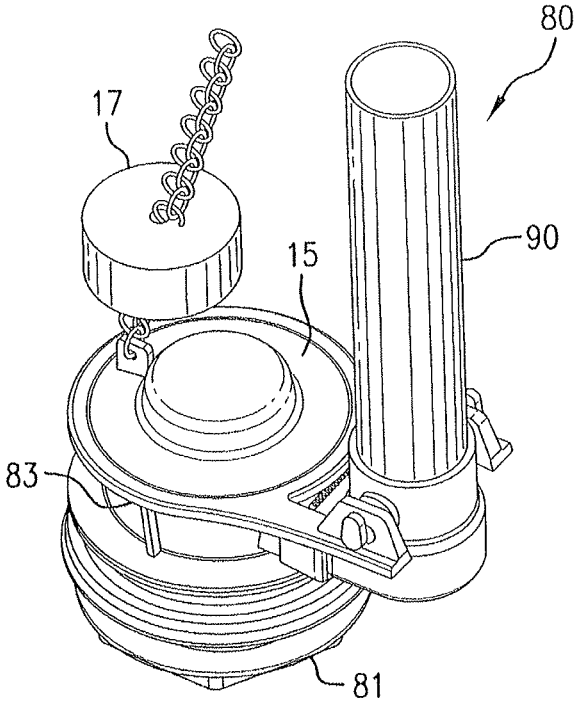
FIG. 13 is a perspective view of the rim flush valve of FIG. 12.
Figure 14:
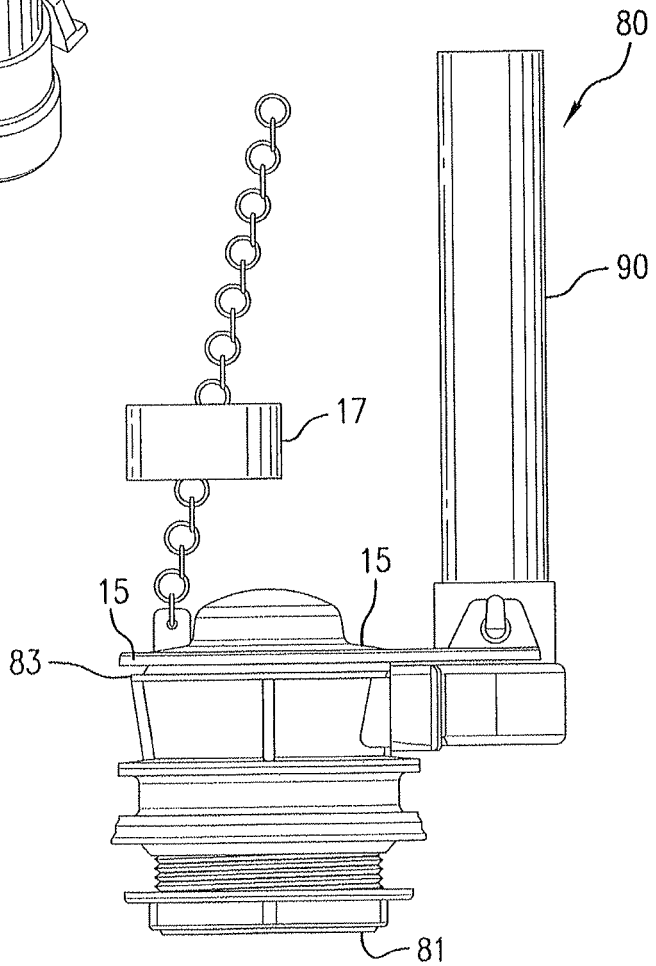
FIG. 14 is a side elevational view of the rim flush valve of FIG. 12.

In the embodiment as shown in FIG. 3, the shelf 27 can extend around almost the entire interior surface before terminating to induce a vortex flow effect for cleaning. A rim shelf design can also accommodate multiple rim shelves and multiple rim inlets as described in co-pending U.S. Publication No. 2013/0219605 A1, incorporated herein by reference in relevant part in terms of describing rimless features and as shown in the alternate "rimless" embodiment 410 of FIG. 28. A similar design as shown in U.K. Patent Application No. GB 2 431 937 A or any future variations of such designs, wherein the bowl is formed without the traditional hollow rim and water is directed around a contoured interior surface of the bowl in an upper perimeter portion forming a shelf or similar geometrical feature in the contour of the bowl surface as shown that allows fluid to pass around at least a partial path around the bowl entering the interior of the bowl at a location(s) which are transversely displaced form the rim inlet may be used as well. It should also be understood that standard rim channels having a rim inlet port that feeds into a rim channel defined by a traditional upper rim, and having one or more rim outlet ports for introducing washing water into the interior area of the bowl may also be used in the embodiment described herein (see FIG. 16 and embodiment 110). Such rim may be pressurized or not pressurized and have various features as described in further details below with respect to the embodiment 110. The rim features of embodiment 110 may be incorporated into the rimless version shown in FIGS. 1-13 or FIG. 28 without departing from the scope of the invention.

Figure 30:
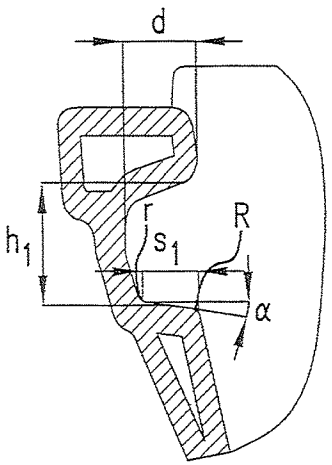
FIG. 30 is an enlarged longitudinal cross-sectional view taken along line 30-30 of FIG. 29 showing the depth of the rim shelf and height of the area formed in the upper peripheral area of the toilet bowl at the location of the rim shelf near the location of the rim inlet port.
Figure 31:
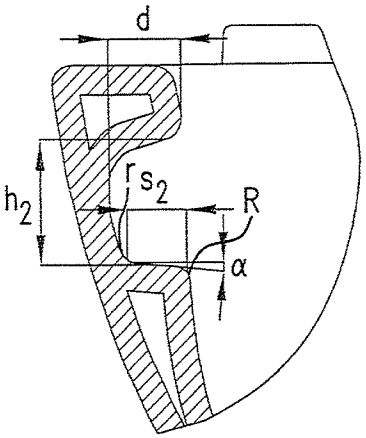
FIG. 31 is an enlarged longitudinal cross-sectional view taken along line 31-31 of FIG. 29 showing the depth of the rim shelf and height of an area formed in the upper peripheral area of the toilet bowl at the location of the rim shelf at a location approximately mid-way between the rear to the front of the bowl.
Figure 32:
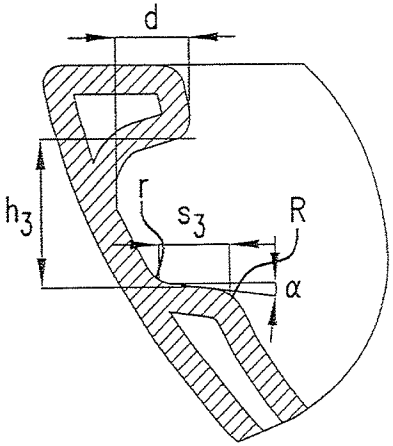
FIG. 32 is an enlarged longitudinal cross-sectional view taken along line 32-32 of FIG. 29 showing the depth of the rim shelf and height of an area formed in the upper peripheral area of the toilet bowl at the location of the rim shelf at a location at the front of the bowl.

In the assembly 10, as noted above, the shelf 17 may be inset. As shown in FIGS. 30-34, the shelf 27 is in a contour having a relatively constant, and preferably constant, depth d as measured transversely from the interior surface of the toilet bowl into the contour and a height h measured longitudinally from the shelf 27 to an upper surface 47 above the shelf. The shelf width s varies along the rim flow path from the rim outlet port. The contour has an inwardly extending portion 43 and an upper surface 47 above the shelf 27 that extends along the shelf but the shelf changes in size to provide a deeper shelf in the area where the contour has a shelf width $s_1$ and a height $h_1$ which is somewhat larger than the depth to accommodate strong flow of fluid from the rim inlet port as seen in FIG. 30, and maintaining a reasonably large shelf size in a position approximately mid-way between the rear and front of the bowl (see, FIG. 31) as rim flow continues along the shelf towards the front of the bowl as shown in FIG. 32 (see $s_2$ and $s_3$). While the depth d is relatively constant, the height h begins to elongate towards the front of the bowl (see $h_2$ and $h_3$) while the shelf width decreases (see $s_2$ and $s_3$). The depth preferably in one embodiment herein remains between about 10 mm to about 30 mm. Height in varies from about 35 mm to about 50 mm at the outset of flow to about 35 mm to about 50 mm at the mid-way point between rear and the front of the bowl, and to about 40 mm to about 55 mm at the front of the bowl. The shelf width is illustrated by s, wherein s is the transverse measurement taken along a tangent from a first curvature radius r at the inset edge of the shelf to the second radius of curvature R where the shelf tips downward. The shelf is at an angle $\alpha$ with the tangent from the first radius. The angle $\alpha$ in this embodiment varies and as shown is 7°, 5°, 7°, 22° and 31° as the shelf progresses along the paths in FIGS. 30-34, respectively. As the angle increases the radii enlarge and the shelf width s disappears in favor of a downward slope as the shelf terminates.

Figure 33:
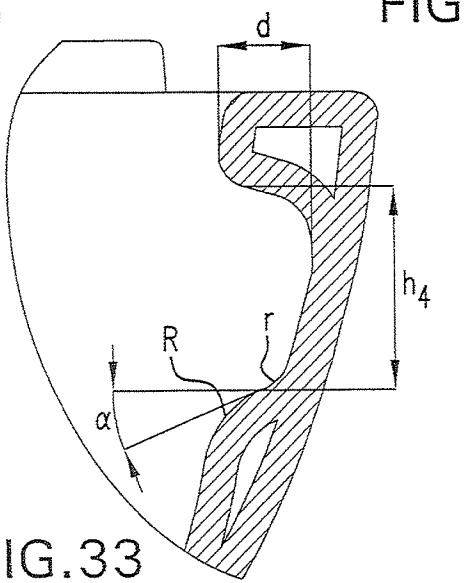
FIG. 33 is an enlarged longitudinal cross-sectional view taken along line 33-33 of FIG. 29 showing the depth of the rim shelf and height of an area formed in the upper peripheral area of the toilet bowl at the location of the rim shelf at a location approximately mid-way between the front and the rear of the bowl on a side of the bowl opposite the view in FIG. 31.
Figure 34:
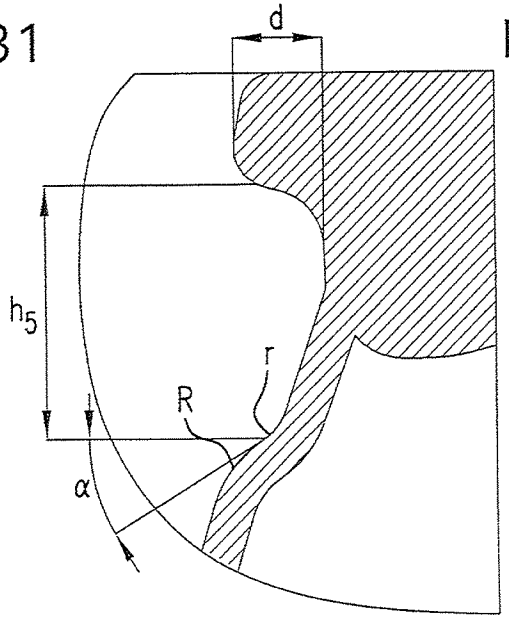
FIG. 34 is an enlarged longitudinal cross-sectional view taken along line 34-34 of FIG. 29 showing the depth of the rim shelf and height of an area formed in the upper peripheral area of the toilet bowl at the location of the rim shelf at a location at the rear of the bowl.
Figure 35:
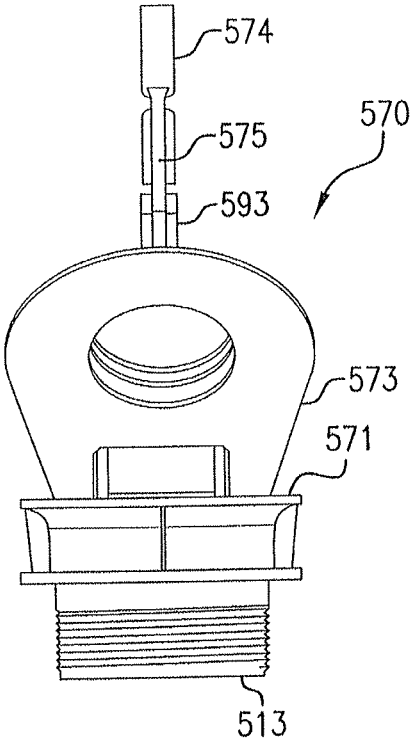
FIG. 35 is a front elevational view of jet valve for use in the embodiments of the invention herein shown in an open state in an embodiment of the jet valve having a flapper and a back flow preventer mechanism with a hold-down linkage.
Figure 36:
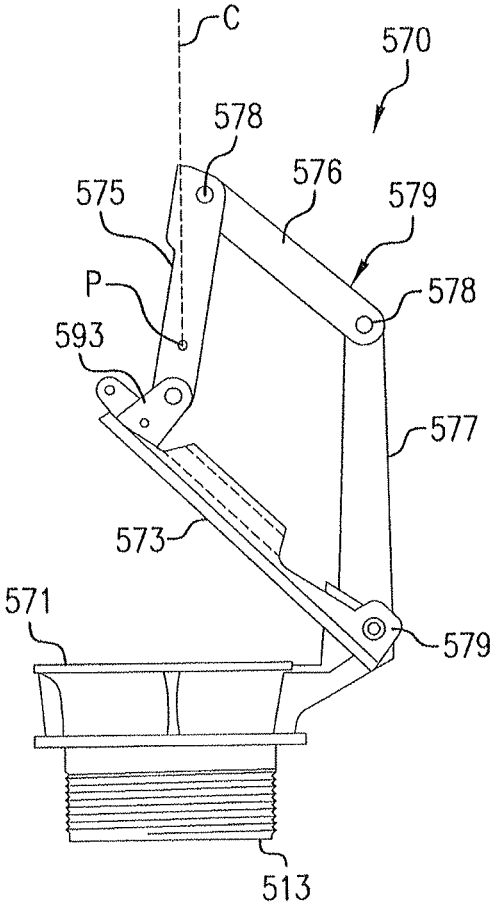
FIG. 36 is a right side elevational view of the jet valve of FIG. 35.

As flow continues to the opposite side of the bowl as shown in FIG. 33 at the mid-way point traveling from the front of the bowl towards the rear of the bowl at FIG. 34, the depth d remains constant, but the height elongates further from about 45 mm to about 60 mm at the mid-way point in FIG. 33 to the rear of the bowl where it is about 50 mm to about 65 mm. As the height elongates ($h_4$ and $h_5$), the shelf 27 decreases to a curve and ultimately terminates.

The bowl assembly also includes a jet 20 defining at least one jet channel, such as jet channels 38. The jet 20 has an inlet port 18 in fluid communication with the outlet 13 of the jet flush valve 70 and a jet outlet port 42 positioned in a lower or bottom portion 39 of the bowl 30. The jet outlet port may be configured in varying cross-sectional shapes and sizes for discharging fluid to a sump area 40 of the bowl 30.

Additional optional areas or pathways may be provided so long as closed jet fluid path is maintained, including multiple jet outlets if desired or multiple additional pathways or openings to space within the bowl, provided the space is primed and any holes or outlets are below the water line in the sump to avoid impact on the jet trap seal depth. Additional jet outlets are preferably below the primary outlet. As best seen in FIGS. 3C to 3G the shape of the internal jet including space created by the bowl geometry around the channels 38 is larger than the channels themselves and extends between inlet 18 and outlet 13. The jet shape is illustrated in the top plan view, bottom perspective view, right side elevational view, back view and left side elevational views of FIGS. 3C to 3G, respectively. The shape or common areas may vary provided the interior space of the jet 20 remains primed in use.

The sump area 40 is in fluid communication with an inlet 49 to the trapway 44 having a weir 45. The closed jet fluid pathway 1 includes the jet channel(s) 38. The jet flush valve 70 is preferably positioned at a level L above the weir 45 of the trapway. The closed jet fluid pathway 1 preferably extends from the outlet 13 of the jet flush valve 70 to the outlet port 42 of the jet 20. Once the assembly is primed, the closed jet fluid pathway 1 is capable of remaining primed with fluid to keep air from entering the closed jet fluid pathway before actuation of and after completion of a flush cycle.

The closed jet fluid pathway may include a jet manifold (not shown) by inserting a space or area between the inlet and the jet path and providing fluid communication through a jet manifold inlet opening and an outlet (not shown). The toilet bowl assembly may have a rim manifold (not shown). Any such rim manifold would also have to have a rim manifold inlet opening in communication with the outlet 81 end of the rim flush valve assembly 80 and for receiving fluid from the outlet 81 of the rim flush valve assembly 80 and an outlet to deliver flow to the rim inlet. Such rim and jet manifolds are described in the embodiment of FIG. 16. In embodiment 10 herein, the rim 32 is a rimless shelf (although traditional rims with a rim channel may also be used). The shelf extends at least partially around the bowl.

The assembly preferably includes a tank 60 that is in fluid communication with a source of fluid (SF) which may be city water, tank water, well water or the like so that when installed, the assembly is installed, the tank 60 can accept a flow of fluid through the tank into the fill valve. The tank preferably has at least one fill valve 66. The fill valve may be any suitable fill valve commercially available or to be developed so long as it provides an adequate supply of water to maintain desired volume in the tank to serve the functions described in this disclosure. The tank 60 may be one large open container holding both the rim and jet flush valve assemblies as shown in FIGS. 1-13. The tank may also be modified as described below with respect to embodiment 1010 to have at least one jet reservoir and at least one a rim reservoir. If a divided reservoir is provided, the jet reservoir may include a fill valve or a jet fill valve along with the at least one jet flush valve assembly 70, and the rim reservoir may include the at least one rim flush valve assembly and a tank or rim fill valve. If desired, such a rim reservoir may further accommodate an overflow tube 91 on the rim flush valve assembly 80.

The toilet bowl assembly of FIGS. 1-13 like other embodiments herein is capable of operating at a flush volume of no greater than about 6.0 liters, and preferably no greater than about 4.8 liters, and even more preferably no greater than about 2.0 liters.

The sump area 40 of the bowl preferably has a jet trap 41 defined by the interior surface 36 of the bowl 30 in a lower portion 39 of the bowl. The jet trap 41 has an inlet end 46 and an outlet end 50. The inlet end 46 of the jet trap receives fluid from the jet outlet port 42 and the interior area 37 in a lower portion 39 of the bowl 30 and the outlet end 50 of the jet trap 41 includes and flows into the inlet 49 to the trapway 44. The jet trap has a seal depth as described further hereinbelow. All variations described below with respect to seal depth, jet paths and the measurement of the depth x as shown in embodiment 10, shown, e.g., in FIGS. 1-13 and 29-34 are also readily incorporated into and operable in the embodiment 110 of FIG. 16.

To maintain a siphonic flush toilet assembly such as assembly 10 in a primed state, the initial step is to provide a toilet bowl assembly having the features as described hereinabove and with respect to the various other embodiments herein including 110, 1010, 210, 310 and 410, etc., particularly wherein the closed jet fluid pathway 1 having the jet channel 38 therein extends from the outlet 13 of the jet flush valve 70 to the outlet 42 of the jet 20 so that once primed, the closed jet fluid pathway is capable of remaining primed with fluid to keep air from entering the closed jet fluid pathway before actuation of and after completion of a flush cycle. The flush cycle is actuated by any suitable actuator such as a flush handle H. In one preferred embodiment, the chinaware exterior and the handle H are formed from or incorporate materials herein providing an antimicrobial surface. After initiating the flush cycle by a flush actuator, such as a handle, the handle has a portion in operative connection (which may be detachable or not detachable) to a flush activation bar 75.

Figure 15:
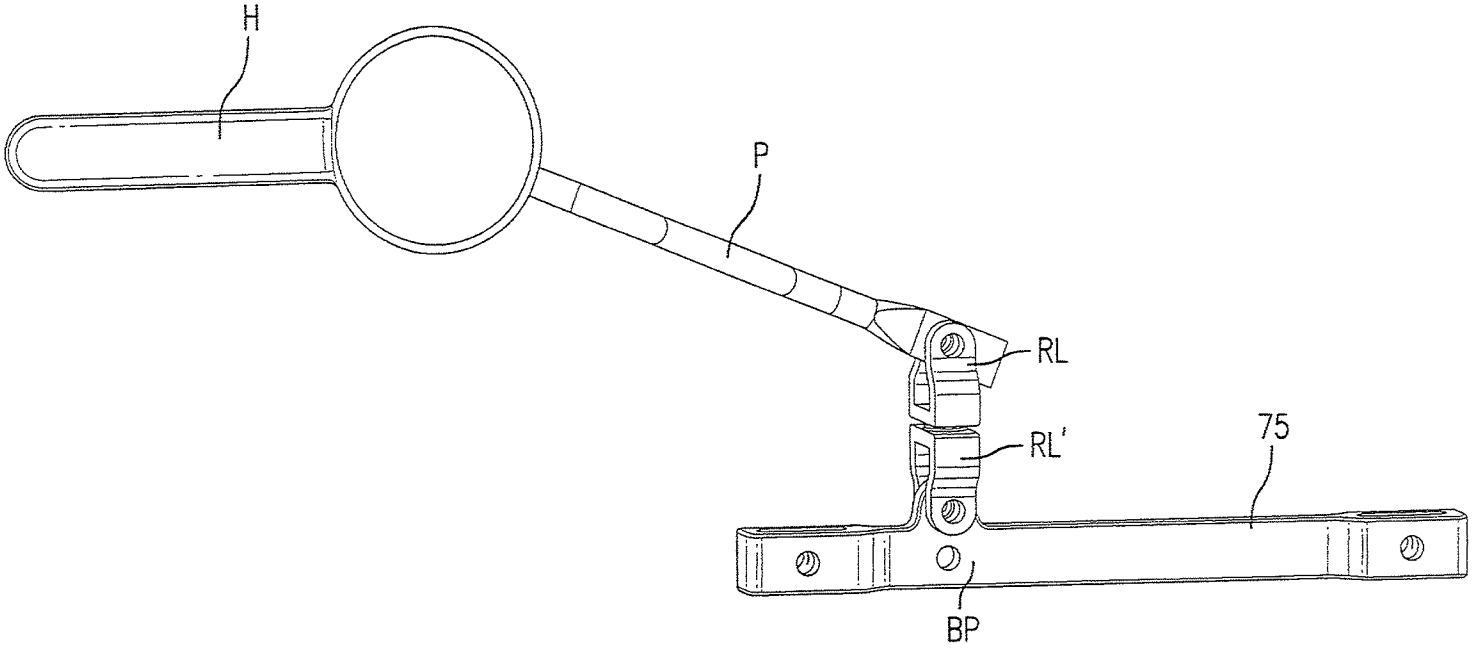
FIG. 15 is a perspective view of a flush actuation bar for the rim and jet valves of the toilet assembly of FIG. 1.

The valves can have an actuator that enables both to open at the same time (which may be done with a standard actuation bar of a flush handle) or can have a timing change and/or adjustment for lift based on the weight of the respective flush valve covers by using a flush actuation handle such as that of FIG. 15 which provides a balancing approach. As best shown in FIG. 15, handle H is in operative connection with a pivot rod P having a rotatable movement linkage RL. Any hinge, pin connection, washer or other rotating connector may be used. The flush activation bar 75 has a balance point BP for movable connection to the pivot rod P through linkage RL. A similar movable and rotatable linkage RL' (which may be the same as rotatable linkage RL) connects the pivot rod and its linkage RL to the flush activation bar 75 at the balance point BP. The balance point is chosen by design to operate with the flush valves so as to specifically and mechanically time the opening of each valve when the handle H is depressed to actuate the flush cycle. When handle H is depressed, the pivot rod P and linkage RL are pushed upward at the end having linkage RL. This in turn pulls up on the activation bar 75. It is possible to provide a bar 75 having multiple holes to provide linkages for varying balance points so that only one bar need be manufactured but can be used for a variety of valve cover weights and flush timing patterns. Although the flush activation assemblies are described in relation to a siphonic flush toilet, it is understood that the flush activation assemblies may be used with any style flush toilet, including washdown toilets.

Figure 69:
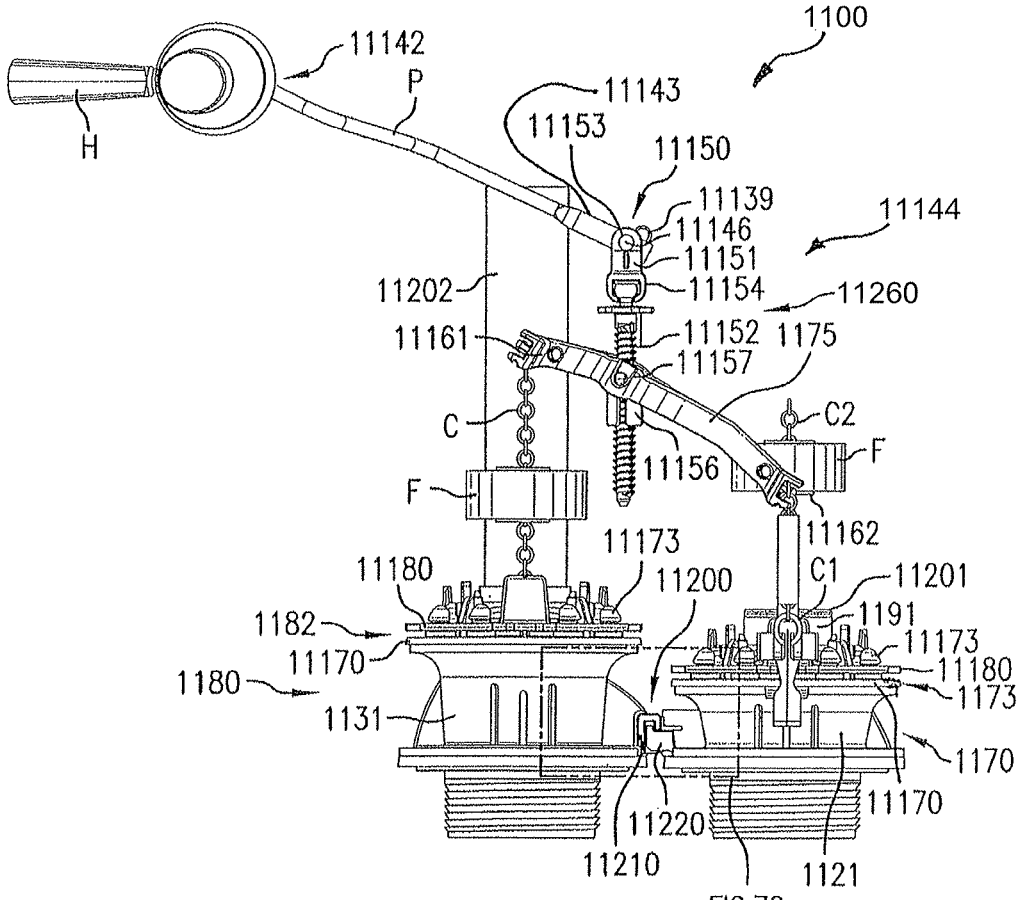
FIG. 69 is a front elevational view of an assembly kit according to an embodiment herein including a flush activation assembly connected to two valve assemblies.
Figure 70:
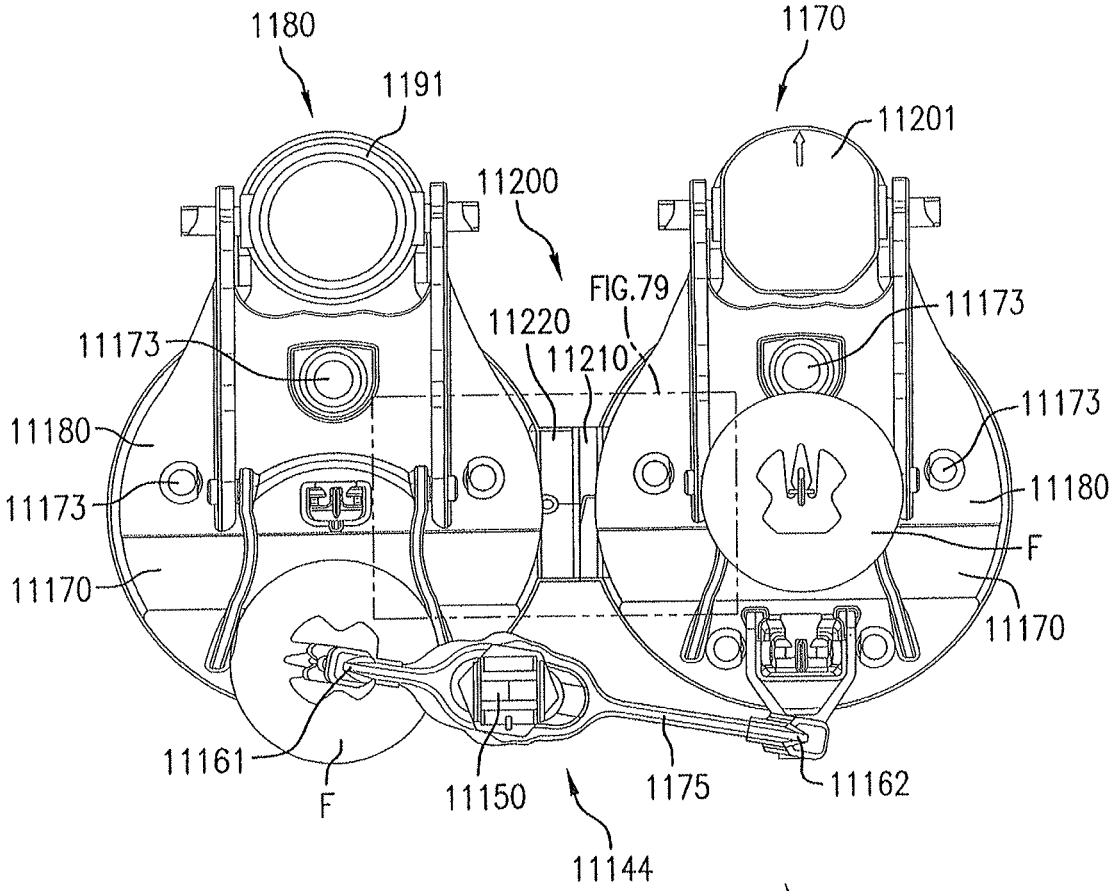
FIG. 70 is a top plan view of the assembly kit of FIG. 69.
Figure 85:
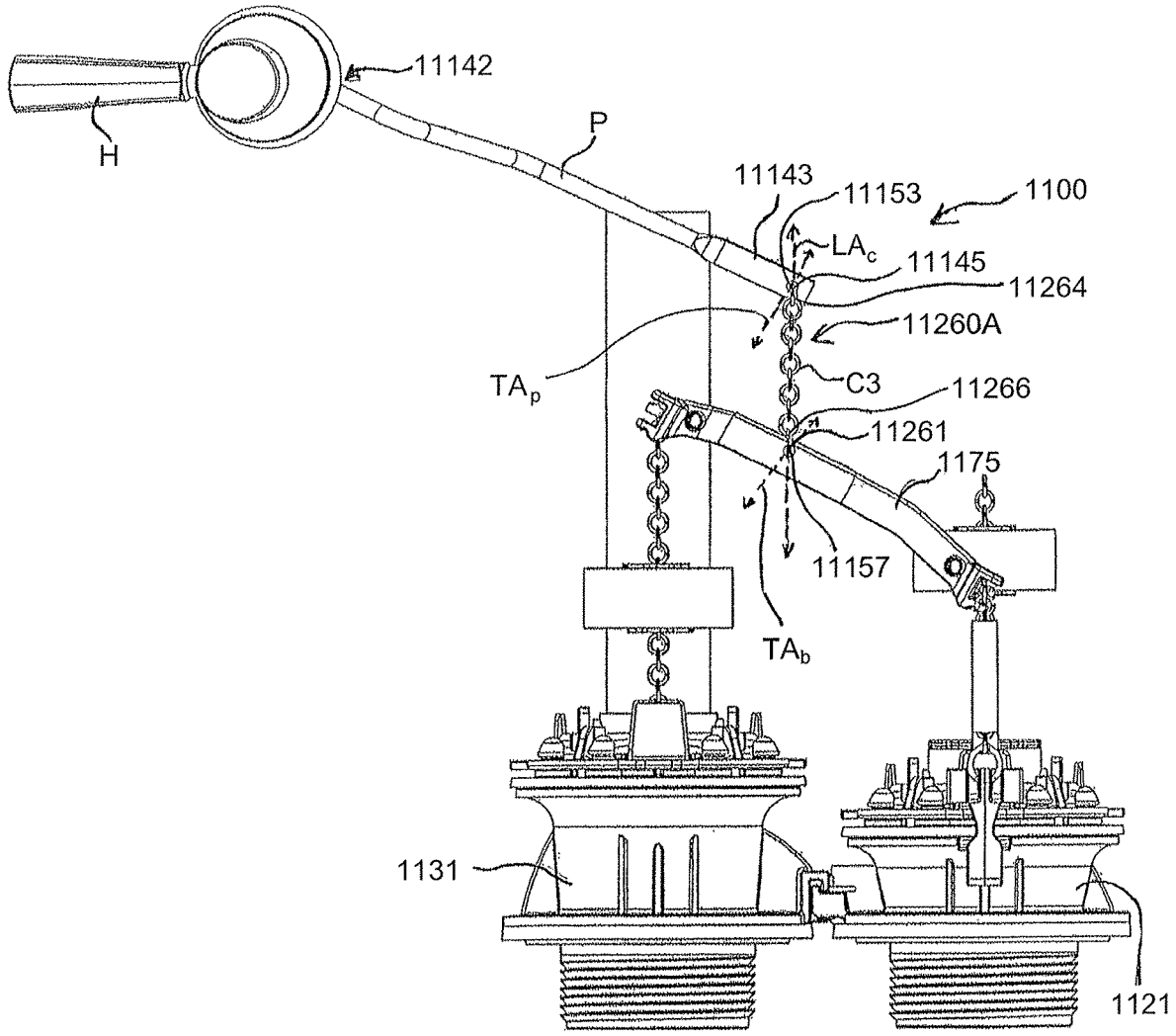
FIG. 85 is a front elevational view of the assembly kit of FIG. 69 including an alternate embodiment of a connector within the flush activation assembly.

An assembly kit 1100, as shown in FIGS. 69-70 and 85 may be provided to improve the activation and communication between the handle H and one or more valves. The assembly kit 1100 may have a flush activation assembly 11144 that includes a pivot rod P, a flush activation bar 1175 and a connector 11260. One end 11142 of the pivot rod P may be connected to the handle H located on the exterior of the tank, or any other flush activation mechanism, while the opposite end 11143 of the pivot rod P may be connected to the connector 11260 using a rotatable connection. The pivot rod P may be any standard or a conventional pivot rod, or adjusted to the size and configuration of the tank. As shown in FIG. 85, the location of the connection element 11145 on the pivot rod P, which may be one or more opening(s) may be positioned at different locations along the pivot rod with respect to the valve openings depending on the manufacturer of the pivot rod, or toilet tank. Each manufacturer may have a slightly different location for the connection element 11145 along the length of the pivot rod P, or the shape of the pivot rod P itself may be varied. The variations of the embodiment described herein for a connector 11260 may be used to compensate for the different locations of the connection element, as such, it is contemplated that substantially any pivot rod P, as well as other non-conventional flush actuators are compatible with the present embodiment. The variations of the embodiment of the connector described herein may also be useful to counteract variations in the exact positioning of handle H and pivot rod P with respect to valve bodies 1131 and 1121 due to variations in handle and pivot rod configurations, and/or variations in tank size. As such, the connector may ensure that a proper amount of lift is provided to the valves to trigger the desired activation.

As shown in FIG. 85, the connector 11260A is shown as a chain C3 that is hooked to a connection element 11145 in the pivot rod P at a first chain end 11264 creating a first rotatable connector 11153 and a connection element 11261 on the flush activation bar 1175 at a second chain end 11266 creating a second rotatable connector 11157. The flush activation bar 1175 and pivot rod P in each variation of the embodiment may be the same as the flush activation bar and pivot rod described in more detail below regarding use of the adjustable flush connector 11150 as illustrated in FIGS. 69-72. Depending on the type of connector 11260 used, the connection elements on the pivot rod and the connector may be varied to form a rotatable connection between these elements. The connector 11260 should provide at least partial rotational movement about its longitudinal axis $LA_c$ (FIG. 85) such that the flush activation bar 1175 may rotate about axis $LA_c$ in relation to the pivot rod P, but pivot rod P does not rotate about axis $LA_c$. Additionally, the first rotatable connector 11153 between the pivot rod P and the connector 11260 should be rotationally positionable about the transverse axis $TA_p$ of the pivot rod P. The second rotatable connector 11157 between the flush activation bar 1175 and the connector 11260 should be rotationally positionable about the transverse axis $TA_b$ of the flush activation bar 1175. Preferably, the connector 11260 is an adjustable flush connector 11150, as shown in FIGS. 69 and 70 and described in more detail below. Additional variations of this embodiment of the connector that are sufficient to provide rotational movement of the flush activation bar 1175 in relation to the pivot rod P are also acceptable connectors and are shown in FIGS. 86 and 87.

Figure 86:
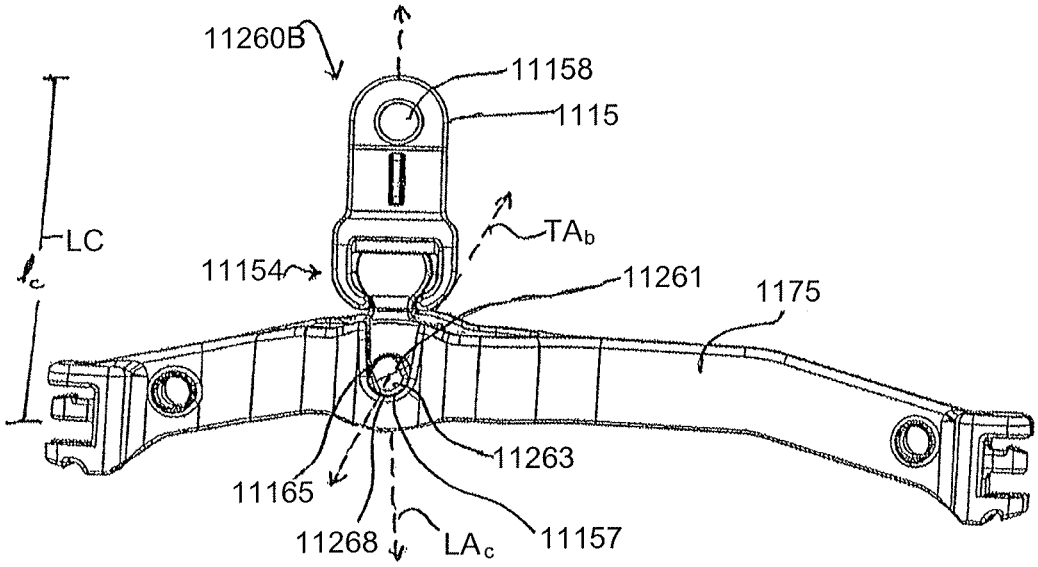
FIG. 86 is a front elevational view of an alternative embodiment of a connector and the flush activation bar in the assembly kit of FIG. 85.
Figure 87:
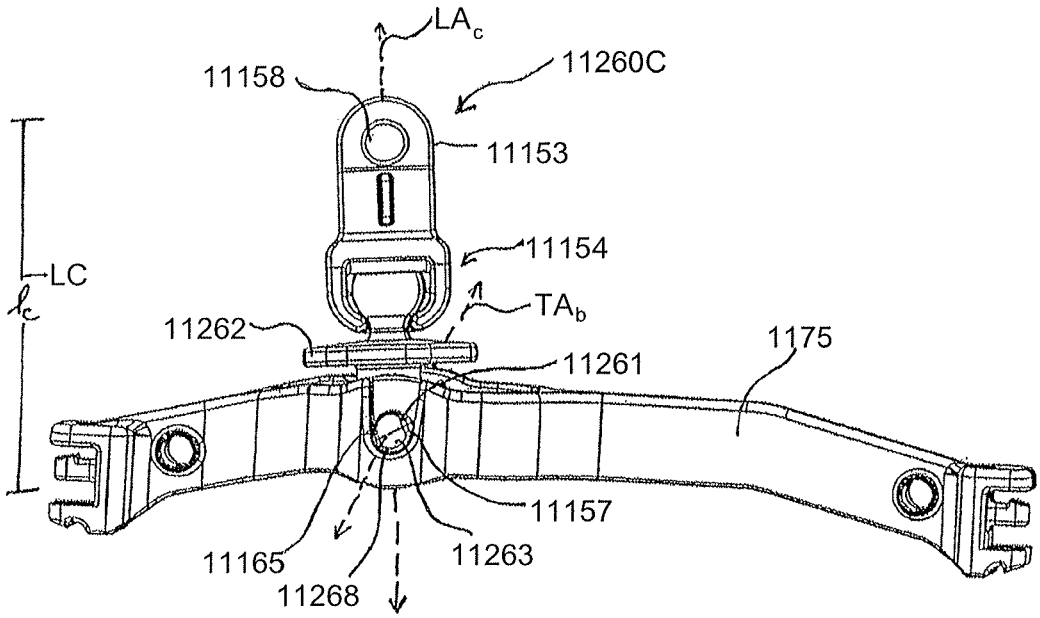
FIG. 87 is a front elevational view of a second alternative embodiment of a connector and the flush activation bar in the assembly kit of FIG. 85.

FIGS. 86 and 87 show additional variations of connector 11260B and 11260C that provide rotational movement about their longitudinal axis $LA_c$. The rotational movement about the longitudinal axis $LA_c$ of these variations of the connector is provided by a ball and socket connector 11154 that is located along the length $l_c$ of the connector preferably at the longitudinal center point LC. A similar ball and socket connector 11154 will be discussed in further detail below with regard to a variation of embodiment 1100 using an adjustable flush connector 11150 shown in FIG. 69 as an alternative embodiment for the connector 11260. Regarding FIG. 87, a spacer 11262 may be located between the ball and socket connector 11154 and the flush activation bar 1175. The spacer 11262 may be included to provide easier rotation of the flush activation bar 1175 about the longitudinal axis, but it is not necessary for the connector to function properly.

In FIG. 85, the first rotatable connector 11153 between the connector as shown as a chain 11260A and the pivot rod P may be a hinge-type connection wherein a pin 11146 is inserted through opening 11158 located on the connector 11260A. It is understood that any connection between the connector 11260 and the pivot rod P that allows for the rotation about the transverse axis $TA_p$ of the pivot rod may be used, including a hook inserted into a hole, the use of protrusions on one element inserted into openings or depressions on the other, a ball-and-socket style joint, as well as any other known connections. Similar connections between the pivot rod P and the connector 11260 will be discussed in further detail below with regard to the adjustable flush connector 11150 in FIGS. 69-72.

Likewise, the second rotatable connector 11157 between the flush activation bar 1175 and the connector 11260 may be the same as or different than the connection used for the first rotatable connector 11153 between the connector and the pivot rod. As shown in FIGS. 86 and 87, a hinge-type connection 11268 may be used wherein protrusions 11263 are integrally formed on the connectors 11260B and 11260C. These protrusions 11263 may be inserted into openings 11165 in the flush activation bar 1175 through spring and/or torsional compression of the protrusions and/or the sides of the flush activation bar. The flush activation bar 1175 may freely rotate about the transverse axis of the flush activation bar $TA_b$. Additional types of connection devices suitable for use with the second rotatable connector 11157 are also contemplated, including the use of a pin through openings in both elements, a hook inserted within an opening, a ball-and-socket-type joint, as well as any other rotatable connection that is known or to be developed. Similar connections between the connector 11260 and the flush activation bar 1175 will be discussed in further detail below with regard to the adjustable flush connector 11150 in FIGS. 69-72.

Although several exemplary variations of connector 11260A-C have been described herein, it is understood that any connector 11260 that provides rotational movement about the longitudinal axis $LA_c$ may be used in a flush activation assembly. Such rotational movement may allow for the flush activation bar to be located in the proper position to actuate the valve assemblies. Preferably the connector 11260 may be an adjustable flush connector 11150, and the flush activation assembly may be configured as described below.

Figure 71:
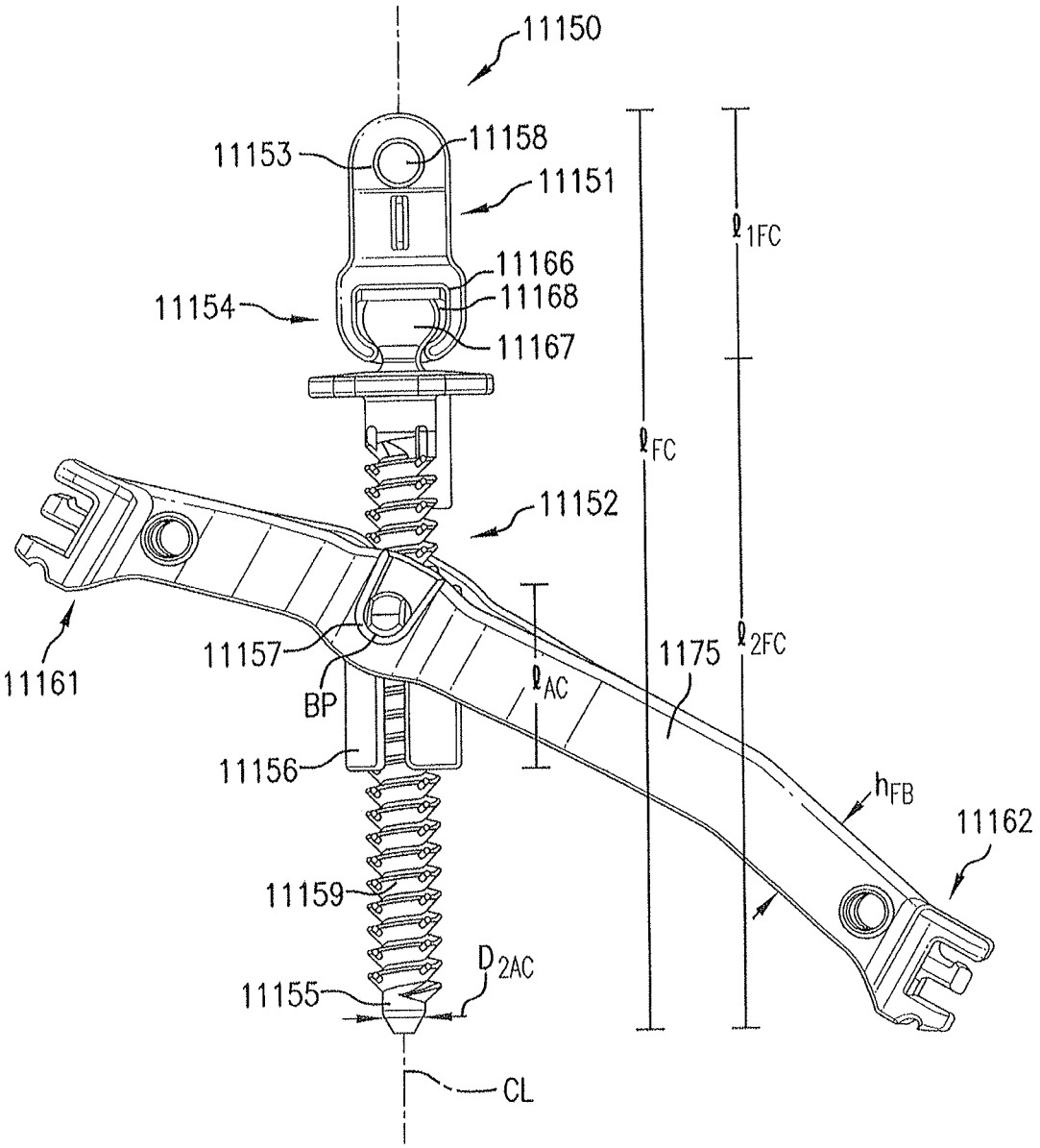
FIG. 71 is a front elevational view of the adjustable flush connector and the flush activation bar in the assembly kit of FIG. 69.
Figure 72:
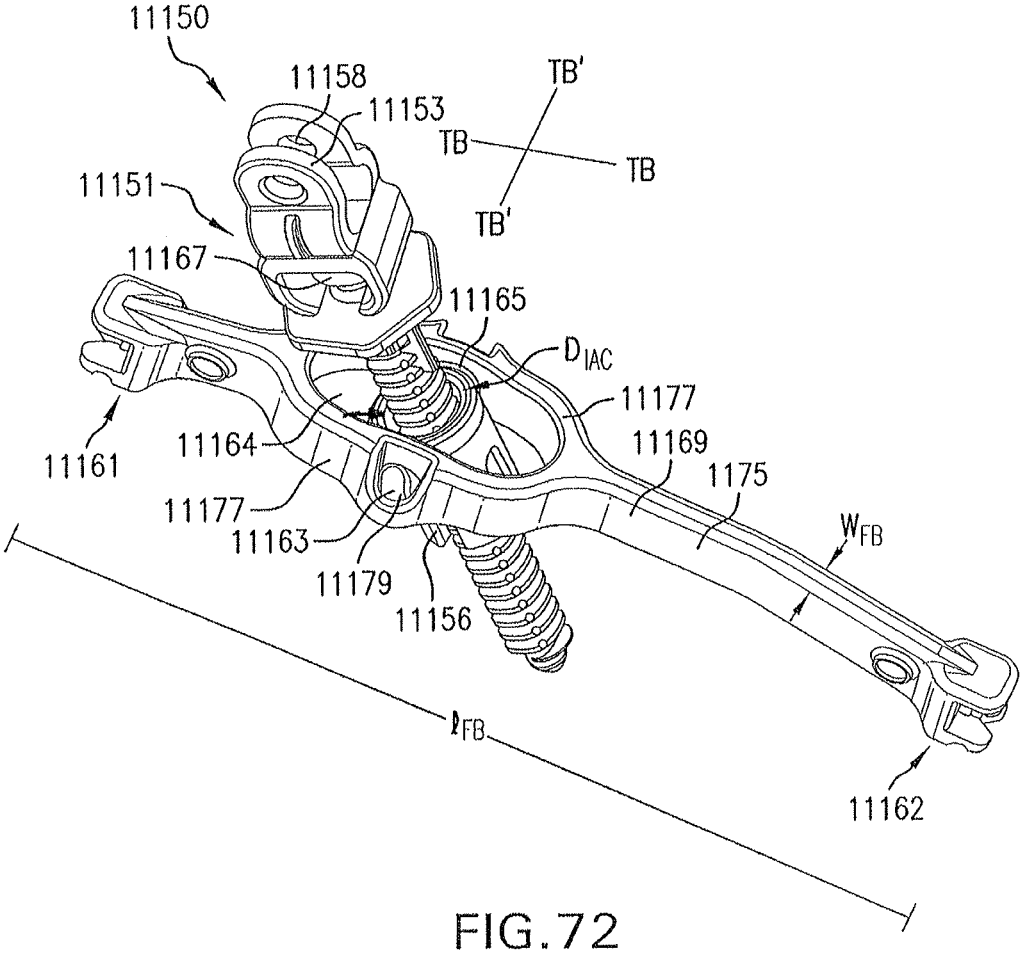
FIG. 72 is a perspective view of the adjustable flush connector and the flush activation bar of FIG. 71.

FIG. 71 shows a front perspective view and FIG. 72 shows a top perspective view of the adjustable flush connector 11150 shown in FIGS. 69 and 70. The prefer able adjustable flush connector 11150 is configured such that it is suitable to work with a variety of different pivot rods P and/or a variety of different valve configurations. The configuration of the adjustable flush connector 11150 may have connection elements that are adjustable in relation to each other in at least one direction. The adjustability of the configuration may include rotation about its longitudinal axis, rotation about a transverse axis and/or movement along its longitudinal axis. Specific preferable structures for this purpose are discussed in further detail below. The adjustable flush connector 11150 preferably has a first section 11151, a second section 11152 and an adjustable connector 11156.

The first section 11151 preferably has a first rotatable connector 11153, which is configured to be connectable to the pivot rod P. The configuration of the connection with the pivot rod P is such that when the end 11143 of the pivot rod P that is connected to the adjustable flush connector 11150 is moved upwardly, the adjustable flush connector 11150 also moves upwardly. The end 11143 of the pivot rod P connected to the adjustable flush connector 11150 may move upward when the handle H is depressed. The first rotatable connector 11153 may include a structure that allows the first rotatable connector to at least rotate about an axis transverse to the longitudinal centerline CL of the adjustable flush connector 11150, such configurations may include one or more openings in which a pin, or hook may be inserted, a hook to be inserted within a hole, a ball-and-socket joint, a snap fastener, other hinged structure, or any other known connection.

The adjustable flush connector 11150 is preferably connected to the pivot rod P through the use of the first rotatable connector 11153. An opening 11158 in the first rotatable connector 11153 is preferably aligned with an opening in the end of the pivot rod 11143. Once the openings are aligned, a pin 11146 may be inserted through the openings and secured on the side opposite from the side in which the pin was originally inserted. The pin is preferably secured by inserting a cotter pin 11139 within an opening in the end of the pin that was inserted through the openings. Other ways of securing the pin are possible, including using a spring-loaded pin, split pin, or other pin that preferably does not allow the pin 11146 to be removed from the openings. Although the method of inserting a pin 11146 through openings for connecting the adjustable flush connector 11150 to the pivot rod P is preferred, it is understood that any method of connecting the two elements that allows for the rotation of the adjustable flush connector 11150 with respect to the pivot rod P may be used. The rotational aspect of the first rotatable connector 11153 allows the longitudinal centerline CL of the adjustable flush connector 11150 to remain perpendicular to the tank bottom while being moved upwardly by the pivot rod P.

The second section 11152 of the adjustable flush connector 11150 may be connected to the first section 11151 of the adjustable flush connector 11150 through the use of a ball-and-socket connector 11154. The ball-and-socket connector 11154 allows the second section 11152 to rotate about the longitudinal centerline CL of the adjustable flush connector 11150 in relation to the first section 11151. The ball-and socket connector 11154 also allows the second section 11152 to swing back and forth like a pendulum along any plane that intersects the longitudinal axis, this motion allows the longitudinal axis of the second section 11152 the freedom to not be perpendicular to the bottom of the tank at all times. The ball-and-socket connector 11154 is one possible type of connector that may be used between the sections 11151, 11152 that allows for the second section 11152 with respect to the first section 11151 to both rotate about the longitudinal axis and swing back and forth along a plane intersecting the longitudinal axis of the second section. However, it is understood that any type of connector that allows for rotation of the sections 11151 and 11152 with respect to each in only one of these ways may also be used, including a hook and loop or hinged connection using a pin along with openings in one or both sections 11151 and 11152. It is also understood that the adjustable flush connector 11150 may be a single unit having no movement or rotation capable between the first 11151 and second 11152 sections.

Each of the first section and the second section may independently be made of either polymeric material or metal, preferably they are of dissimilar materials to prevent mating parts from binding. It is preferred that the first section 11151, including the ball and socket connector 11154 be molded as a single unit from a polyester material. The second section 11152 is preferable formed of acetal material. Other materials, including other polymers, as well as various metals or alloys, are also contemplated for use in forming the first and/or second sections. Both the first section and the second section are preferably formed through heat molding, such as an injection molding process. It is understood that other methods may also be used to create the first and second sections of the adjustable flush connector 11150, including resin casting, compression molding, or three dimensional printing. It is also understood that each section can be created using a different process. The length $l_{FC}$ of the entire adjustable flush connector 11150 as measured along its longitudinal center line CL is preferably between about 60 mm and about 130 mm. The length $l_{FC}$ of the first section 11151 is preferably between about 10 mm and about 50 mm and the length $l_{2FC}$ of the second section 11152 is preferably between about 50 mm and about 100 mm.

The first section 11151 preferably includes the socket element 11166 of the ball-and-socket connector 11154 and the second section 11152 preferably includes the ball element 11167 of the ball-and-socket connector 11154. Both the socket 11166 and the ball 11167 may have a generally spherical shape. The ball element 11167 of the second section 11152 is preferably sized so that it fits within the socket element 11166 of the first section 11151 and is held such that movement along the longitudinal axis with respect to the first section 11151 is minimal. The ball 11167 should be sized so that it freely moves within the socket 11166. The outer surface of the ball may be in contact with the inner surface of the socket, but if contact does occur, it should be such that the friction created between the elements does not interfere with the freedom of the ball 11167 to rotate within the socket 11166. However, the use of additional force to rotate the elements with respect to each other due to friction is also acceptable.

The second section 11152 of the adjustable flush connector 11150 has an outer surface 11155 that may have optional threads 11159 so as to be configured to threadingly connect with an adjustable connector 11156. The preferable diameter $D_{2AC}$ of the outer surface 11155 exclusive of threads of the second section 11152 is between about 3 mm and about 12 mm. The threads 11159 on the surface 11155 of the adjustable flush connector 11150 may extend along the entire length of the second section 11152 excluding the ball 11167, or other connector element. However, it is understood that only a portion of the surface 11155 may be threaded. If only a portion of the surface 11155 has threads 11159, at least about 20 mm should be threaded, sufficient for the adjustable connector 11156 to engage with this surface 11155. Additionally, it is understood that the surface 11155 does not have to include any threading.

The adjustable connector 11156 may have a longitudinal length $l_{AC}$ between about 10 mm and about 30 mm. The diameter $D_{1AC}$ of the interior surface of the adjustable connector 11156 as measured along a transverse center line through the adjustable connector 11156 is between about 4 mm and about 15 mm. The diameter $D_{1AC}$ of the interior surface should be compatible with the diameter of the outer surface $D_{2AC}$ of the second section 11152 such that the second section 11152 is capable of being inserted within the adjustable connector 11156. The adjustable connector is preferably injection molded from a polyester resin or other polymer material. However, any method of making the adjustable connector may be used including resin casting, compression molding, or three dimensional printing. To avoid binding of components, the adjustable connector 11156, which mates with the flush activation bar 1175 and the adjustable flush connector 11150 should be of a dissimilar material to each of these components.

The adjustable connector 11156 may preferably have mating threading on an interior surface, defining a passage through the adjustable connector 11156, such that the adjustable connector 11156 may be threaded onto the surface 11155 of the second section 11152 of the adjustable flush connector 11150 having threads 11159. The screw-like connection allows the adjustable connector 11156 to be longitudinally adjustable along the length of the second section 11152 and rotationally positionable about the longitudinal axis of the second section 11152. The use of threading to connect the adjustable connector 11156 to the second section 11152 is a preferred embodiment, however it is understood that other methods of connecting the adjustable connector 11156 to the second section 11152 may be used. Such connections may include a slidable connector with a clamping member, as well as any other connection that allows the adjustable connector 11156 to be longitudinally movable along the second section 11152 and rotationally positionable about the longitudinal axis of the second section 11152. The second section 11152 may also be configured such that a separate adjustable connector 11156 is not necessary. Such a second section 11152 may include one or more projections or one or more openings located along the length of the second section for connecting with the flush activation bar directly. The position of the flush activation bar 1175 would be adjustable along the length of the second section 11152 by selecting the location for direct connection using projections or openings on the flush activation bar 1175 with the openings or projections on second section 11152. Additionally, the angle of the openings and/or projections in the second section 11152 may be varied about the longitudinal center axis, so that the flush activation bar could also be rotationally positionable about the longitudinal axis of the second section.

The adjustable connector 11156 preferably has a second rotatable connector 11157. The second rotatable connector 11157 is configured to connect the flush activation bar 1175 to the adjustable connector 11156 at a balance point BP on the flush activation bar 1175. The configuration of the second rotatable connector 11157 is such that the flush activation bar 1175 is rotatable about a transverse line extending across from side to side of the adjustable connector 11156. Specific preferable configurations are included below. The balance point BP is preferably located such that when the flush activation bar 1175 is lifted, which typically happens in response to the depression of the handle H or the lifting of the end 11143 of the pivot rod P connected to the adjustable flush connector 11150, the timing of the opening of each valve with respect to the other is optimized. An embodiment regarding the timing optimization between the openings of the valve covers has been described above, and is shown in FIG. 15.

The flush activation bar 1175 preferably has a bar body 11169 with a preferable length $l_{FB}$ of the flush activation bar 1175 between about 90 mm and about 130 mm. The preferable width $w_{FB}$ of the flush activation bar 1175 is between about 2 mm and about 5 mm, and the preferable height $h_{FB}$ of the flush activation bar 1175 is between about 5 mm and about 15 mm. The cross-section of the flush activation bar 1175 may substantially rectangular. However, any shape cross section, including, circular, oval, hexagonal, triangular, etc. could be used as understood by one skilled in the art based on this disclosure. The flush activation bar 1175 may be made from a polymeric material, metal or metal alloy and is preferably injection molded using acetal. However, any method of making including resin casting, compression molding, or three dimensional printing may be used to make the flush activation bar.

The flush activation bar 1175 preferably has two side arms 11177. The two side arms 11177 form and define a large opening 11164 in the bar body 11169 that is preferably located around the balance point BP of the flush activation bar 1175. The large opening 11164 defined by the side arms 11177 may extend along the longitudinal axis of the flush activation bar 1175. The large opening 11164 preferably has an oval-shaped cross-section. However, any shape for the large opening 11164 is contemplated, including circular or rectangular. The side arms 11177 are preferably symmetrical about the longitudinal axis of the flush activation bar 1175, but symmetry of these elements is not necessary. For the preferable shape of the flush activation bar 1175, the side arms 11177 should be parallel to each other at least at one location along their lengths. The size for the large opening 11164 is contemplated such that at least a portion of the entire adjustable flush connector 11150, including the adjustable connector 11156 may be inserted therethrough.

At the location where the two side arms 11177 are parallel to each other, two small openings 11165 may extend transversely through the side anus 11177, which are formed as part of the flush activation bar 1175 and define the larger opening 11164. The small openings 11165 are preferably circular, but may have any shape that allows for the rotation of a connection element and at least the bottom of the small opening 11165 should be substantially curved. The small openings 11165 preferably correspond to, or are arranged to receive two protrusions 11163 extending from the sides of the adjustable connector 11156.

For attaching the flush activation bar 1175 to the adjustable connector 11156 and creating the second rotatable connector 11157, the adjustable connector 11156 includes two protrusions 11163 each extending from one side of the adjustable connector 11156. The two protrusions 11163 are preferably located towards the top of the adjustable connector 11156 and are preferably located on the same line as each other extending transverse to the adjustable connector 11156. The protrusions 11163 preferably have a cylindrical shape. However, any cross-sectional shape is contemplated, such as an oval. The cross-sectional shape is preferably rounded on at least the bottom edge, such that the protrusions 11163 are capable of rotating within the small openings 11165 in the flush activation bar 1175.

As a method of forming the second rotatable connector 11157, the two protrusions 11163 may be snapped into the small openings 11165 in the flush activation bar 1175 creating a connection that is rotatable about the protrusions 11163, which is about the transverse axis of the flush activation bar 1175. The protrusions 11163 are preferably snapped into place through the use of spring and/or torsional compression of the protrusions 11163 and/or the side arms 11177, such that the protrusions 11163 are locked in place within the small openings 11165. The protrusions 11163 may also be spring operated to extend into the small openings 11165 and the ends 11179 of the preferred protrusions 11163 may be angled to help with the insertion of the protrusions 11163 into the small openings 11165. If removal is desired, the angled ends 11179 may also assist with the removal of the protrusions 11163 from the small openings 11165. Although a removable connection is preferred, the protrusions 11163 may also have a shape and/or size that makes removal difficult or highly impractical.

Any type of connection that is rotatable about a transverse axis of the flush activation bar 1175 will be understood by one skilled in the art based on the disclosure to be an acceptable alternative configuration for the second rotatable connector 11157. The use of an opening through the adjustable connector 11156 and the second section 11152 of the adjustable flush connector 11150 through which a pin may be inserted, is also contemplated as creating the second rotatable connector 11157 to connect the flush activation bar 1175 to the adjustable flush connector 11150. In such an embodiment, two or more openings would be required on the second section 11152. The openings extend transversely across the second section and would be positioned at various points along the length of the second section. Two or more of the openings may extend across the second sections at one or more different angles with respect to each other. The two or more openings would allow the adjustable connector 11156 to be longitudinally moveable and rotationally positionable. A similar arrangement may also be used to directly connect the flush activation bar 1175 to the second section 11152 of the adjustable flush connector 11150 without the use of the adjustable connector 11156 as discussed above. Other possible connections could include a threaded surface on the protrusions 11163. A matingly threaded female piece with a smooth outer surface could be used to removably secure the flush activation bar to the adjustable connector to create the second rotatable connector. A riveted connection may also be used, which could create either a removable or a permanent connection.

Figure 80:
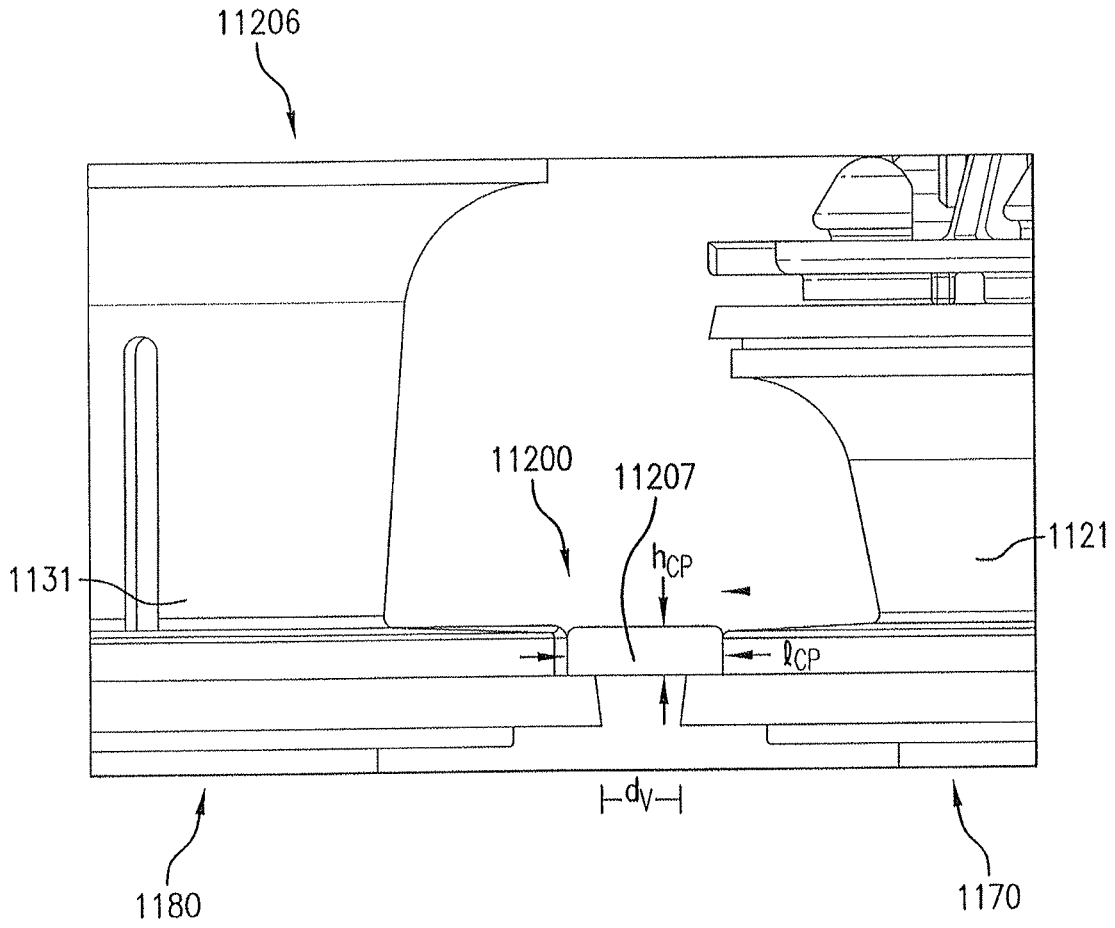
FIG. 80 is an enlarged front elevational view of a portion of an embodiment of the assembly kit of FIG. 69 having a unitary multiple flush valve assembly showing the connection piece.
Figure 81:
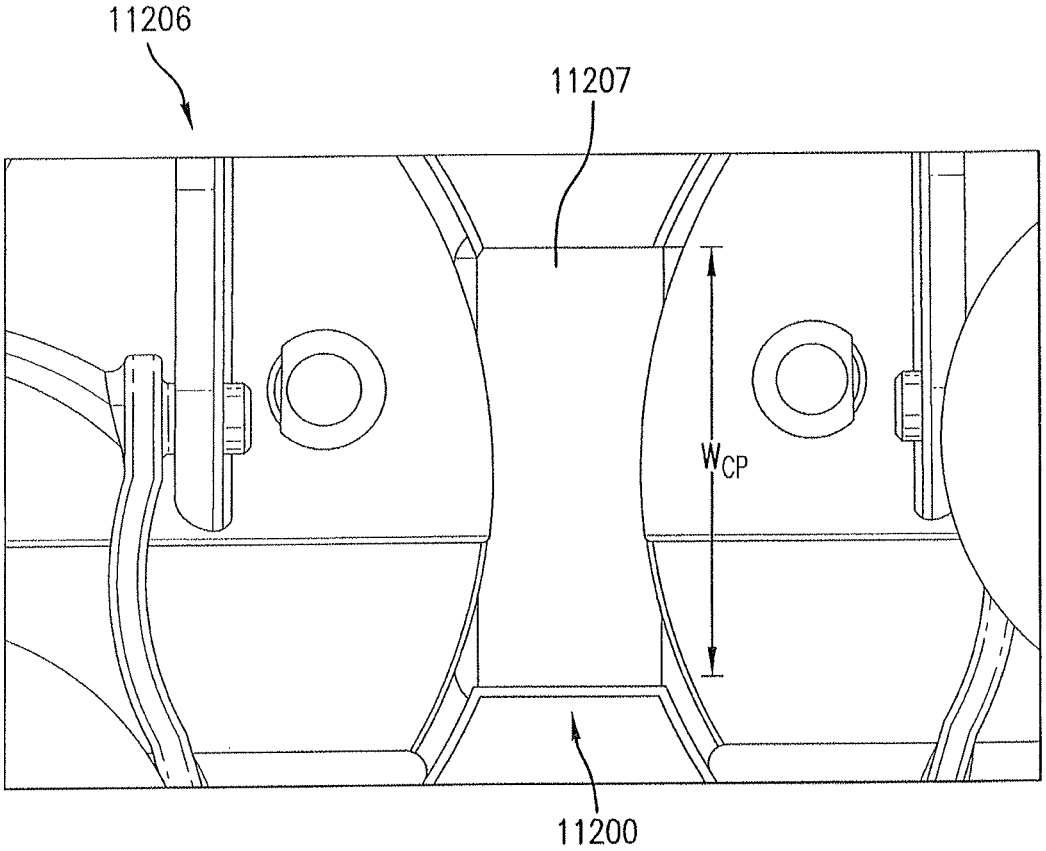
FIG. 81 is an enlarged top plan view of the connection piece as shown in FIG. 80.
Figure 88:
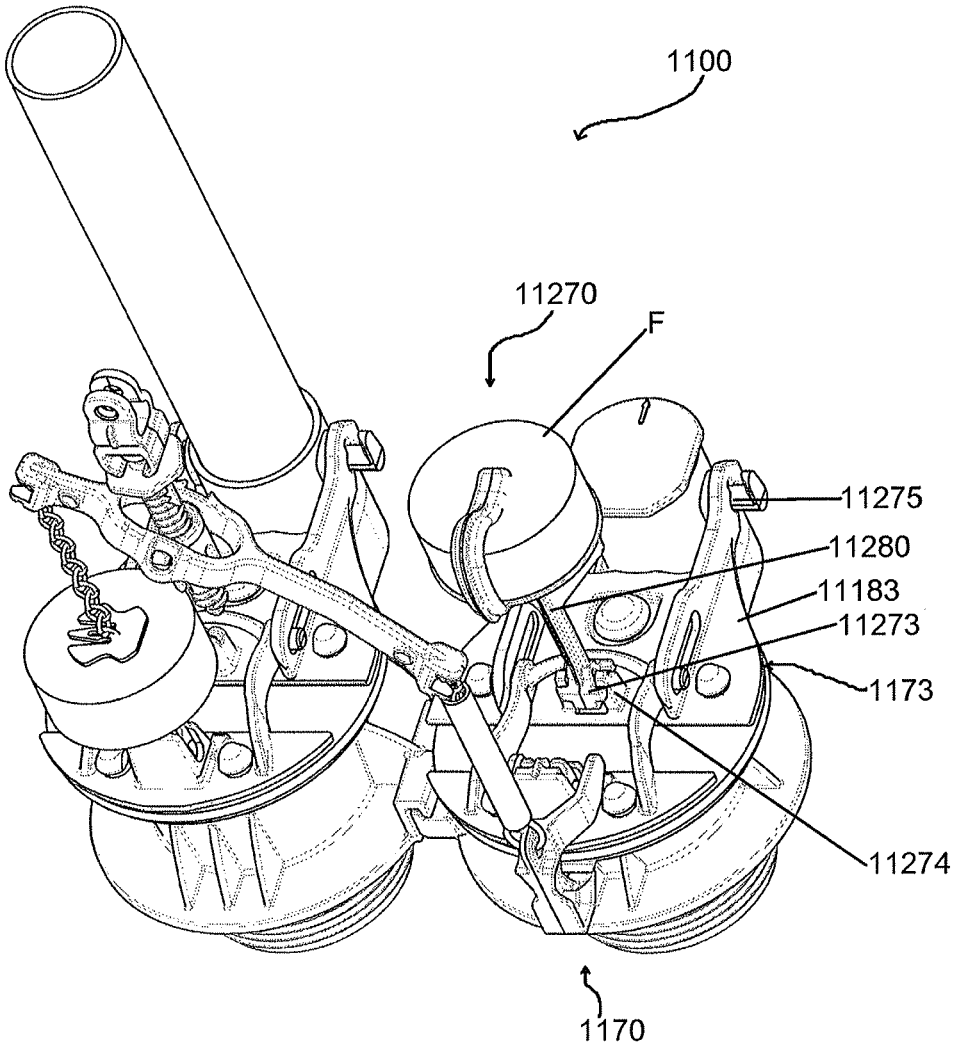
FIG. 88 is a perspective view of an assembly kit as in FIG. 69 modified to include an alternate embodiment of a float attachment.
Figure 89:
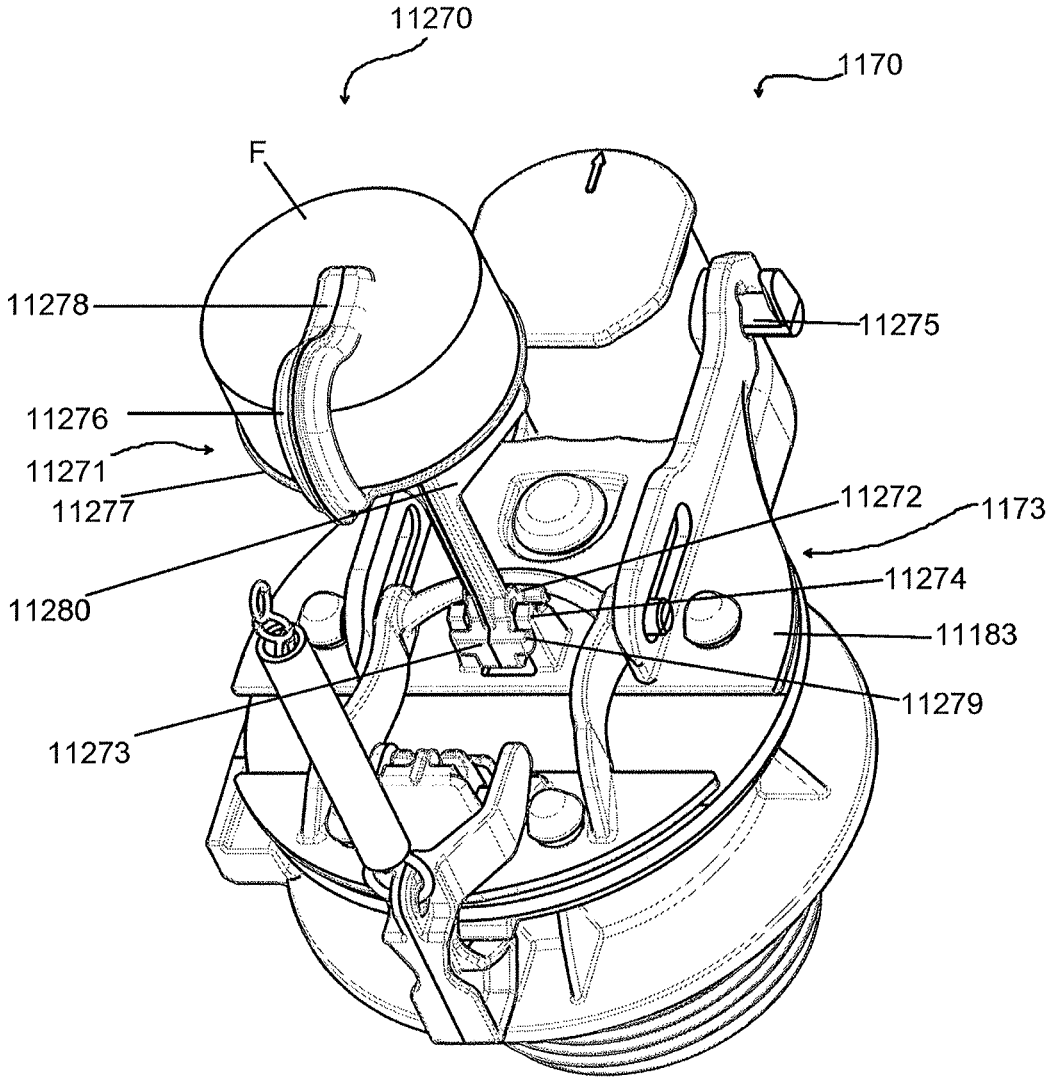
FIG. 89 is a perspective view of a second valve assembly in the assembly kit of FIG. 88 showing the float attachment.
Figure 90:
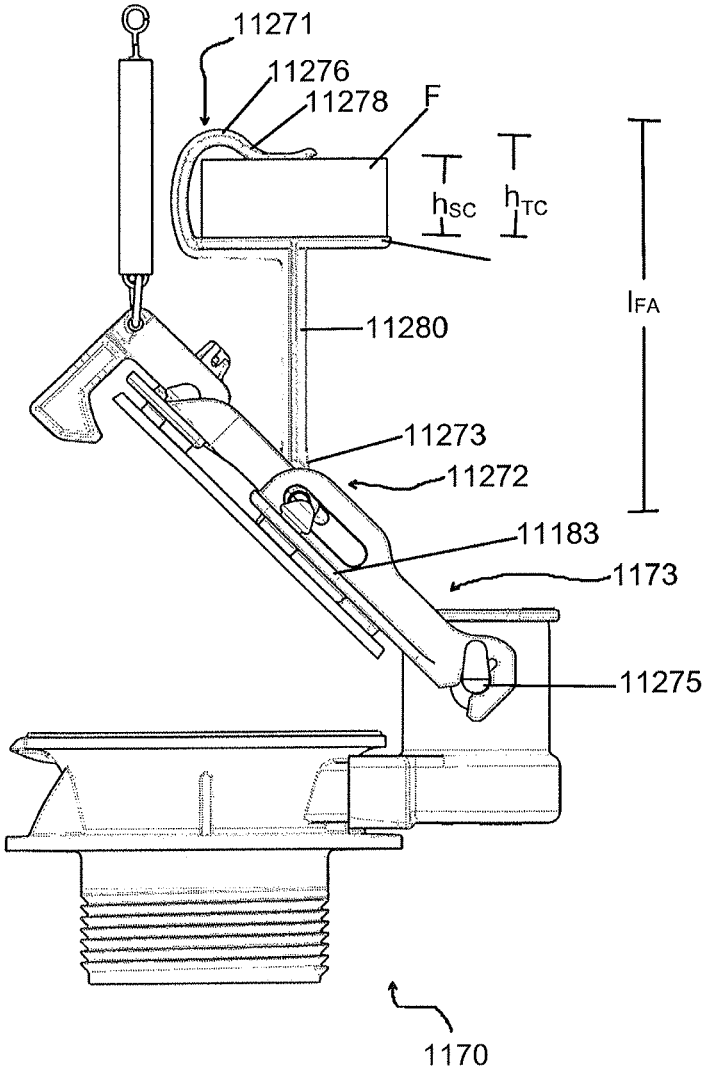
FIG. 90 is a side elevational view of the second valve assembly of FIG. 89.

In FIG. 69 an embodiment of the assembly kit 1100 is depicted having a first valve assembly, a second valve assembly and a flush activation assembly including a flush activation bar and an adjustable flush connector without tools and shown as connected to a pivot rod P and a handle H. Alternative kits may also contain one or more of the following, a tank to bowl gasket tool as shown below in FIGS. 83 and 84, a float attachment as shown in FIGS. 88-90, or a multiple flush valve assembly as shown in FIGS. 80-81. FIG. 69 shows the connections that associate action on the handle H with valve opening. When the handle H is depressed, the pivot rod P lifts the adjustable flush connector 11150 vertically, this in turn moves the flush activation bar 1175 vertically at the balance point BP. The flush activation bar 1175 is preferably connected to a first valve assembly 1180 at a first portion 11161 of the bar 1175 and a second valve assembly 1170 at a second portion 11162 of the bar 1175. The first valve assembly 1180 is preferably a rim valve assembly and the second valve assembly 1170 is preferably a jet valve assembly. The rim valve assembly 1180 and the jet valve assembly 1170 have been described herein in various embodiments of the primed toilet and may be similar or identical to those described in earlier embodiments as valves 80 and 70. In order for the flush activation bar 1175 to be usable with a wide variety of connector styles that are used on the chains C and C1 that connect the flush activation bar 1175 to each valve assembly 1170 and 1180, one or more different types of connector pieces may be located on the first portion 11161 and/or the second portion 11162 of the flush activation bar 1175, including a snap, or other female fitting as shown in FIG. 69. Likewise, hooks or other male fittings may also be included on one or both the first 11161 and second portions 11162.

The location of the balance point BP between the adjustable connector 11156 and the flush activation bar 1175 may affect the timing of when each valve cover 1182 and 1173 opens. The valve covers 1182 and 1173 may be set to open at the same time, or be set to optimize performance in a siphonic, primed jet toilet as discussed in relation to FIG. 15 by having the rim valve cover 1182 fully open before the jet valve cover 1173 begins to open.

As the flush cycle is activated, fluid is provided through the at least one rim valve, here, through rim flush valve assembly 1180 and through at least one jet flush valve, as shown here jet flush valve assembly 1170. The configuration of the closed jet fluid pathway is such and the timing of the flush cycle optimized so as to maintain the closed jet fluid pathway in a primed state after completion of a flush cycle. The flush mechanism and timing may be the same as the optimized performance discussed in the various embodiments 10, 110, 210, 310, 410, etc. and examples included herein.

In one embodiment of the method herein, after actuating the flush cycle, the flush activation bar operates to provide fluid through the at least one jet flush valve assembly at a flow rate sufficient to keep air from entering the jet outlet and to generate a siphon in the trapway. The flow rate is then lowered through the jet channel for about 1 second to about 5 seconds until the siphon breaks; and the flow is maintained at least until the jet outlet port is covered.

Fluid is also preferably provided through the at least one rim flush valve assembly during the flush cycle. When first installed, the toilet may require an initial priming by providing a flow rate through the jet flush valve assembly outlet sufficient to keep air from entering the jet outlet port until the sump fills with fluid as described above. The associated flow rates for carrying out these steps are outlined elsewhere herein. The toilet assembly is capable of being self-priming as described above, and it is preferred that all or substantially all of the air becomes expelled from the jet channel when the toilet is in a state causing the jet channel to have air. It is acceptable for general performance that some minor amount of air may enter the closed fluid jet path while still providing good operation, preferably including up to only about 100 ml in an embodiment such as embodiment 10 shown herein, but acceptable performance can include further amounts of air, but preferably no more than about 500 ml to avoid fall off in performance. The specific quantities may vary by bowl geometry.

The toilet is typically in the primed state, for example, when the toilet is first installed as noted above, although other situations, such as plumbing work or maintenance also can cause such a situation. The user may, of course, manually intervene to prime the toilet assembly upon installation, or as configured, the toilet can self-prime over one or more of the first several flushes of the toilet without user manual intervention.

As shown in FIGS. 1-13 and 29-34 herein, the toilet is able to expel virtually all air in as little as about three flushes, although more or less may be required depending on individual toilet geometry. For self-priming to be complete, two conditions must be met: (1) the flow rate of fluid through the jet flush valve needs to be greater than the flow rate of fluid exiting the jet outlet port so as to provide sufficient energy to displace the air and (2) air must be provided a route of escape from the outlet or up through the jet flush valve assembly. This can be accomplished through modification of the jet channel and/or the jet outlet port geometry and/or cross-sectional area and/or by modification of the flush valve to enhance performance. Thus it is preferred to use a jet flush valve that can contribute a high energy and strong velocity flow into the closed jet fluid pathway through the jet channel. Suitable valves are described in U.S. Pat. No. 8,266,733 and in co-pending U.S. Non-Provisional Patent Application Publication No. 2014/0090158, both of which are incorporated herein by reference with respect to their teaching of valves having streamlined valve body configurations and having a radiused inlet and/or a weighted cover. Other suitable flush valves are commercially available and are described elsewhere herein with respect to other embodiments of the toilet assemblies described below for which the same flush valves may be used (see also FIGS. 35-68 herein providing for better air release from peeling capability as described below). In addition to a gradually lifting cover, star patterned internal ribs may also impact the speed of air evacuation as discussed further below.

Figure 20:
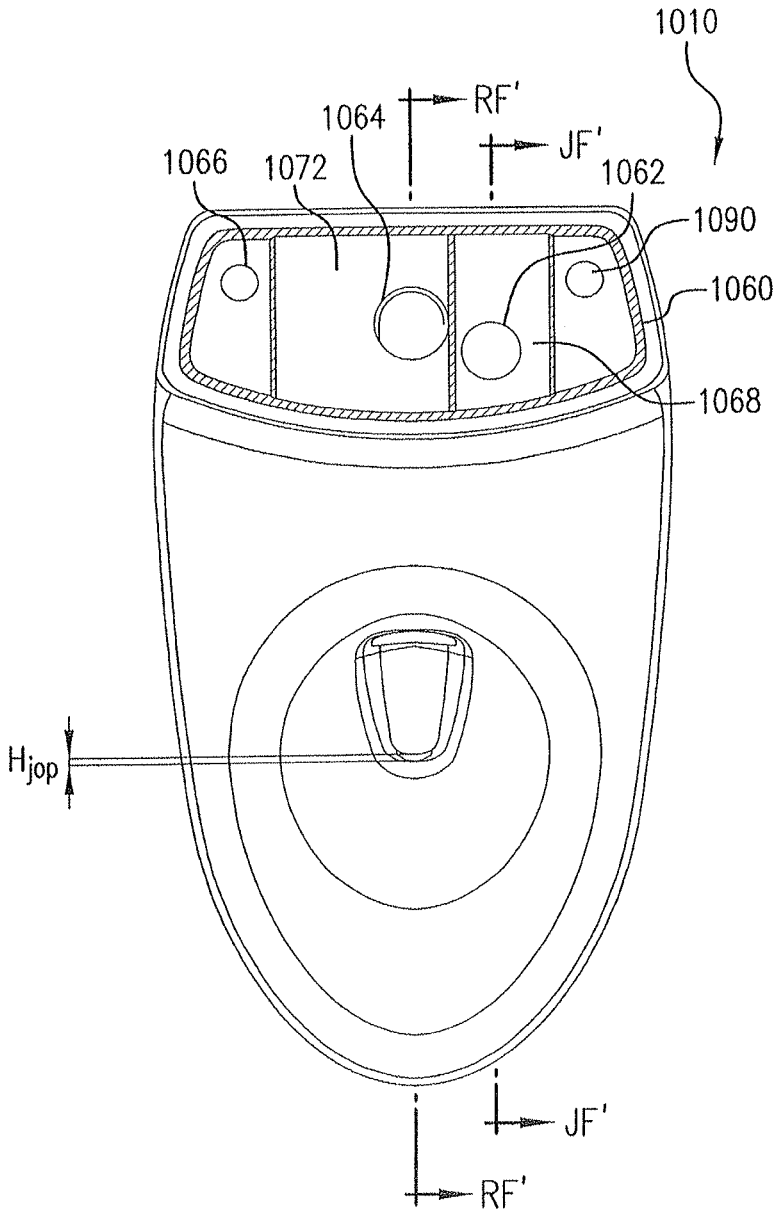
FIG. 20 is a top partial plan view of an alternate embodiment of a siphonic toilet bowl assembly of FIG. 1, having both a jet reservoir and a rim reservoir.
Figure 21:
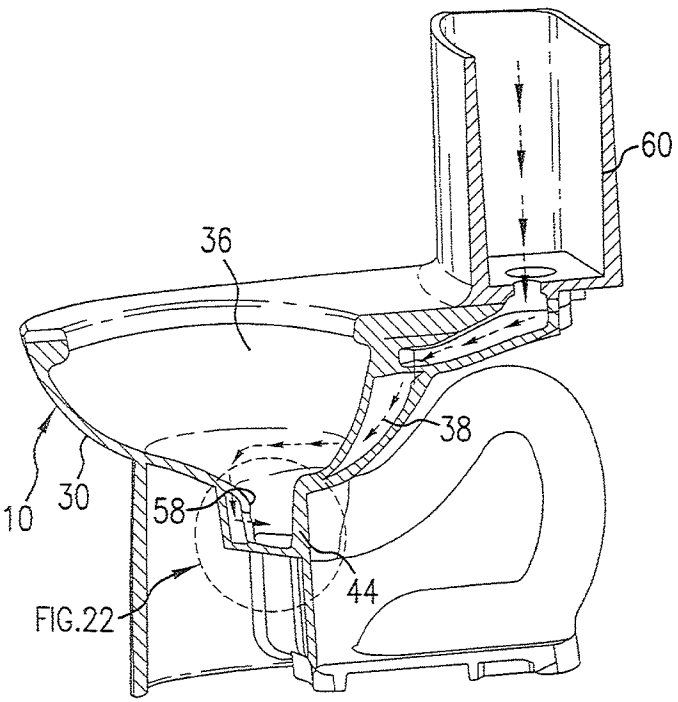
FIG. 21 is a longitudinal cross-sectional view of the siphonic toilet bowl assembly of FIG. 19, taken along line 21-21 and showing the flow of fluid to the jet with the jet flush valve assembly removed.

FIGS. 16 and 20, 21 and 22 show additional embodiments of toilet bowl assemblies described herein. The toilet bowl assembly of FIG. 16, generally referred to herein as 110, has at least one jet flush valve assembly 170 configured for delivery of fluid, such as flush water, to a jet 120, such as a direct-fed jet, and at least one rim flush valve assembly 180 configured for delivery of fluid to a rim 132. With reference to FIG. 21, the toilet bowl assembly 110 also has a jet manifold 112, having a jet manifold inlet opening 114 configured for receiving fluid from an outlet 113 of the jet flush valve assembly 170 and a jet manifold outlet opening 116 for delivery of fluid to a jet inlet port 118. The toilet bowl assembly 110 further has a rim manifold 122, including a rim manifold inlet opening 124 configured for receiving fluid from the rim flush valve assembly 180 and a rim manifold outlet opening 126 for delivery of fluid to a rim inlet port 128.

The assembly 110 further includes a bowl 130 having a rim 132 provided around an upper perimeter portion 133 of the bowl 130. In one embodiment, the rim 132 may define a rim channel 134 as shown. The rim inlet port 128 is in fluid communication with the rim channel 134 so that the rim channel 134 is also in fluid communication through the rim inlet port 128 with the rim manifold outlet opening 126 and the rim channel is also in fluid communication with at least one rim outlet port 129. As used herein, in fluid communication means that the one element of the assembly is structurally positioned so as to be open to flow from another element. The rim outlet port(s) are in fluid communication with an interior area 137 of the bowl 130, wherein the interior area 137 is defined by an interior surface 136 of the bowl 130. The remainder of this assembly is analogous to parts in embodiment 10.

With respect to embodiment 10, the bowl assembly includes a direct-fed jet 20 that has and defines the configuration of at least one jet channel(s) 38 as described above (such jet channels may also be provided to embodiment 110). The channel(s) extend between the jet inlet port 18 and the jet outlet port 42. The at least one jet channel 38 has an inlet port 18 in fluid communication with an outlet opening 16 of jet flush valve. The jet also has a jet outlet port 42 configured for discharging fluid from the jet channel 38 to a sump area 40. The sump area is in fluid communication with a trapway 44 or other toilet exit conduit for draining the toilet bowl 30.

Figure 19:
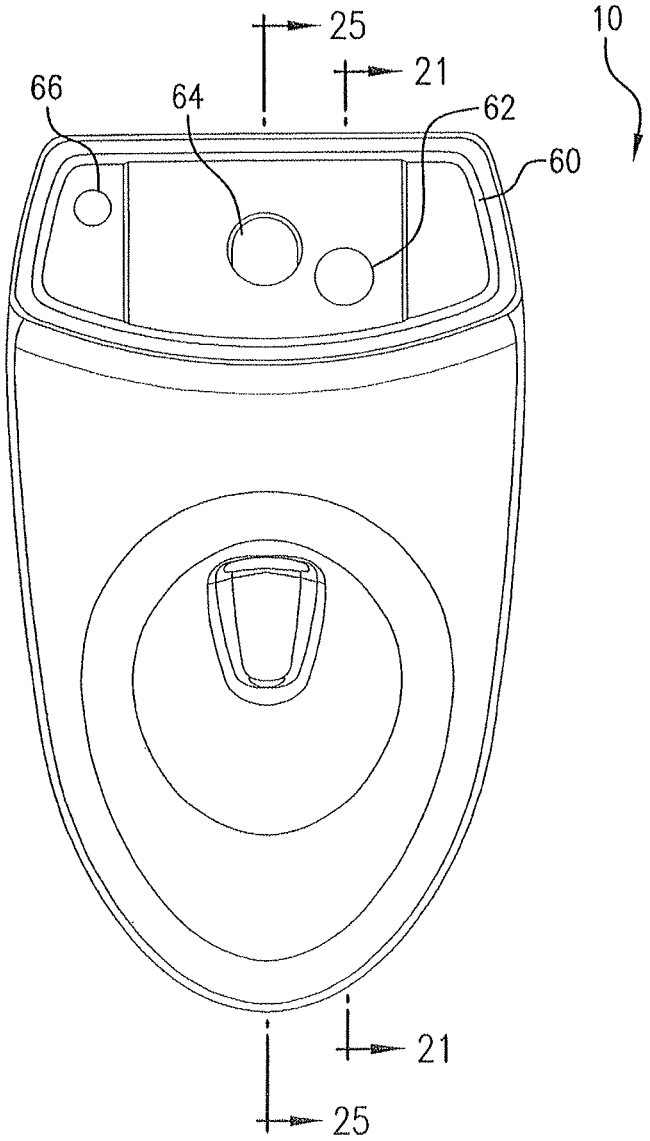
FIG. 19 is a top partial plan view of the siphonic toilet bowl assembly of FIG. 1.

A fluid source (such as flush water) may be used when the bowl is installed to come from an in-line flushmaster-type valve connected directly to a plumbing water inlet in the wall as in many industrial or commercial toilets. The assembly may optionally include a tank 60 as shown in FIGS. 19 and 21. Preferably, tank 60 provides at least one opening 62 for receiving the jet flush valve assembly 70 and allowing fluid from the outlet 13 of the at least one jet flush valve assembly 70 to enter the closed jet fluid path 1 and jet channel(s) 13, and at least one second opening 64 for receiving the rim flush valve assembly 80 and allowing fluid from the outlet 81 of the rim flush valve assembly 30 to enter the rim path to rim outlet port 28 or to any optional rim manifold through a rim manifold inlet opening.

The tank 60 should also include at least one fill valve 66 and, optionally, an overflow tube such as overflow tube 91 shown in the above embodiments, which is preferably associated with the rim flush valve. The tank 60 may be formed as a single, open reservoir housing both the jet flush valve and the rim flush valve in one area as shown in FIG. 19, or alternatively, constructed as two separate reservoirs as shown in embodiment 1010 of FIG. 20. An overflow tube should be operated from the flow of the rim flush fluid RF out of the rim flush valve (associated in any manner with the valve body known in the art or to be developed) and not from the flow of the jet flush fluid JF through the jet flush valve to eliminate any opportunity for air to enter the closed jet fluid path 1. The rim path may be left open to air without the nature of the invention being affected by connection to an overflow tube within the rim path.

The jet flush valve 70 and rim flush valve 80 assemblies may incorporate any standard commercially available flush valve and flapper design, including various designs known or to be developed in the art, for example, the Fluidmaster 502 flush valve. The rim valve may be electrical, mechanical or computer operated as well. Preferably, the toilet bowl assembly 10 has at least one jet flush valve assembly 70 configured for delivery of fluid, such as flush water, to a jet 20 and at least one rim flush valve assembly 80 separately configured for delivery of fluid to a rim outlet port. The flush valve assemblies for use in the present invention may be configured to be a master flush valve that delivers separate fluid flow to the rim and to the jet or, more preferably, is at least one jet flush valve assembly 70 and at least one rim flush valve assembly 80 positioned to deliver independent fluid flow and may be any suitable flush valves known or to be developed in the art such as those described above with respect to embodiment 10 and flush valves 70, 80.

The at least one jet flush valve assembly 70 and at least one rim flush valve assembly 80 can each also be a dual flush valve assembly. An example of a flush valve assembly known in the art which may be preferred for us in the embodiments herein may be found in U.S. Pat. No. 8,266,733 B2, incorporated herein in relevant part by reference. The two valves can be opened and closed simultaneously, or opened and closed at different timing during the flush cycle to further optimize performance. To achieve a cleaner bowl with cleaner post-flush water, it is desirable to open the rim flush valve prior to opening the jet flush valve. In preferred embodiments for a 6.0 liters/flush, the rim flush valve is opened immediately upon initiation of the flush cycle and closed at about 0.1 second to about 5 seconds into the cycle, whereas the jet flush valve is opened at about 1 second to about 5 seconds into the cycle and closed at about 1.2 seconds to about 10 seconds.

For ultra low flush toilets, with three liters/flush, the rim flush valve may be opened immediately upon initiation of the flush cycle and closed at about 1 second to about 3 seconds into the cycle, whereas the jet flush valve is opened at about 0.1 second to about 3 seconds into the cycle and closed at about 1.2 seconds to about 3 seconds. In embodiments herein, with a 54 mm diameter trapway, a volume of only about 1 liter flowing from the fully primed, closed jet channel is required to initiate the siphon, making possible the application of the invention to flush toilets that operate at volumes of 2 liters or less, depending on the desired effectiveness of the bowl wash and the quantity of water directed to that function.

Another embodiment for a dual flush toilet assembly opens a dual flush valve as rim flush valve immediately upon initiation of the flush cycle, which then triggers the jet flush valve (either single or dual flush) to open after the rim dual flush valve. The amount of water delivered to the rim for cleansing pre-siphon would be about 1 liter/flush to about 5 liters/flush, and preferably about 2 liters to about 4 liters/flush, and the amount of water delivered through the jet flush valve to establish a siphon would be about 1 liter/flush to about 5 liters/flush.

An additional embodiment of a flush valve assembly is shown in FIGS. 69 and 70. The valve assemblies as described in this embodiment may be similar to embodiments of the rim valve assembly 80, 1180, etc. and embodiments of the jet valve assembly 70, 570, 670, 77, 870, 970, and 1170, described herein, with the noted differences. In previously described dual valve assemblies, each valve assembly was capable of moving in relation to the other valve assembly. With sufficient movement of the valve assemblies, the alignment with the flush activation bar could be altered, resulting in a possible change to the timing of valve opening and a possible reduction in the performance of the flushing mechanism. Although the valve assemblies are described in relation to a siphonic flush toilet, it will be understood by one skilled in the art based on this disclosure that the valve assemblies may be used with any style flush toilet, including washdown toilets.

Figure 77:
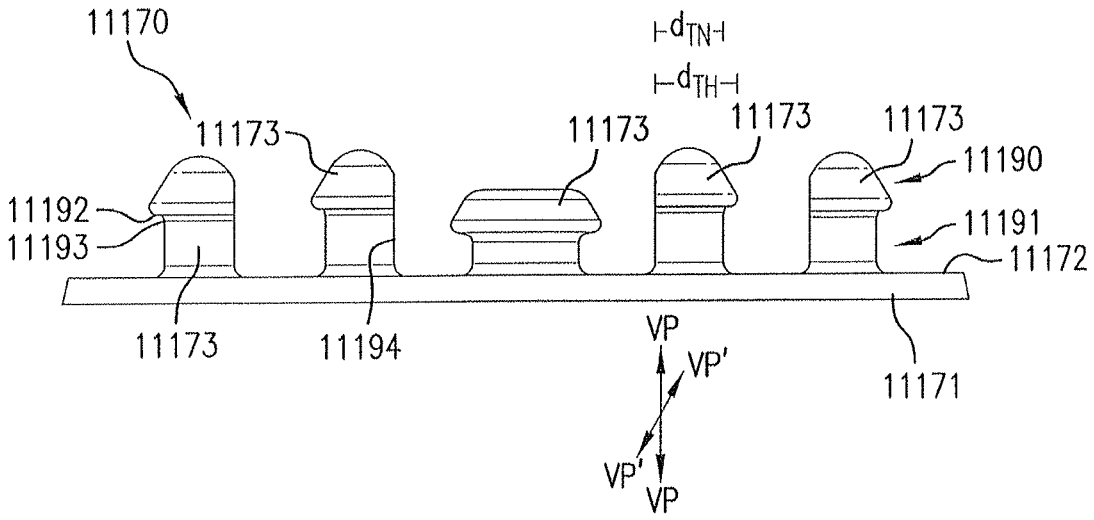
FIG. 77 is a front elevational view of the seal of FIG. 76.
Figure 78:
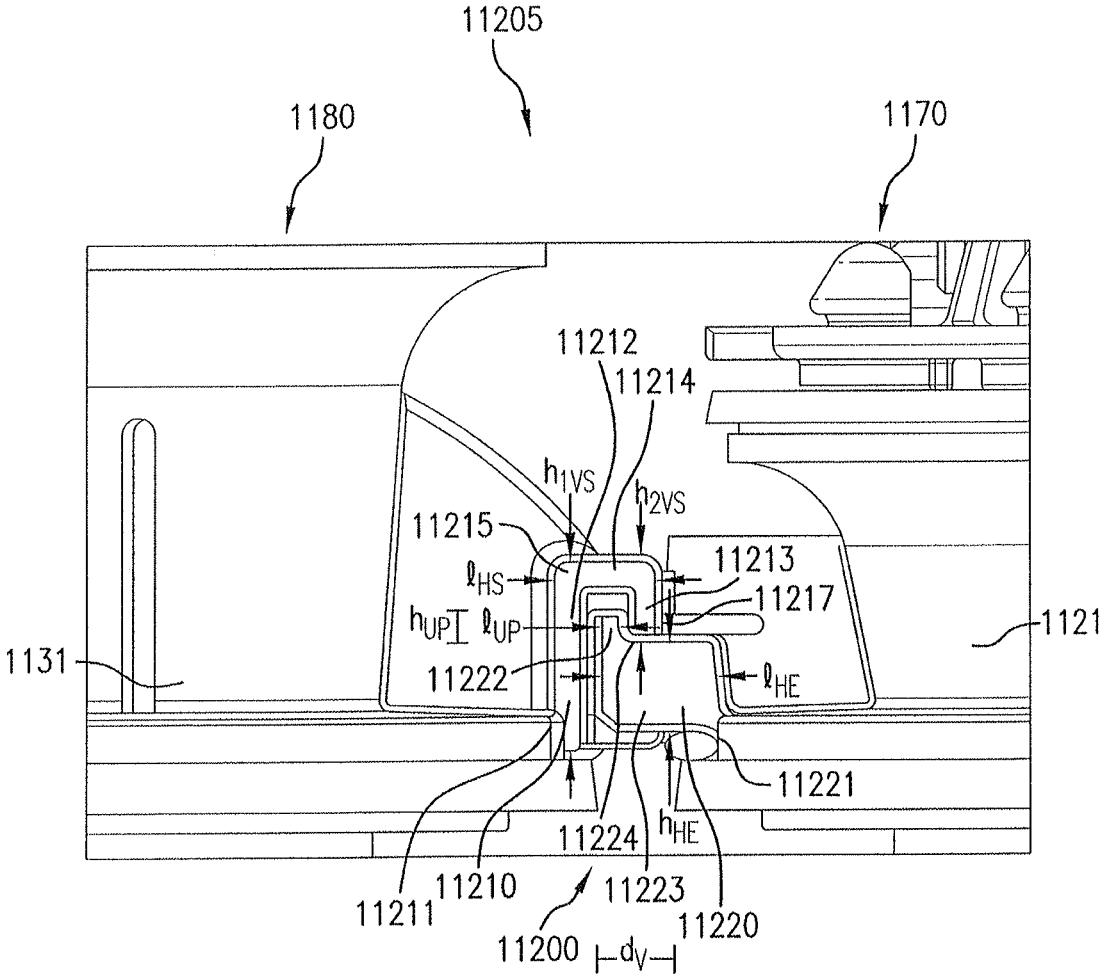
FIG. 78 is an enlarged front elevational view of a portion of the assembly kit of FIG. 69 showing the linking device.

In this embodiment, as shown in FIGS. 69-70 and 78-79, a valve assembly 1180 is provided and configured to connect to a second valve assembly 1170. The valve body 1131 of the valve assembly 1180 may include a first link 11210 for associating the valve body 1131 with a second valve body 1121 of a second valve assembly 1170. The valve assembly 1180 may also have a valve cover 1182. As best seen in FIG. 78, the first link 11210 may be capable of connecting with a second link 11220 on the second valve assembly 1170 to create a linking device 11200, or other structure for holding the distance $d_V$ between the valve assembly 1180 and the second valve assembly 1170 constant, as discussed further below. The valve assembly 1180 preferably includes the seal 11170 secured to the rigid cover 11180 as described in the embodiment below, preferably using the locking lugs 11173 as described and shown in FIGS. 73-77. Specifically, the seal 11170 should include a sealing surface 11171 and a locking surface 11172, with the locking surface 11172 having a plurality of locking lugs 11173. The locking lugs 11173 are insertable within corresponding openings 11188 in the rigid cover 11180. The rigid cover 11180 may then be capable of bending with the seal 11170 through the use of the peeling section 11182 and the lifting section 11183 to provide gradual opening of the valve cover 1182.

Although the valve assembly has been described herein and shown in the Figures using the numbering associated with a rim valve assembly, and the second valve assembly has been described and shown in the Figures using the numbering for the jet valve assembly, it is understood that the valve assembly may be a rim valve assembly 1180 and/or a jet valve assembly 1170. Likewise, the second valve assembly may be a rim valve assembly and/or a jet valve assembly.

Both the valve assembly 1180 and/or the second 1170 valve assembly may include an overflow tube 1191 capable of allowing liquid to enter the valve body 1121 or 1131 when the valve cover 1173 or 1182 is closed and/or to allow air to escape upwardly during flushing. The overflow tube 1191 on one or more of the valve bodies 1121 and/or 1131 preferably has a removable cap 11201 for when the use of the overflow tube 1191 is not desired.

Figure 79:
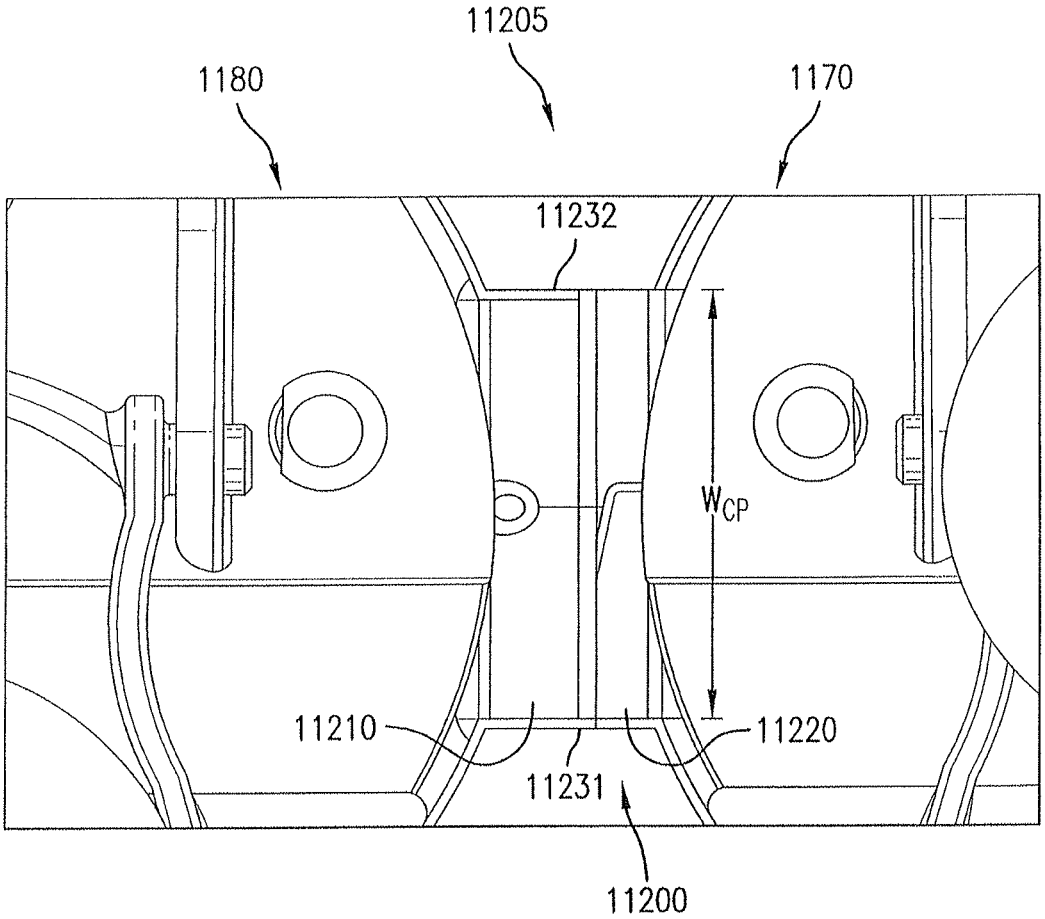
FIG. 79 is an enlarged top plan view of the linking device as shown in FIG. 78.

Another embodiment may optionally include a multiple flush valve assembly 11205, as shown in FIGS. 78 and 79. A multiple flush valve assembly 11205 preferably includes a first valve assembly 1180 and a second valve assembly 1170. The first 1180 and second 1170 valve assemblies may be as included in the embodiments herein 10, 110, 210, 310, 410, 710, 1010, etc. The multiple flush valve assembly 11205 may also include a first link 11210 on the first valve body 1131 and a second link 11220 to the second valve body 1121. The first valve assembly is preferably a rim valve assembly 1180 and the second valve assembly is preferably a jet valve assembly 1170.

FIG. 78 shows a close-up front view of the linking device 11200. The rim valve body 1131 preferably includes the first link 11210 and the jet valve body 1121 preferably includes the second link 11220. The first link 11210 and the second link 11220 are configured so that the first link 11210 interlocks with the second link 11220 to associate the first valve assembly 1180 with the second valve assembly 1170. The configuration of the first link 11210 and the second link 11220 refers to the shapes of the each element so that they are capable of interlocking, the shapes of the links will be discussed in detail below. The optional linking device 11200 is preferably used to maintain a constant distance $d_V$ between the first valve assembly 1180 and the second valve assembly 1170. The connection provided by the linking device 11200 minimizes the movement of the valve assemblies with respect to each other keeping flush performance consistent.

The first link 11210 preferably extends from the edge 11211 of the rim valve body 1131 located closest to the jet valve assembly 1170. The first link 11210 preferably has a downward hook shape formed from two vertical sections 11212 and 11213 and a horizontal section 11214. The first vertical section 11212 may connect with or be an integral part of the edge 11211 of the rim valve body 1131 and may extend up from rim valve body 1131 and connect to the horizontal section 11214 at the top 11215 of the first vertical section 11212. The height ($h_{1VS}$) of the first vertical section 11212 is preferably about 10 min to about 30 mm.

The horizontal section 11214 may extend substantially perpendicularly away from the first vertical section 11212 and the edge 11211 of the rim valve body 1131 towards the jet valve assembly 1170 a length $l_{HS}$ slightly more than the distance $d_V$ between the rim valve assembly 1180 and the jet valve assembly 1170. The distance $d_V$ between the rim valve assembly 1180 and the jet valve assembly 1170 may be variable and may depend on the manufacturer of the toilet tank. The preferable distance $d_V$ between the rim valve assembly 1180 and the jet valve assembly 1170 is about 2 mm to about 10 mm. Using these distances, the preferable length $l_{HS}$ for the horizontal section 11214 of the first link 11210 is about 4 mm to about 12 mm.

Preferably, the second vertical section 11213 connects with the end of the horizontal section 11214 furthest from the rim valve body 1131 and extends downwardly towards the bottom of the tank and is substantially parallel to the first vertical section 11212. The height $h_{2VS}$ of the second vertical section 11213 is such that it is sufficient to interlock with the second link 11220. The preferable height $h_{2VS}$ for the second vertical section 11213 is about 3 mm to about 8 mm. However, this height $h_{2VS}$ is dependent on the height $h_{1VS}$ of the first vertical section, as well as the height $h_{up}$ of the upward protrusion 11222 of the second link 11220. The larger the height $h_{UP}$ of the upward protrusion 11222, the smaller the height $h_{2VS}$ of the second vertical section 11213 required. However, the amount of contact area of the second vertical section 11213 and the upward protrusion 11222 that are adjacent to each other may not be important. This contact area preferably is sufficient to maintain the linkage of the first link 11210 with the second link 11220.

The first link 11210 is described as having three sections 11212, 11213, 11214. However, it is understood that all three sections may be integrally formed together as a single piece, and may also be integrally formed with the valve body 1131. The first link is preferably molded as an integral piece of the valve body through the use of injection molding, but any method of formation is contemplated, including but not limited to, compression molding, resin casting and three dimensional printing. Additionally, one or more of the sections may be formed separately and connected to the other sections, for example through welding, press fitting or other known connection process, prior to use. With the use of any of the described methods of forming the first link 11210, either a plastic or metal material may be used.

Preferably, the second link 11220 extends from the edge 11221 of the jet valve body 1121 located closest to the rim valve assembly 1180. The second link 11220 preferably has generally a rectangular shape with an upward protrusion 11222 when viewed from the front of the tank. In one embodiment, the second link 11220 has a horizontal element 11223 and an upward protrusion 11222. The horizontal element 11223 may connect to, or be an integral part of the edge 11221 of the jet valve body 1121 and extends perpendicularly from the edge 11221 toward the rim valve body 1131. The horizontal element 11223 may be sized such that it extends almost the entire distance $d_V$ between the rim valve assembly 1180 and the jet valve assembly 1170. The preferable length $l_{HE}$ of the horizontal element 11223 is about 10 mm to about 20 mm. However this distance may be varied depending on the distance $d_V$ between the valve assemblies 1180 and 1170. The height $h_{HE}$ of the horizontal element 11223 is preferably sized so that the top 11224 of the horizontal element 11223 is just below the bottom 11217 of the second vertical section 11213 of the first link 11210. The height $h_{HE}$ of the horizontal element 11223 may vary from about 2 mm to about 27 mm, with the height $h_{UP}$ of the upward protrusion 11222 being more important. The preferable height $h_{HE}$ for the horizontal element 11223 corresponds to the preferable sizes of the three sections 11212, 11213, 11214 of the first link 11210 so that the first link 11210 and the second link 11220 associate with each other to hold the distance $d_V$ between the valve assemblies 1180 and 1170 relatively constant.

Preferably, the upward protrusion 11222 of the second link 11220 extends upwardly from the top of the horizontal element 11224 with the front of the upward protrusion 11222 preferably aligning with the front of the horizontal element 11223. The upward protrusion 11222 is preferably sized to fit within the hook-shape formed by the first link 11210. The height $h_{UP}$ of the upward protrusion 11222 of the second link 11220 may be sufficient to interlock with the second vertical section 11213 of the first link 11210 such that the rim valve body 1131 and the jet valve body 1121 are secured to each other and are not capable of moving towards, or away from each other. The preferred height $h_{UP}$ of the upward protrusion 11222 is about 2 mm to about 5 mm, but is dependent on the height $h_{HE}$ of the horizontal element 11223 and the height $h_{1VS}$ and $h_{2VS}$ of the first 11212 and second 11213 vertical sections of the first link 11210. The preferred length $l_{UP}$ of the upward protrusion 11222 is about 1 mm to about 5 mm. This preferable length may be selected such that the upward protrusion 11222 just fits within the hook shape of the first link 11210, so that movement of the valve assemblies 1180 and 1170 both towards and away from each other is minimized.

Although the second link 11220 has been described as having two sections 11222 and 11223, the preferable second link 11220 is made from a single piece of material. Specifically, the second link 11220 may be made of either metal or polymer material and is preferably a polymer material that has been molded in the shape described for the preferable embodiment above. Preferably, the second link 11220 is integrally formed with the valve body 1121.

Both the first link 11210 and second link 11220 may also be provided as separate items that may be installed on a respective valve assembly 1180 and 1170 after the valve assembly has been installed within a toilet. For such purpose the first link 11210 and the second link 11220 may include a strapping mechanism, clamping mechanism, tabs, or other connection device capable of securing the first 11210 and second 11220 links to the first 1131 and second 1121 valve bodies, respectively. Additionally, the first link 11210 and the second link 11220 may be integrally formed and the linking device 11200 may only have one piece. The linking device 11200 as a single piece may be installed with connection elements, including straps to be looped around the assembly, and/or clamping devices for connecting to the sides of both valve assemblies. For example, a single rigid article could be affixed to both valve assemblies. Such an article should be capable of holding the distance $d_V$ between the two valve assemblies 1180 and 1170 substantially constant. It should also be noted that the valve bodies 1121 and 1131 may also be formed as a single unit, eliminating the need for linking device 11200.

As preferred, both the first 11210 and the second 11220 links are made from rigid materials. However, flexible materials may also be used for one or both of the links. If the upward protrusion 11222 is made from a material that is compressible, than its length $l_u$p may be increased such that the upward protrusion 11222 can be compressed to fit within the hook shape of the first link 11210. If flexible materials are used for some, or all of the elements described for the preferable first link 11210 and preferable second link 11220, the thickness and/or amount of flexibility that may be used should not allow the first 1180 and second 1170 valve assemblies to substantially move with respect to each other.

When viewing the linking device 11200 from above as in FIG. 79 the width $W_{LD}$ of the linking device 11200 extending transversely across the tank is visible. The widths of the first link 11210 and the width of the second link 11220 are preferably equal and may be sized so that slight movements of one or both valve bodies 1121 and 1131 in the direction transverse across the tank does not cause the interlocking to be disconnected. The preferable width $W_{LD}$ of the linking device 11200 is about 20 mm to about 40 mm. Although the width of the first link 11210 and the width of the second link 11220 are preferred to be equal, it is understood that either the width of first link 11210 or the width of the second link 11220 may be larger and the linking device 11200 should be able to maintain a constant distance between $d_V$ the valve assemblies 1180 and 1170. Both the front side 11231 of the linking device 11200 and the back side 11232 of the linking device 11200 may be open, which may allow for easier installation and removal of one or both of the valve bodies 1121 and/or 1131 from the tank.

One possible method of installation for the multiple valve assembly 11205 according to this embodiment is to install one of the valve assemblies 1180 or 1170 in the tank and then install the second valve assembly 1180 or 1170 separately. Each valve assembly is preferably separately installed and secured to the bottom of the tank using conventional tank to bowl installation methods. Additionally, a tank to bowl gasket kit, as described below, may be used. Each valve body 1121 and 1131 may be inserted through a separate hole in the bottom of the tank. Upon installation of the second valve assembly 1170 the first link 11210 and the second link 11220 are preferably interlocked. By using this method one valve assembly may be removed, repaired, or replaced without adjusting or removing the other valve assembly.

Another embodiment of a multiple valve assembly 11205 including a linking device 11200 may have a unitary multiple flush valve assembly 11206 as shown in FIGS. 80 and 81. The unitary multiple flush valve assembly 11206 may include both the first valve assembly 1180 and the second valve assembly 1170 provided together as a single unit. A unitary multiple flush valve assembly 11206 may have the first link 11210 and the second link 11220, as described in the embodiments above permanently affixed to one another. Additionally, the first and second valve bodies may be molded as a unitary structure. The affixed linking device 11200 is preferably permanently affixed to both the first 1180 and the second 1170 valve assemblies to form the unitary multiple flush valve assembly 11206. Although for the unitary multiple flush valve assembly 11206 the entire structure is permanently connected, it is understood that the linking device 11200 may be a separate element and may be permanently connected to the individual first 1131 and second 1121 valve bodies prior to installation within the toilet to create a unitary multiple flush valve assembly 11206.

Preferably, to create a unitary multiple valve assembly 11206, two valve bodies 1121 and 1131 and a connection piece 11207 linking the two valve bodies are integrally formed with one another. The two valve bodies 1121 and 1131 may be as described in any of the embodiments disclosed herein, such as 10, 110, 210, 310, 410, 1010, 1110 etc., or may be a conventional valve body that is known in the art. A connection piece 11207 of preferably the same material may be molded along with the valve bodies 1121 and 1131 such that the entire structure is a single piece. The connection piece may also be permanently connected to the valve bodies 1121 and 1131 after formation. The connection piece 11207 is preferably any size sufficient to maintain a constant distance between the valve bodies, which is dependent on the material used. Preferably, the connection piece 11207 is made from a polymeric material such as ABS resin and has a height $h_{CP}$ of about 2 mm to about 10 mm, a width $W_{CP}$ of about 10 mm to about 30 mm, and a length $l_{CP}$ of about 2 mm to about 12 mm. The length $l_{CP}$ depending upon the distance between the valve openings in the tank. The connection piece 11207 preferably has a rectangular cross section as taken transverse across the tank. Any shape for the cross section is contemplated and the shape may be circular, oval, triangular, octagonal, etc.

Another embodiment includes an installation method using the unitary multiple flush valve assembly 11206 wherein the first valve assembly 1180 and the second valve assembly 1170 are permanently connected to each other. Additionally, this method of installation may be useful to install two separate valve assemblies 1170 and 1180 when the linking device 11200 is interlocked prior to the valves being installed within the tank. In the embodiment comprising a unitary multiple flush valve assembly 11206 both the first valve body 1131 and the interlocked second valve body 1121 may be installed within the tank at the same time and secured to the bottom of the tank using conventional tank to bowl installation methods. Additionally, a tank to bowl gasket kit, as described below, may be used. Each valve body 1121 and 1131 may be inserted through a separate hole in the bottom of the tank. If not permanently connected, the separate valve assemblies 1170 and 1180 may be installed in the connected form. If so, it is contemplated that the individual valve assemblies 1180 and 1170 could be disconnected from each other and removed from the tank individually. However, individual removal would be difficult or impossible with the unitary multiple flush valve assembly 11206 wherein the first 1170 and second 1180 valve assemblies are permanently affixed to each other.

In an embodiment such as toilet bowl assembly 110 separate manifolds for separating the fluid flow introduced into the bowl assembly 110 from at least one flush valve assembly and delivering different fluid volumes to the jet 120 and to the rim 132. This is distinguished from a traditional toilet design in which fluid enters a bowl through one toilet inlet, flows into an open single manifold and then flows in an uncontrolled or gravity-controlled manner downward into the jet 120 and into the rim 132. In such prior art designs, the amount and nature of the fluid flow to the rim or direct jet is difficult to control and typically favors the jet over the rim due to gravity and flow momentum. However, by isolating the flow of fluid to the jet 120 and flow of fluid to the rim 132, fluid flow is controlled and the jet and rim received desired flow volumes. In addition, it allows for maintaining a closed jet fluid path 101 including the primed jet channel 138 and preferably a primed jet manifold 112.

Any optional jet manifold 112 is preferably pre-formed into the chinaware or other manufacturing material of the toilet bowl and is arranged in a stacked position and/or juxtaposed to a rim manifold. The manifolds may be juxtaposed but not completely at the same level. The jet manifold 112 may have a jet manifold outlet opening 116 for delivery of fluid to a jet inlet port 118. A rim manifold 122 may include a rim manifold inlet opening 124 configured for receiving fluid in varying amounts, for example, about 0.1 liters to about 5.5 liters, from the rim flush valve assembly 180, preferably from about 0.5 liters to about 4.5 liters. The rim manifold 122 also has a rim manifold outlet opening 126 for delivery of fluid to a rim inlet port 128. The flow of fluid through the jet 120 may travel directly down the jet channel(s) 138 and out the jet outlet port 142 and enter the sump area 140 at a time different from the entry of water passing through the rim channel 134 and one of these flows may stop before the other, but through at least a portion of the flush cycle, the flow preferably occurs simultaneously. These flow rates are selected to maximize cleaning of the interior surface 137 of the toilet bowl 130 before evacuating the sump area 140.

In another embodiment, the rim channel 134 can be powered directly by line pressure from typical residential or commercial plumbing lines. The opening and closing of flow to the rim can be controlled with mechanical pilot valves similar to those currently used as toilet fill valves or electronically with solenoid valves.

The bowls herein such as bowl 30, 130 may have varied configurations, but most bowls are pre-molded to be generally round or an elongated oval or elliptical shape when viewed transversely from the top of the bowl. In the embodiment described and shown herein, the bowl 30 has a generally elliptical shape. Bowl 130 has a rim 132 provided around an upper perimeter thereof and defining a rim channel 134. The rim channel has an inlet port 128 (at a transition point between the manifold and the rim channel where the rim channel cross-section becomes more uniform) in fluid communication with the rim manifold outlet opening 126 and at least one rim outlet port 129, preferably multiple such outlets, in fluid communication with an interior area 136 of the bowl assembly 110. Bowl 130 further has a jet 120 provided so that the jet channel(s) preferably pass along the exterior surface 135 of the bowl 130 or within the wall of the bowl so that the jet outlet port 142 is located in a lower portion 139 of the bowl 130.

In various embodiments herein such as toilet 10, the jet 20 defines at least one jet channel 38 having a jet outlet port 42 configured for discharging fluid to a sump area 40, and then to an entrance to a trapway 44 and to a toilet outlet O which can connect to a sewage outlet.

Figure 16:
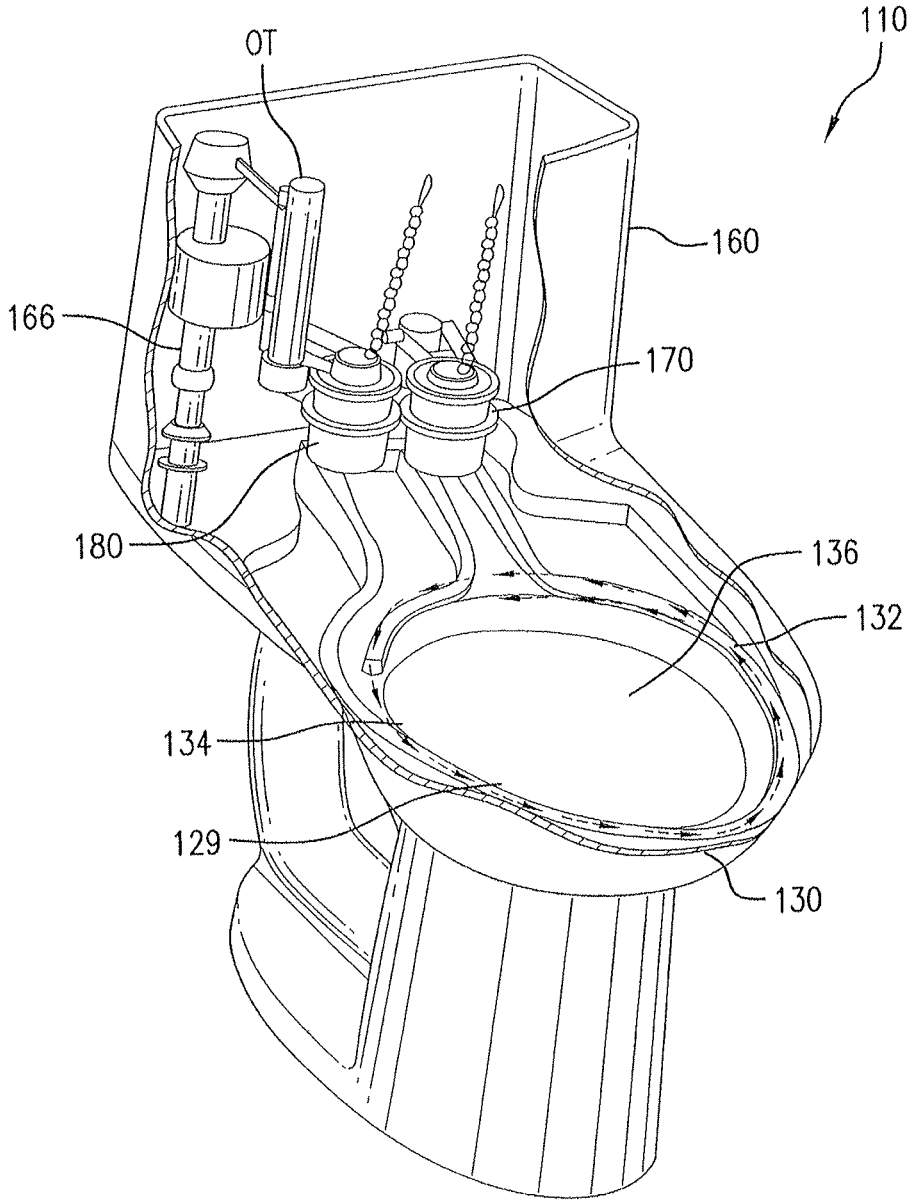
FIG. 16 is a front perspective view of a siphonic toilet bowl assembly according to one embodiment of the invention having a rim channel and at least one rim outlet port.
Figure 18:
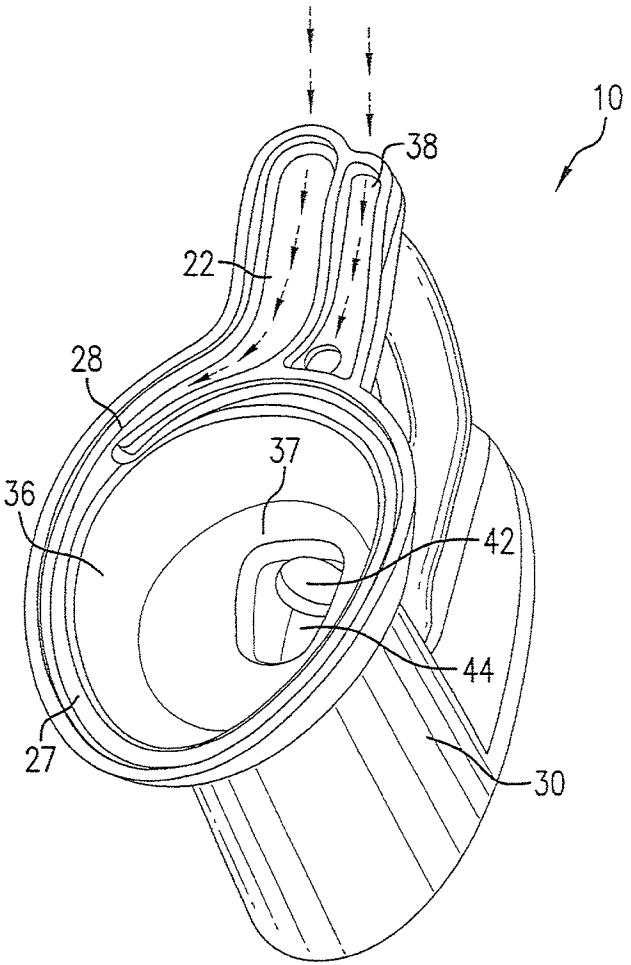
FIG. 18 is an perspective cross-sectional view of the siphonic toilet bowl assembly of FIG. 17.
Figure 17:
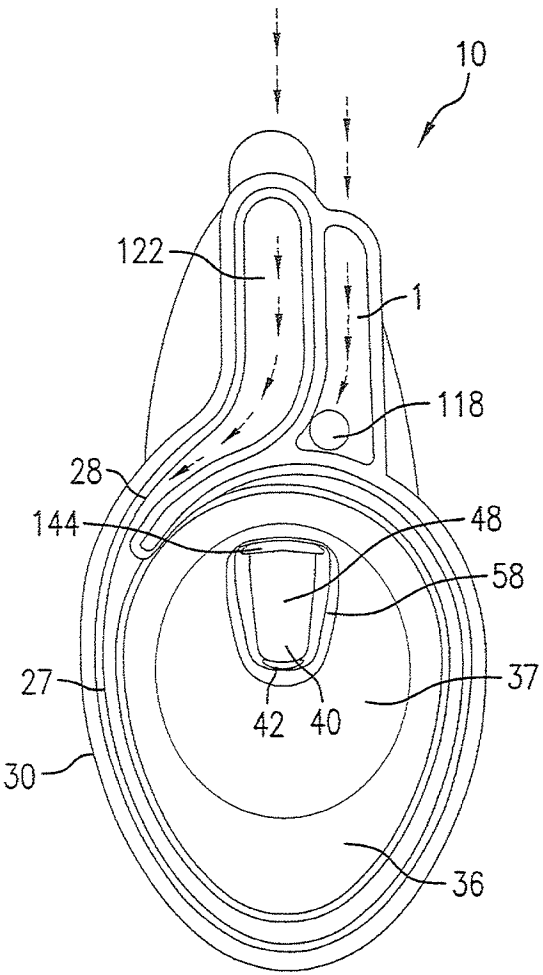
FIG. 17 is a is a transverse cross-sectional top view of the siphonic toilet bowl of FIG. 1 showing the rim channel inlet port and initial rim and jet flow.

In the embodiment of FIG. 16, some of the flush water is directed through the rim channel 134 and flows through openings 129 positioned in the rim 132 providing liquid communication between the channel 134 and the interior area of the bowl 130 so as to disperse water over the entire surface of the bowl 30, which serves to cleanse the bowl during the flush cycle. The water that flows through the rim channel 134 may also in some embodiments herein be pressurized upon exiting the rim outlet ports 129 or from an external fluid source as described above. Depending on the size of the outlet ports, toilet geometry and flow rate, pressurization can cause a strong pressurized stream of water for cleansing the bowl as well as contributing to the siphon. The remainder of the flush water from a separate jet valve assembly 170 is directed to the jet 120.

The jets 20, 120 herein and the at least one jet channel(s) 38, 138 provide a more energetic and rapid flow of flush water to the trapway entrance 44, 144, enabling toilets to be designed with even larger trapway diameters, however, care should be taken to minimize bends and constrictions that can impact operation and to improves the performance in bulk waste removal relative to non-jetted and/or rim jetted bowls.

The at least one jet channel 38 is designed to extend within the interior of the toilet bowl assembly 10 so as to pass around the exterior surface of the toilet bowl 30 but is also positioned to be at least partially within a space defined within the toilet bowl assembly body 10 generally under or beneath the interior area wall 36 of the bowl 30. Multiple jet channels of varying size may be used, for example, two symmetrical channels on either side of the bowl 30 deliver a "dual fed" flow of fluid to the jet 20.

Figure 23:
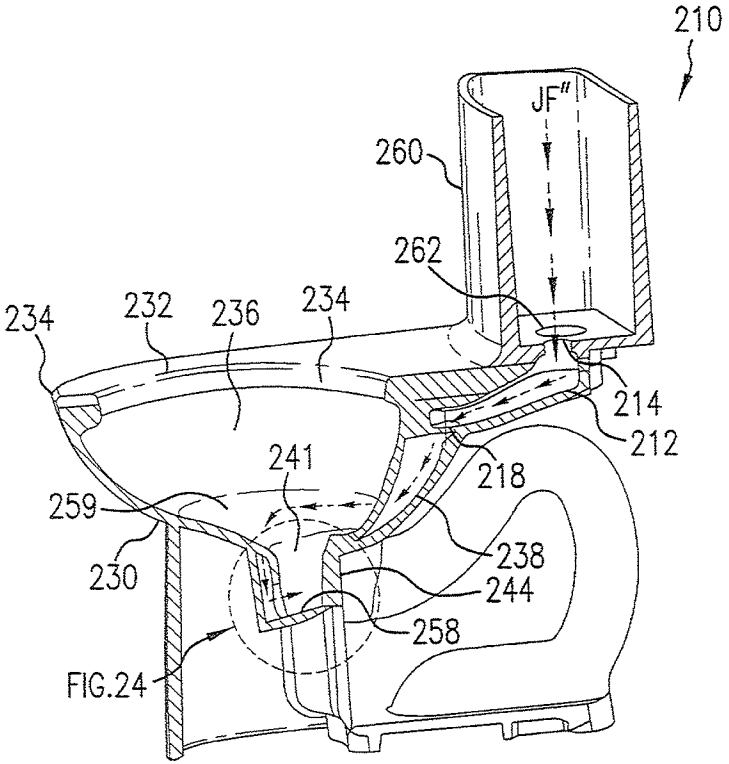
FIG. 23 is a longitudinal cross-sectional view of an alternative embodiment of a siphonic toilet bowl assembly to that of FIG. 21 showing the flow of fluid to a jet with the jet flush valve assembly removed and in which at least a portion of the wall of the toilet bowl in a sump area is upwardly inclined toward a trap inlet from the jet outlet port.

The jet outlet port 42 is configured for discharging fluid from the jet channel 38 to a sump area 40, which is in fluid communication with a trapway 44. The jet outlet port 42 preferably has a height $H_{jop}$ in one embodiment herein, as shown in FIG. 23, of about 1.0 cm to about 10 cm, preferably about 1 cm to about 6 cm, and most preferably about 1 cm to about 4 cm as measured longitudinally across the inner diameter of the jet channel 38. Regardless of the height $H_{jop}$, the cross-sectional area of the jet outlet port should be maintained at an area of about 2 $cm^2$ to about 20 $cm^2$, more preferably of about 4 $cm^2$ to about 12 $cm^2$, and most preferably of about 5 $cm^2$ and 8 $cm^2$. In one embodiment herein, the height $H_{jop}$ of the jet outlet port 42 at an upper surface 54 or uppermost point is preferably positioned at a seal depth x below an upper surface 56 of the inlet 49 to the trapway 44 as shown and is measured longitudinally through the sump area 40. The seal depth x preferably is about 1 cm to about 15 cm, more preferably about 2 cm to about 12 cm, and most preferably about 3 cm to about 9 cm to help prevent passage of air into the jet channel 38 through outlet port 42. This distance should also preferably be equal to or below the minimum level of fluid in the sump area 40 to avoid a break in the jet channel 38 and to maintain a primed state in the jet channel 38 of the toilet bowl assembly 10 with fluid from the jet flush valve assembly 70 or other flush valve before actuation of and after completion of a flush cycle.

As discussed above, maintaining a primed jet channel 38, i.e., a closed jet fluid path 1, greatly reduces turbulence and resistance to flow, improves toilet performance, and enables lower volumes of water to be used to initiate siphon. Air in the jet channel 38 hampers the flow of flush water and restricts the flow of the jet 20. Furthermore, air, if not purged, can be ejected through the jet outlet port 42 and enter into the trapway 44, which can retard the trap siphon and affect clearance of bowl 30 fluid and waste.

To improve the cleaning function of the bowl in rim channel embodiments such as 110, it is also a preferred option to design the toilet assembly so that the rim is pressurized during the flush cycle. Pressurization of the rim channel 134 is preferably achieved by maintaining the relative cross-sectional areas as in relationship (I):

$$A_{rm} > A_{rip} > A_{rop} < 6\ cm^2 \quad (I)$$

wherein $A_{rm}$ is the longitudinal cross-sectional area of the rim manifold 122, $A_{rip}$ is the cross-sectional area of the rim inlet port 28, and $A_{rop}$ is the total cross-sectional area of the at least one rim outlet port 29. Preferably, the cross-sectional area $A_{jm}$ of the jet manifold 112 is from about 20 $cm^2$ to about 65 $cm^2$ and the cross-sectional area $A_{rm}$ of the rim manifold 122 is from about 12 $cm^2$ to about 50 $cm^2$. The cross-sectional area $A_{jm}$ of the jet manifold 12 is measured at a distance about 7.5 cm downstream from the center of the jet flush valve inlet opening 162. Likewise, the cross-sectional area $A_{rm}$ of the rim manifold 122 is measured at a distance about 7.5 cm downstream from the center of the rim flush valve inlet opening 164. Maintaining a preferred geometry of the water channels within these parameters and otherwise avoiding constrictions or bends that impact performance allows for a toilet bowl assembly 110 that maximizes the potential energy available through the gravity head of the water available from a fluid source, or in a tank, which becomes extremely critical when reduced water volumes are used for the flush cycle. In addition, maintaining the geometry of the water channels within these parameters and avoiding constrictions and overly small passageways in the jet or trap enables preferred pressurization of the rim and jet channels in a direct-fed jet toilet, maximizing the performance in both bulk removal and bowl cleaning. Since there are preferably a plurality of rim outlet ports which can be of varying sizes depending on the desired design, the area of the rim outlet ports is intended to be the sum of all of the individual areas of each such outlet port. Similarly, if multiple jet flow channels 118 or multiple jet outlet/inlet ports are used, then the jet channels 118 or any multiple ports 142 would be the sum of the areas of the jet channels or jet ports, respectively. Further, to achieve the benefits of pressurization in the rim, it is preferred that the jet channel not be made overly small or constricted to avoid clogging and poor performance when functioning with the pressurized rim as described in U.S. Pat. No. 8,316,475, incorporated in relevant part with respect to sizing of rim and jet channels and toilet geometry in a pressurized rim siphonic toilet design.

Figure 22:
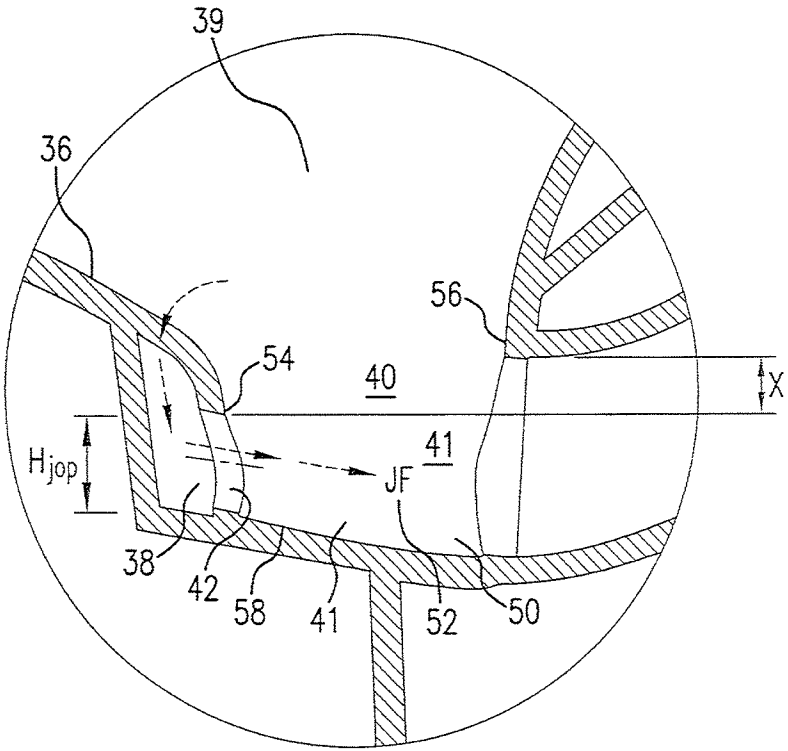
FIG. 22 is a greatly enlarged, partially cut-away cross-sectional view of the sump area of FIG. 21.
Figure 24:
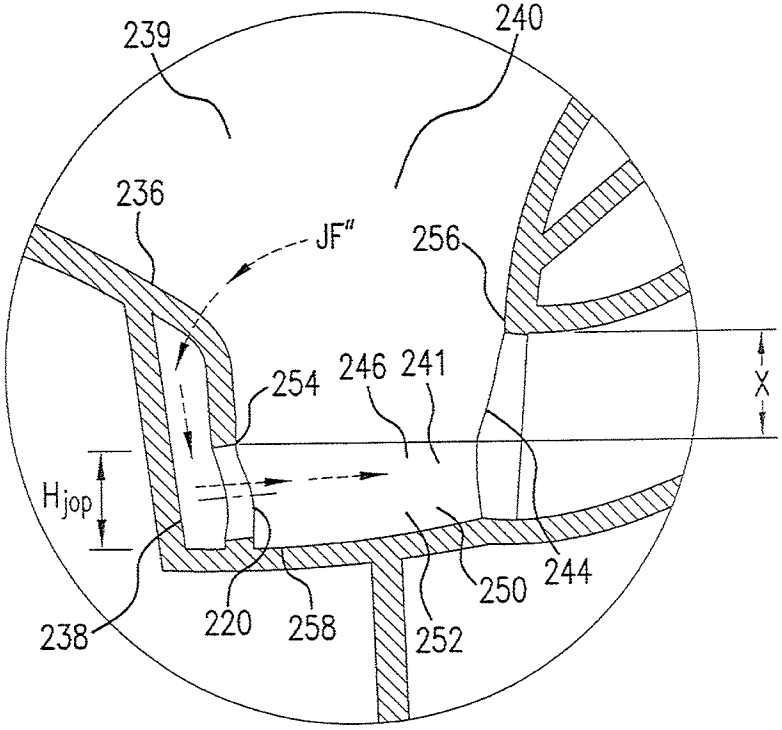
FIG. 24 is a greatly enlarged, partially cut-away cross-sectional view of the sump area of FIG. 23.
Figure 27:
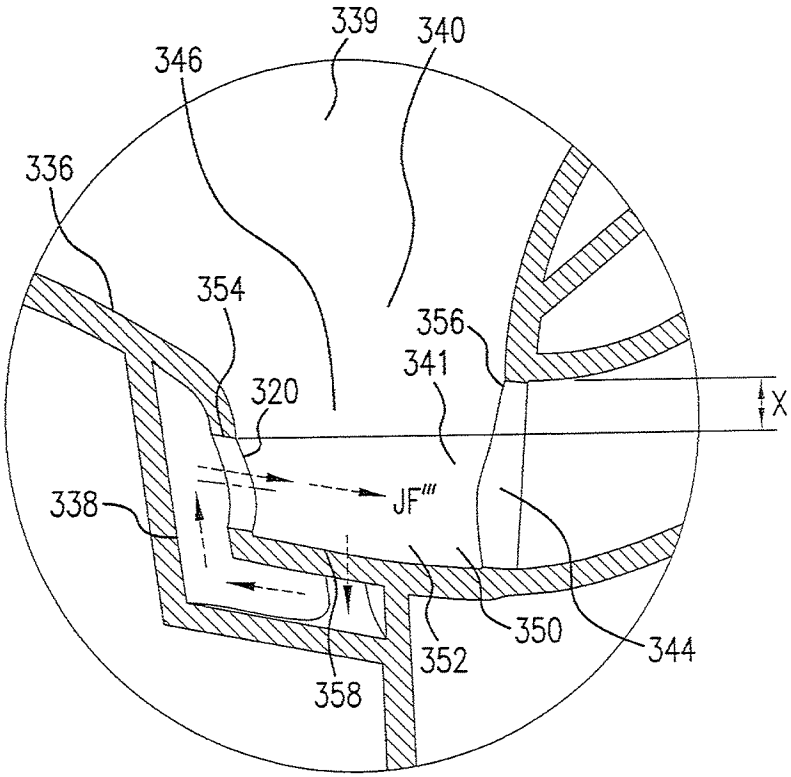
FIG. 27 is a greatly enlarged, partially cut-away cross-sectional view of the sump area of FIG. 26.

The sump area 40 of the toilet bowl 30 in embodiment 10, collects water from the rim, the jet channel 38, flush water and waste for evacuation. The sump area 40 is located in a bottom portion 39 of the bowl 30, and defines a trap 41 for the jet 20 by an interior surface 36 of the bowl 30 and extending longitudinally from a trap inlet end 46 to a trap outlet end 50, wherein the inlet end 46 has an opening 48 for receiving fluid from the jet outlet port 42. The trap outlet end 50 has an opening 52 for fluid exiting the bowl to an entrance to a trapway 44. The jet trap 41 has a seal depth x, as shown in FIGS. 22, 24 and 27, that is the distance between the topmost point on an upper surface 54 of the inlet to the trapway 44 and the topmost point on an upper surface 54 of the jet outlet port 42.

The jet trap seal depth x is measured preferably so as to maintain a distance of about 1 cm to about 15 cm, more preferably 2 cm to about 12 cm, and most preferably 3 cm to about 9 cm to assist in maintaining the siphon in the sump area 40. When the jet trap seal depth x is sufficiently large, it establishes a buffer level of fluid in the sump area 40 that helps ensure the trapway will break siphon before the level of water in the jet trap 41 can be pulled below the depth at which the seal of the jet channel 38 will be broken, thereby preventing the passage of air into the jet channel 38 and maintaining the jet channel 38 in a fully primed state. Conversely, in some embodiments, the jet trap seal depth x can be equal to 0 or less than 0 (when above the trap) and still maintain a primed state in the jet channel 38 and path 1 by adjusting the rate of flow through the jet flush valve assembly 70.

In the sump area 40, at least a portion of the interior surface 36 has a inclined portion 58 that may be upwardly inclined towards the trap entrance from the jet outlet port 42 so as to increase the seal depth x of the jet channel 38 and decrease the likelihood of air entering the jet channel 38 during or after a flush cycle. The seal depth x can be further extended by forming a jet channel 38 that temporarily dips below the floor of the sump before rising to the jet outlet port 42 at the sump floor. The seal depth x can also be increased by reducing the diameter of the jet outlet port 42. Preferably, the height $H_{jop}$ of the jet outlet port 42 can be reduced to form a circular, oval or oblong outlet, which would help to maintain sufficient cross-sectional area and flow through the jet 20 while increasing the seal depth x of the jet channel 38.

FIG. 20 shows an alternate embodiment generally referred to herein as assembly 1010, but for the feature of a tank 1060 with separate reservoirs as described below in all other respects is the same and analogous reference numbers refer to analogous elements herein. The tank 1060 may include at least one jet reservoir 1068 and at least one a rim reservoir 1072, and the jet reservoir 1068 may include a jet fill valve 1090 and the at least one jet flush valve assembly, which may be the same as in assembly 10, as configured for delivery of fluid to the jet manifold inlet opening 1062, and the rim reservoir 1072 may have a rim fill valve 1092 and the at least one rim flush valve assembly, which may be the same as in assembly 110, configured for delivery of fluid to the rim manifold inlet opening 1064. This may be a partial transverse division of the tank 1060, allowing for the use of one fill valve, or the tank division may be a permanent pre-molded casting of the tank into multiple reservoirs. If an overflow tube is optionally present in both the jet reservoir 1068 and the rim reservoir 1072, the overflow tube has to be operated from the flow RF' of the rim flush fluid and not from the flow JF' of the jet flush fluid.

FIGS. 23 and 24 show another embodiment generally referred to herein as assembly 210. But for the feature of the sump area inclined wall being configured in an upwardly inclined or tapered position toward the entrance of the trapway 244 as described below in all other respects is the same as the embodiment 10. The sump area wall 258 as shown in FIGS. 23 and 24 is designed to extend around and enclose the sump area 240. The jet outlet port 242 is positioned so that fluid JF" from the jet channel 238 enters into the bowl sump area 240 so as to merge with fluid that has entered the toilet bowl from the rim through the at least one rim outlet port (not shown). The jet fluid flow JF" and the rim fluid flow RF" merges at that point (and with waste and other fluid if present) and then flows together generally downwardly along the bowl interior surface 236 and over the sump wall into the sump area 240 into the trapway entrance 244 for expulsion through the sewage drain. At least a portion of a wall 258 may be upwardly inclined of desired to increase the seal depth x of the jet channel 238 that helps to prevent air from entering the jet channel 238 during or after a flush cycle. When the seal depth x is sufficiently large, it establishes a buffer level of fluid in the sump area 240 by helping to ensure the trapway 244 will break siphon before the level of water in the jet trap 241 can be pulled below the depth at which the seal of the jet channel 238 will be broken, thereby preventing the passage of air into the jet channel 238 and maintain the jet manifold 212 in a fully primed state.

Figure 25:
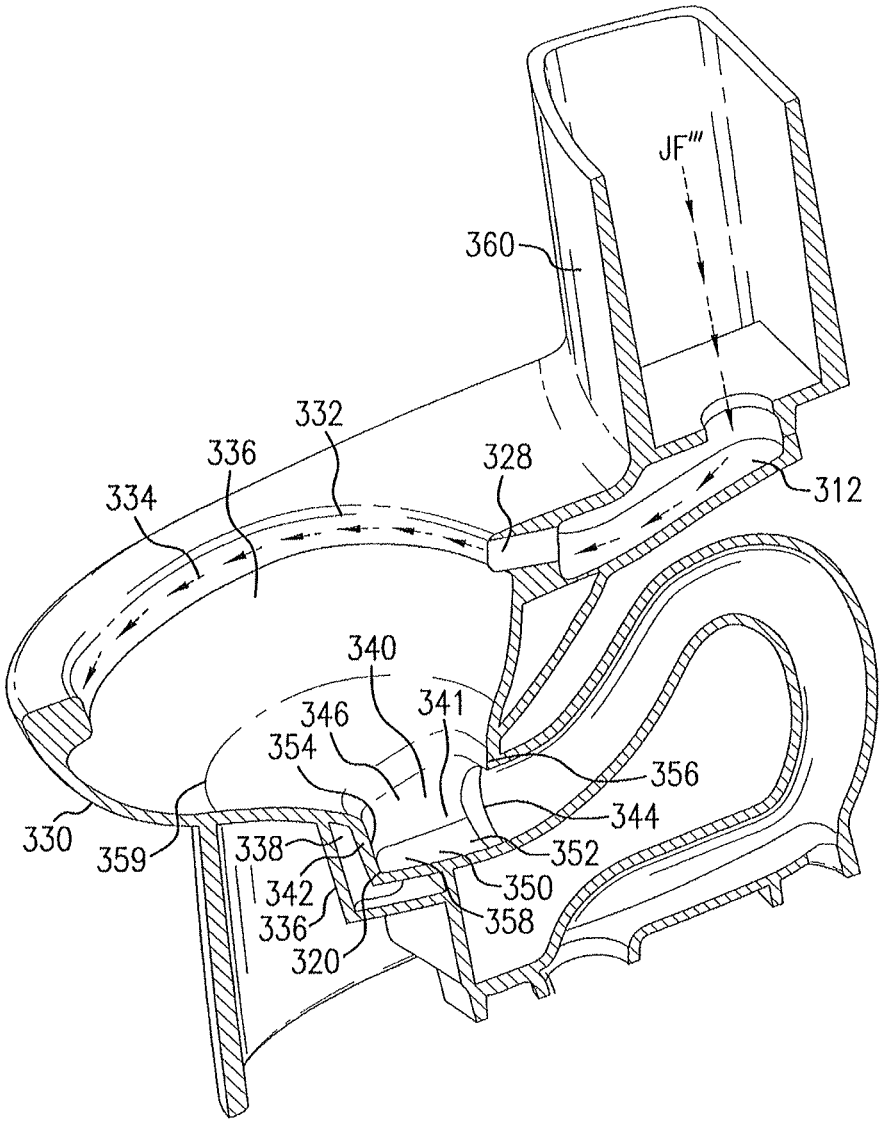
FIG. 25 is an isometric longitudinal cross-sectional view of an alternative embodiment of a siphonic toilet bowl assembly of the invention, in which the jet flow passes under the bowl and showing the flow of fluid to the rim with the rim flush valve assembly removed.
Figure 26:
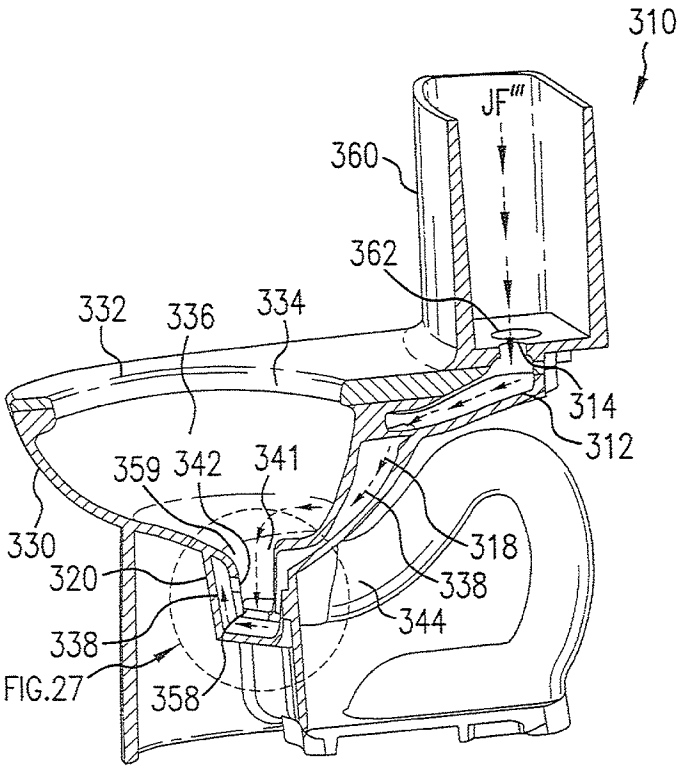
FIG. 26 is a longitudinal cross-sectional view of the siphonic toilet bowl assembly of FIG. 25 showing the flow of fluid through the jet.

FIGS. 25-27 show a different embodiment to those of FIGS. 16-24 generally referred to herein as assembly 310. But for the feature of the at least one jet channel 338 being under the bowl sump area 340 as described below in all other respects is the same as embodiment 10. The at least one jet channel 338 is designed to extend within the interior of the toilet bowl assembly 310 so as to be located behind the interior area wall 336 and the sump area wall at the rear of the bowl 330 but is also positioned to be at least partially within a space defined within the toilet bowl assembly body 310 generally under the interior area wall 336 and the sump area wall 358 of the bowl 330. The at least one jet channel 338 passing under or below the sump area 340 and ends within the sump area wall 358 so as to position the jet outlet port 342 directly opposite to the entrance to the trapway 344. The advantage of this construction is that the at least one jet channel 338 will more easily stay primed and thus, eliminate air in the jet channel 338 as its design is gravitationally able to maintain full jet fluid JF''' capacity and the level of fluid in the jet channel is inherently under the level of fluid or flush water in the bowl at both pre-actuation and post-actuation of a flush cycle. The routing of the jet channel 338 below the floor of the sump further increases the seal depth x of the jet channel 338 beyond what can be accomplished by a sloped sump floor embodiment such as that pictured in FIGS. 25 and 24, offering greater assurance that the trapway will break siphon before the level of water in the jet trap 341 can be pulled below the seal depth x at which the seal of the jet channel 338 will be broken, thereby preventing the passage of air into the jet channel 338 and maintaining the jet manifold 312 in a fully primed state.

Figure 28:
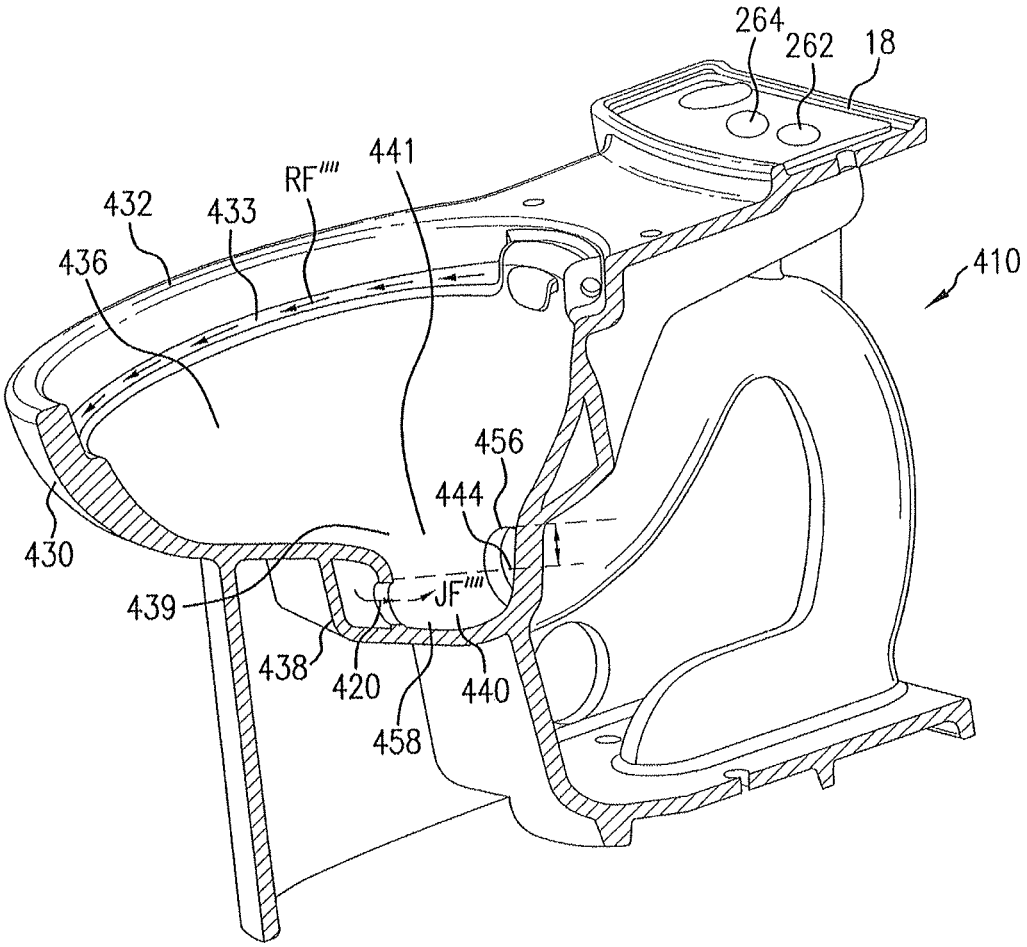
FIG. 28 is an isometric longitudinal cross-sectional view of an alternative embodiment of a siphonic toilet bowl assembly of the invention, showing the flow of fluid to an upper perimeter portion of the rim with the rim flush valve and the jet flush valve assemblies removed.
Figure 29:
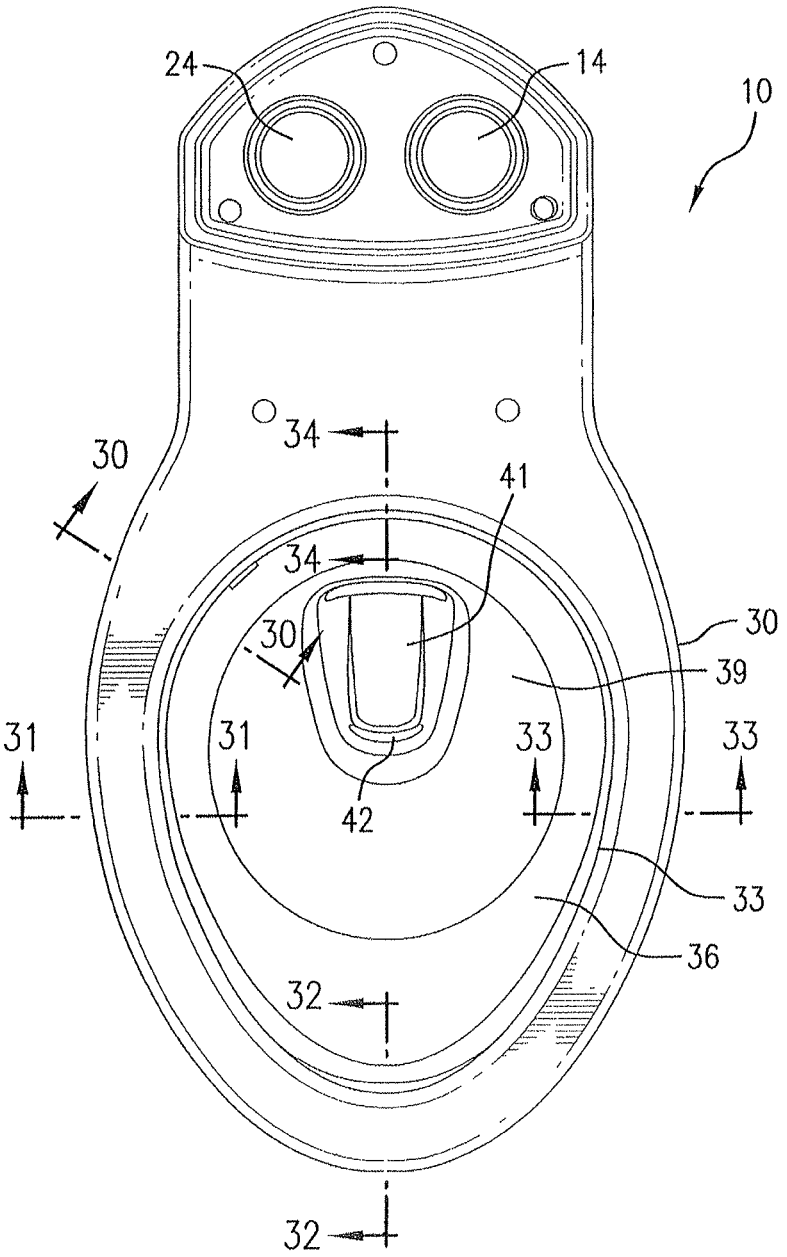
FIG. 29 is a transverse cross-sectional view of the toilet of FIG. 4B for illustrating various longitudinal cross-sectional views of the rim shelf as shown in FIGS. 30-34.

FIG. 28 shows a different embodiment to that of FIGS. 16-27 generally referred to herein as assembly 410. But for the feature of the upper peripheral portion 433 around an upper perimeter of a bowl 430 as described below in all other respects is the same. The rim 432 has an upper peripheral portion 433 which is positioned around the inside of the upper perimeter of the bowl 430 so that fluid RF'''' from the rim manifold enters into the bowl for washing down waste into the sump area 440 and to merge with fluid that has entered the toilet bowl from the jet channel 438 and expelled through the jet outlet port 442. The jet fluid flow JF'''' and the rim fluid flow RF'''' merges at that point (and with waste and other fluid if present) and then flows together generally downwardly along the bowl interior surface 436 and over the sump wall 458 into the sump area 440 into the trapway entrance 444 for expulsion through the sewage drain. When the seal depth x is sufficiently large, it helps to establish a buffer level of fluid in the sump area 440 that assists in ensuring the trapway will break siphon before the level of water in the jet trap 441 can be pulled below the depth at which the seal of the jet channel 438 will be broken, thereby preventing the passage of air into the jet channel 438 and maintaining the jet manifold in a fully primed state.

In another embodiment a rimless version of the embodiment is pictured in FIG. 28, flow of fluid enters from rim inlet ports behind a distributor and around a rim shelf in two opposite directions on the upper peripheral portion 433 and passes at least partially around the interior surface of the bowl, thereby forming cleaning action. In a preferred embodiment, upper peripheral portion 433 can be formed so as to guide the flush water downward as it flows around the perimeter of the bowl 430. This embodiment is similar to the assembly of FIG. 1-13 but has a different rim shelf design.

In an embodiment of the preferred method of the invention, after providing, such as by manufacturing, a toilet bowl assembly 10, such as the one described herein, jet is primed with fluid JF from the at least one jet flush valve assembly 70 before actuation and after actuation of a flush cycle. The method herein may be practiced on any of the embodiments herein, including assemblies 10, 1010, 110, 210, and 310, 410, etc.; however, for convenience, an exemplary embodiment of the method will be described with references to assembly 10, embodied in FIGS. 1-13. Analogous parts in alternative embodiments may also be used if practicing the invention using other embodiments.

Priming of the jet manifold 12, jet inlet port 18 and the at least one jet channel 38 before actuation of a flush cycle occurs by opening a flapper or cover of the jet valve flush assembly 70 and allowing fluid (such as flush water) to flow into the jet inlet port 18 and the at least one jet channel 38 upon installation of the toilet bowl assembly 10 onto an installation surface. This priming will automatically occur with the first activation of a flush cycle. When the rim flush valve 80 and the jet flush valve 70 close, water will be maintained in the jet channel 38 and jet manifold 12, held in place by the force that atmospheric pressure exerts on the surface of water in the bowl 10. If any small air pockets remain in the at least one jet channel 38 or jet manifold 12 after the first flush, they will be ejected upon subsequent flushes to yield a fully primed system.

After the initial priming of the toilet bowl assembly of the embodiments herein, a user will actuate a flush cycle. In a standard prior art toilet bowl assembly, a flush valve assembly, such as those described herein, and an overflow tube are provided for use. A flush valve cover connected to the flush valve assembly and a bulb are both connected to a pivot arm. The pivot arm is attached to the top of the flush valve cover and includes a link for attachment to a chain that can be used to lower and raise the valve cover through actuation of any standard valve actuator such as a flush handle and lever, etc. In use, the pivot arm of the flush valve cover is attached to an overflow tube using a standard connection that protrudes from the overflow tube and opens and closes over the inlet opening of the flush valve assembly.

When the flush cycle has been initiated or actuated in the current invention, a flush valve cover opens on both the rim flush valve assembly and the jet flush valve assembly and allows for fluid to pass through the at least one jet flush valve assembly 70 into the jet and rim. These may open simultaneously or through a time delay system as known or to be developed in the art to allow for optimal flow rates through the toilet bowl assembly 10, such as by using embodiments of the flush activation bar 75 and 1175 noted above.

Following actuation of a flush cycle and after completion of the flush cycle, the jet the jet inlet port 18 and the at least one jet channel 38 remain in a primed state as long as (1) the depth of water in the reservoir feeding the jet flush valve is not allowed to fall to the level of the inlet 71 to the jet flush valve 70 before the jet flush valve 70 is closed and (2) the seal of the jet channel 38 is not broken during or after the flush cycle. If both of these conditions are met, the closed jet fluid path 1 including the jet channel 38 and the jet manifold 12 will remain fully primed and ready for the next flush cycle.

The invention will now be described with respect to the following non-limiting Example:

EXAMPLE

Table 1 summarizes data from 20 flushes completed using three different toilets. The present invention was tested based on the embodiment shown herein in FIGS. 1-13 and 29-34. Prior art toilets tested required 79-82% of the flush water to be directed to the jet to achieve desired hydraulic performance of the siphon. The toilet made according to the present invention provided essentially equivalent hydraulic performance using less than 30% of the flush water directed to the jet, thereby allowing the remainder of the water to be used for significant improvement to bowl cleaning.

TABLE 1

| | | Main Flush [l] | Peak Rate [l/s] | Time to Peak [s] | Time to 2500 ml/s [s] |
|---|---|---|---|---|---|
| Prior Art Toilet "K" | Average | 4.343 | 3.239 | 0.778 | 0.405 |
| 79% of Main Flush | STD | 0.068 | 0.116 | 0.144 | 0.03 |
| Volume Through Jet | MAX | 4.458 | 3.478 | 0.99 | 0.45 |
| | MIN | 4.219 | 2.994 | 0.55 | 0.35 |
| Prior Art Toilet "T" | Average | 4.367 | 3.94 | 0.6 | 0.322 |
| 82% of Main Flush | STD | 0.186 | 0.112 | 0.039 | 0.016 |
| Volume Through Jet | MAX | 4.829 | 4.175 | 0.69 | 0.36 |
| | MIN | 4.106 | 3.762 | 0.54 | 0.3 |
| Present Invention | Average | 4.456 | 3.547 | 0.982 | 0.583 |
| 27% of Main Flush | STD | 0.052 | 0.131 | 0.088 | 0.084 |
| Volume Through Jet | MAX | 4.584 | 3.794 | 1.12 | 0.72 |
| | MIN | 4.377 | 3.234 | 0.81 | 0.45 |

The various embodiments herein, 10, 110, 1010, 210, 310, 410, etc. may each benefit from variations in the jet flush valve herein. Optional and unique features may be provided to the jet flush valve designs noted above to improve operation of the various embodiments. In use, should the toilet ever become clogged, or for some other reason, the toilet needs plunging for various plumbing reasons, it is important to release the clog but prevent back-flow up the closed jet pathway through the jet valve which is in a constant primed state. Backflow is not a concern in conventional toilets as they are open to atmosphere. In the present primed invention, it is an issue due to the weight of the water and the existing column of water in the jet channels. One way to modify the jet flush valves herein so as to resist back-flow is by providing a back-flow preventer device to the jet flush valve. Such devices will now be described with respect to a jet flush valve otherwise analogous to jet flush valve 70 herein.

Although the flush valve designs discussed above are very effective against the backflow of water that could occur on plunging, added levels of protection may be desired in some embodiments. Intentionally breaking the prime, i.e., letting air into the closed jet channel and opening it to atmosphere greatly reduces the potential for backflow.

FIGS. 35-38 show an embodiment of a jet flush valve, referred to herein as jet flush valve 570 having a flapper cover 573 and a back-flow preventer mechanism 574 that has a hold-down linkage configuration. The cover 573 may be the same as cover 15 of valve 70 in assembly 10. As shown, the cover 573 is fitted with a first front linkage mount 593 for attaching the hold down linkage. The linkage assembly in the back-flow preventer mechanism 574 includes a first front linkage arm 575 having an attachment point P for a chain C to connect to an actuator mechanism (such as in FIG. 15) to allow lifting of the cover 573. Such a chain can include a float as described above.

The first linkage arm is connected by a hinge pin such as pin 578 to a second linkage arm 576, but other hinge connectors, pins, living hinges, molded pins, rivets or similar mechanisms may be used. Similarly, linkage arm 576 is connected by a similar hinge connector to a third linkage arm 577 which is also pivotally mounted to a back hinge mount 579. In use, if the flapper is lifted, the back-flow preventer hold-down linkage lifts and bends freely as shown so as to form an angle of less than about 180° between the first and second linkage arms when fully opened.

Figure 37:
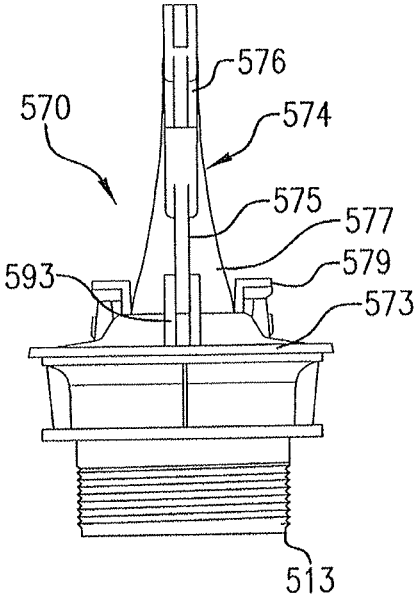
FIG. 37 is a front elevational view of the jet valve of FIG. 35 in the closed state.
Figure 38:
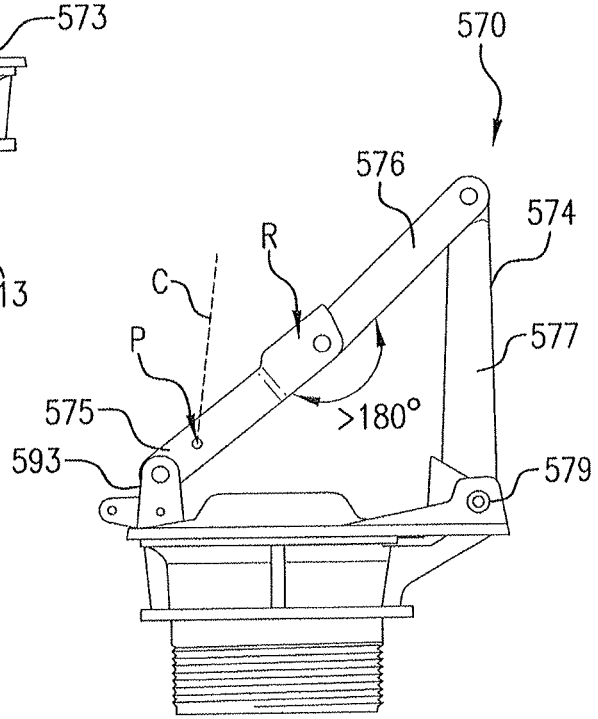
FIG. 38 is a right side elevational view of the jet valve of FIG. 37.
Figure 40:
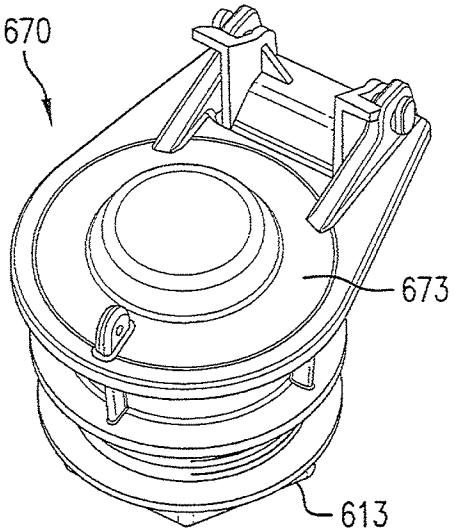
FIG. 40 is a top perspective view of the jet valve of FIG. 39.
Figure 42:
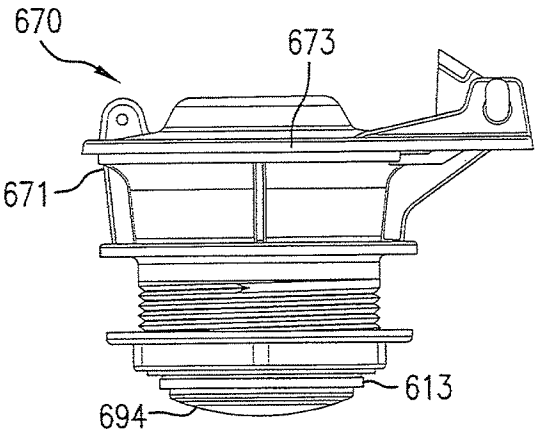
FIG. 42 is a right side elevational view of the jet valve of FIG. 39.
Figure 39:
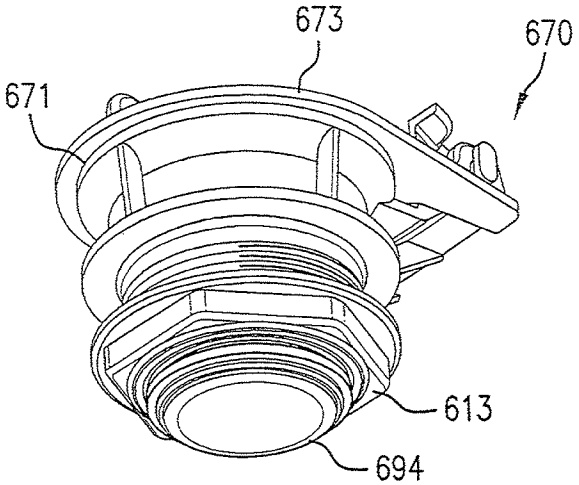
FIG. 39 is a bottom perspective view of a further jet valve for use in the embodiments of the invention herein shown in a closed state in an embodiment of the jet valve having a flapper and lower poppet opening.
Figure 41:
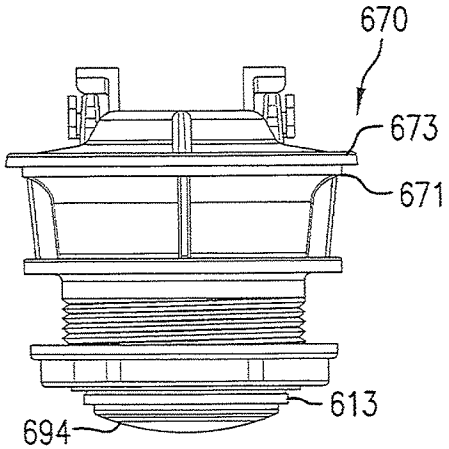
FIG. 41 is a front elevational view of the jet valve of FIG. 39.
Figure 45:
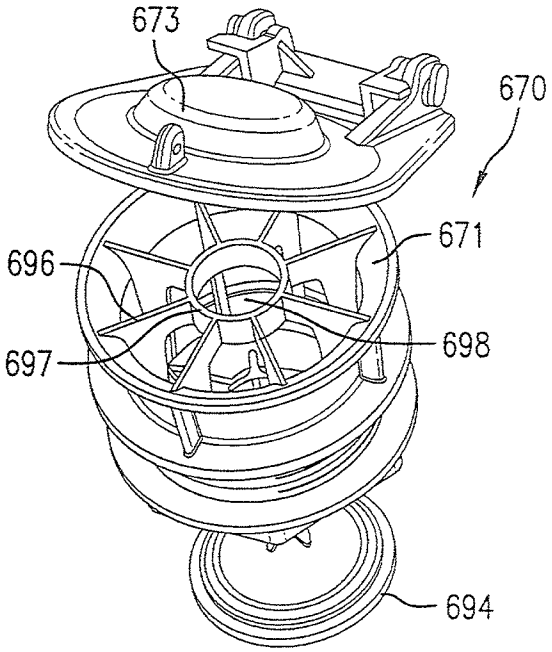
FIG. 45 is a top perspective view of the jet valve of FIG. 44 showing a star-configuration internal rib structure.
Figure 44:
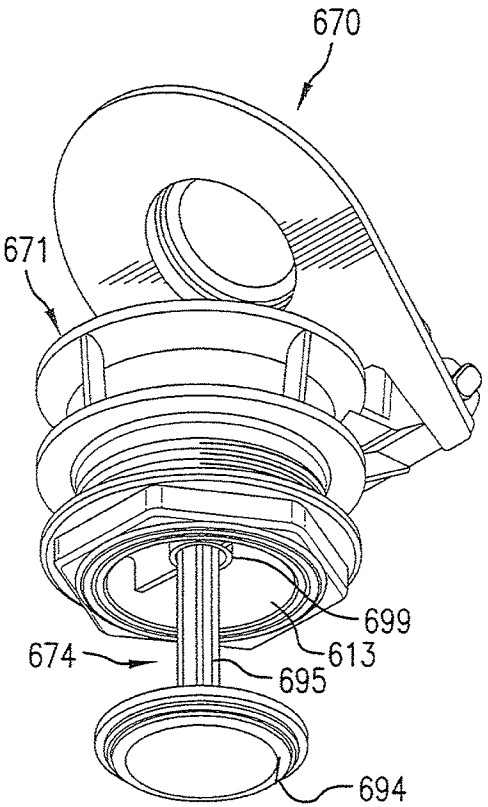
FIG. 44 is a bottom perspective view of the jet valve of FIG. 39 in an open state.
Figure 43:
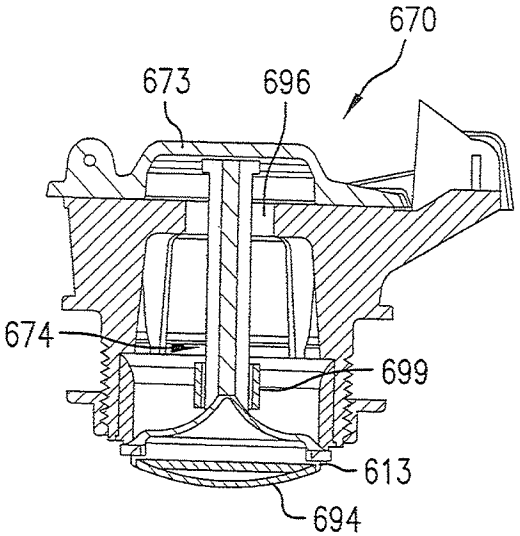
FIG. 43 is a longitudinal cross-sectional view of the jet valve of FIG. 39.
Figure 48:
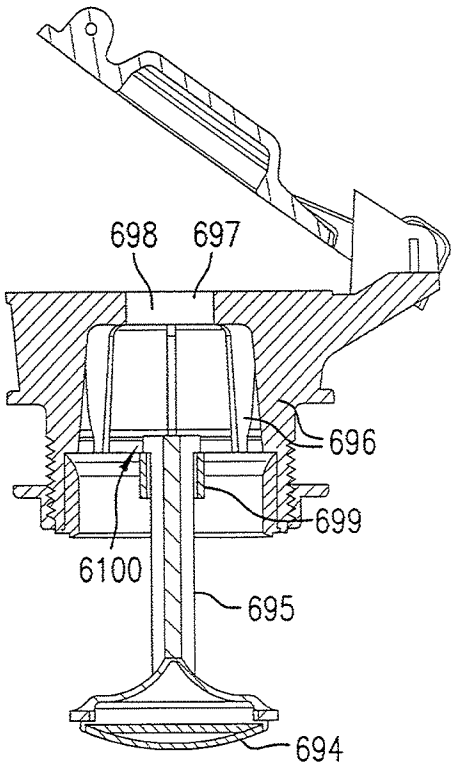
FIG. 48 is a longitudinal cross-sectional view of the jet valve of FIG. 44.
Figure 47:
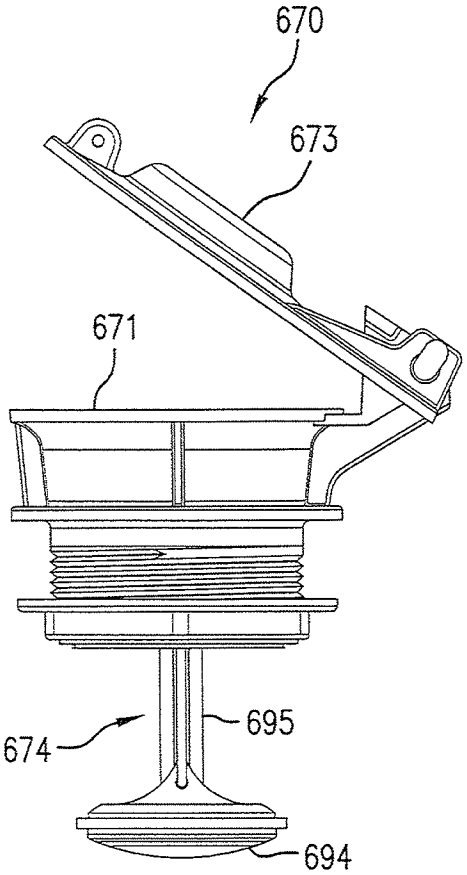
FIG. 47 is a right side elevational view of the jet valve of FIG. 44.
Figure 46:
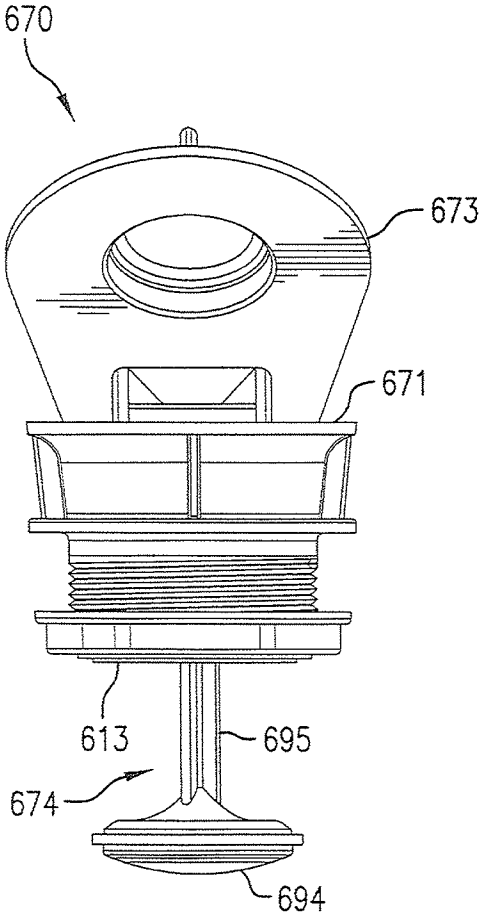
FIG. 46 is a front elevational view of the jet valve of FIG. 44.
Figure 51:
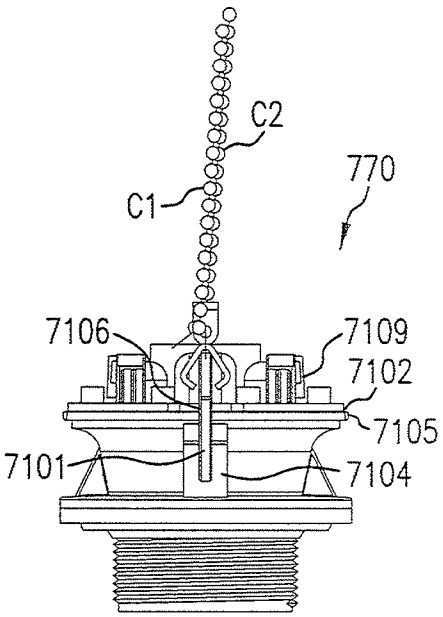
FIG. 51 is a front elevational view of the jet valve of FIG. 49.
Figure 50:
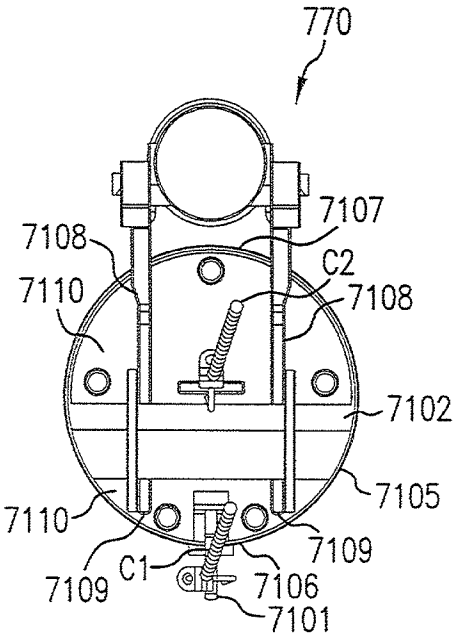
FIG. 50 is a top plan view of the jet valve of FIG. 49.
Figure 49:
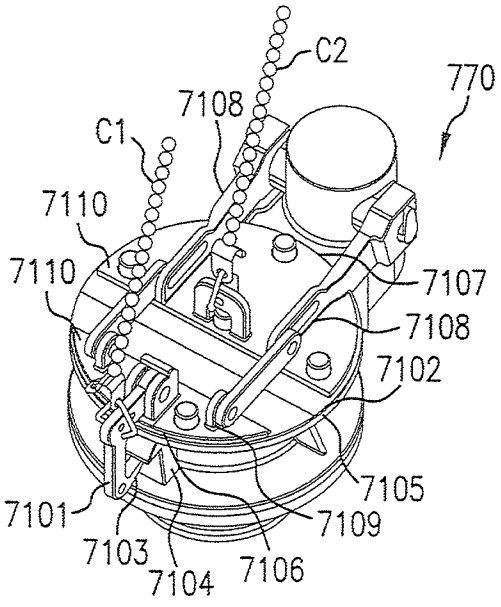
FIG. 49 is a top perspective view of a further jet valve for use in the embodiments of the invention herein shown in a closed state and having a back-flow preventer mechanism including a peel-back flapper cover and a hinged mechanism with lifting hook.
Figure 53:
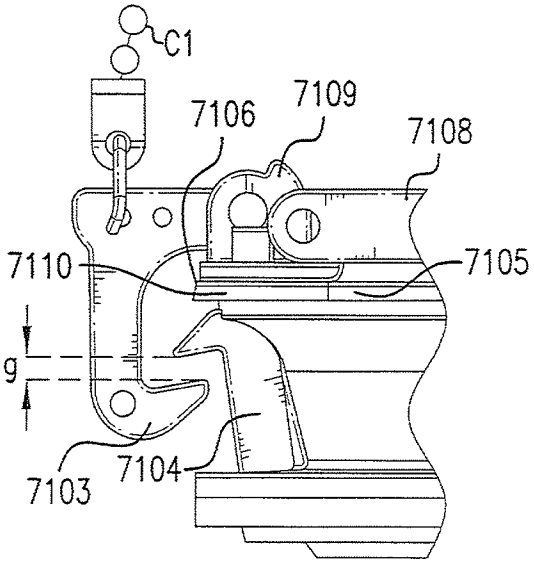
FIG. 53 is an enlarged portion of the valve of FIG. 52 at the location of the hook.
Figure 52:
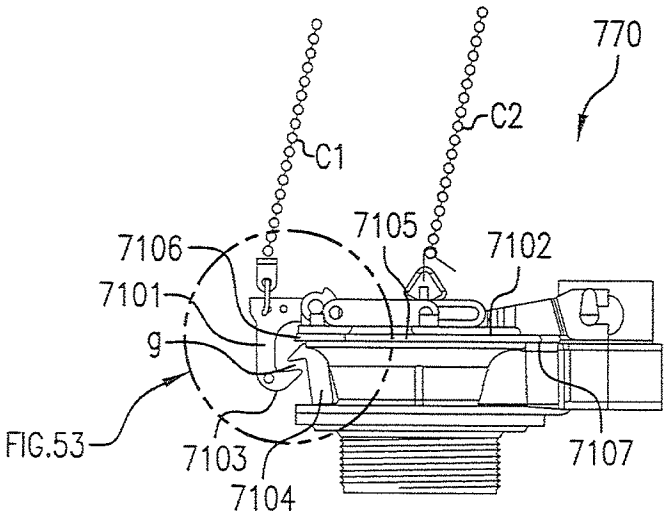
FIG. 52 is a right side elevational view of the jet valve of FIG. 49.
Figure 54:
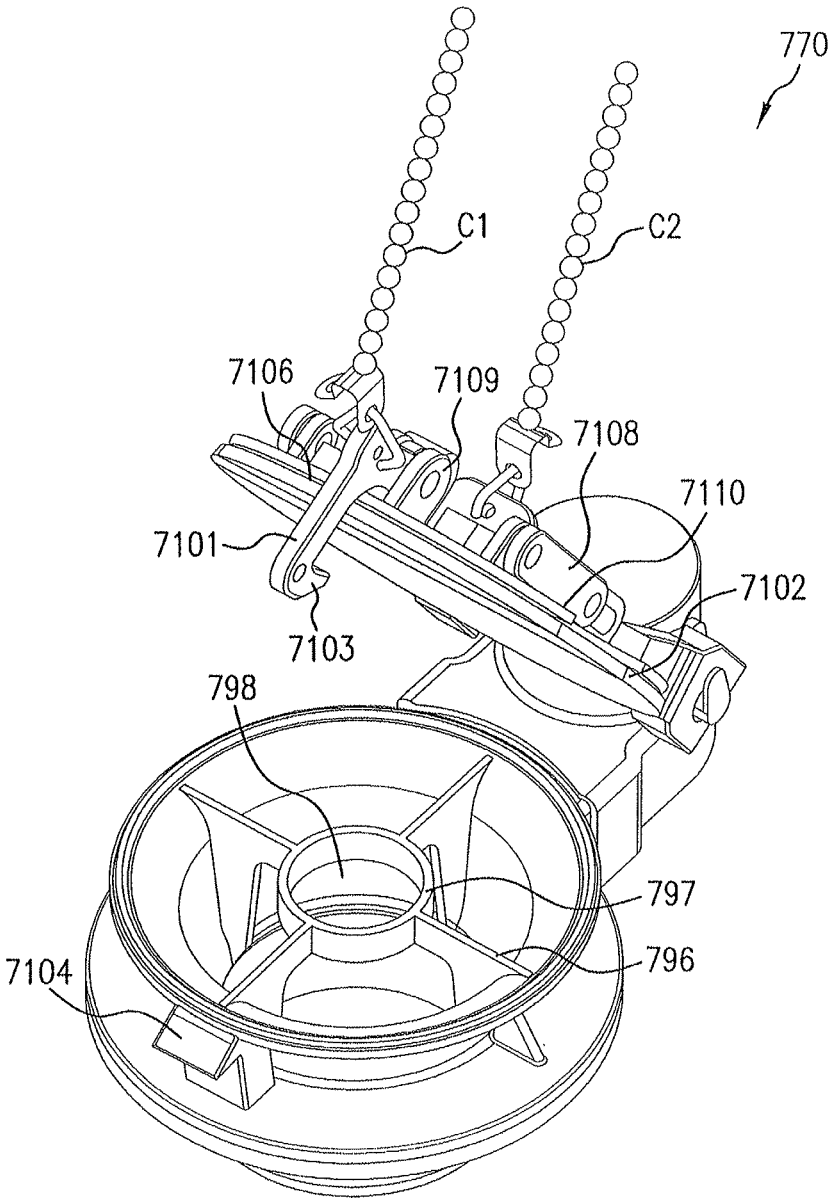
FIG. 54 is a top perspective view of the jet valve of FIG. 49 is an open state and showing internal star-configuration ribs.
Figure 56:
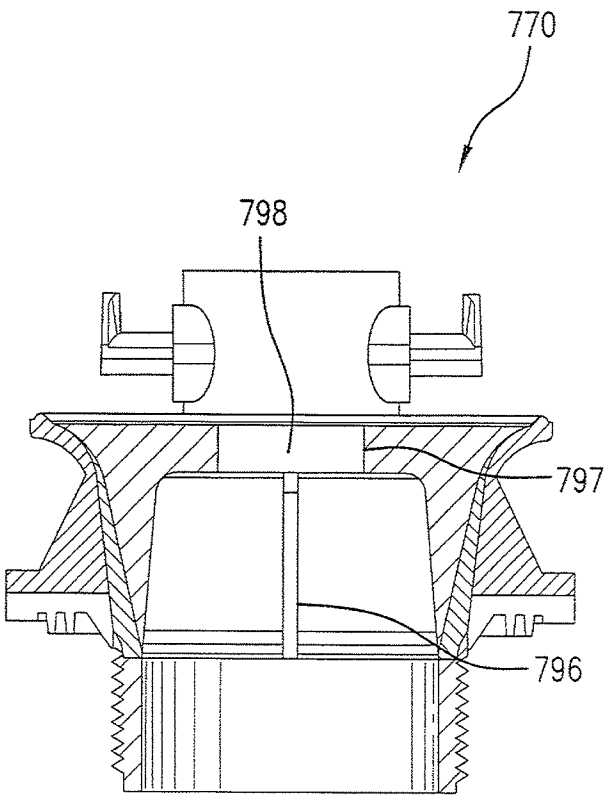
FIG. 56 is a longitudinal cross-sectional view taken along line 56-56 of FIG. 55.
Figure 55:
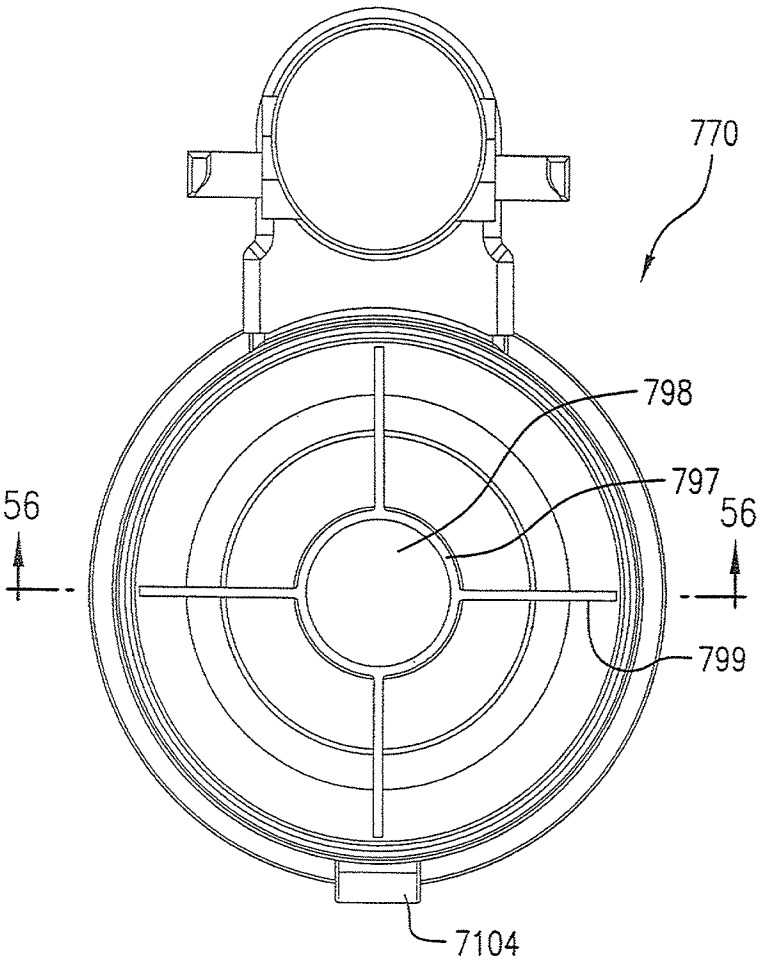
FIG. 55 is a top plan view of the body of the jet valve of FIG. 49 showing the internal star-configuration ribs.
Figure 57:
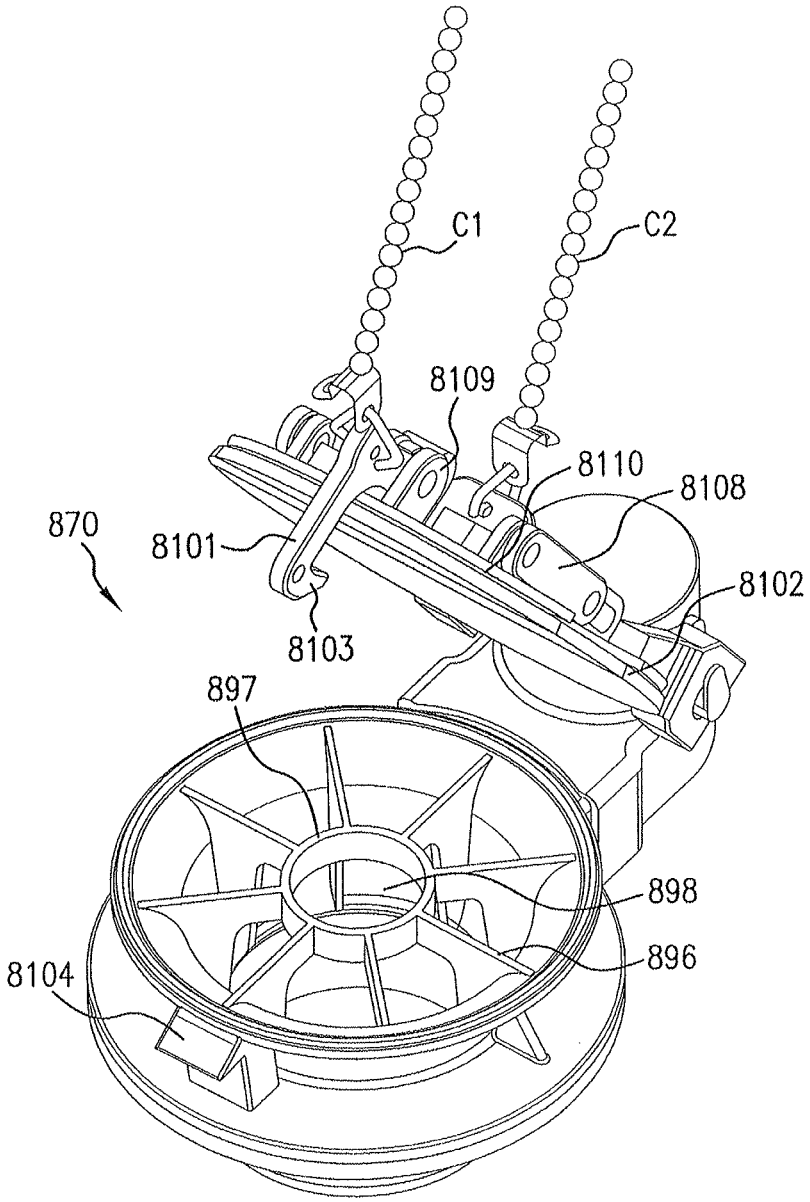
FIG. 57 is a top perspective view of a further embodiment like that of FIG. 49 but having ribs with an alternate internal star-configuration.

When closed, the back-flow preventer prevents flow from pushing back on the flapper cover 573 by positioning of the linkage arms so that the first and second linkage arms are more aligned at their joint area R in a more rigid position where they would remain absent action on chain C at point P (see FIGS. 37 and 38 showing valve in closed position).

Another embodiment 670 of a jet flush valve wherein the back-flow preventer mechanism 674 is a moveable buoyant poppet hat 694. FIGS. 39-43 show the valve 670 in a closed position wherein the poppet hat 694 is pressed against the area of the outlet 613 of the valve 670 in a sealing manner. The upward weight of flush water on the closed valve prevents water entering the interior of the valve. Back-flow cannot enter the bottom of the jet flush valve when the valve is closed due to the poppet hat and pressure from within the primed closed jet path as described above. If a solid poppet hat (not as buoyant) is used, more force for operation would be necessary and a spring or other tension mechanism can be used to connect the hat to the guide.

As shown in FIGS. 45-48, the jet flush valve 670 when opened allows for full flow through the valve body by virtue of lifting of cover 673 (such as by a chain or other flush actuator as described above with respect to valve 70). When the cover 673 is lifted flush water enters the previously primed valve and the continued downward flow pushes out the poppet hat 694. The poppet hat 694 is preferably partially elastomeric or polymeric to sealingly engage against the valve at the outlet 613. The poppet hat 694 is on a post 695 (which as shown best in FIG. 45, may be ribbed in cross-sectional design (or simply a round post).

The post has a top end 699, opposite where it connects to the poppet hat 694, which is configured to have a flange 6100. The flange acts as a stop against a centrally positioned poppet post guide ring 699 within the valve body beneath a ribbed structurally supported configuration. As shown best in FIG. 45, a "star" configuration of ribs 696 extending outwardly from a central hub 697 is shown. An opening 698 extends through the hub, allowing the poppet post to easily pass through in an upward direction when the valve is in the closed position (see FIG. 43). When open, the post passes downward under flow pressure until the flange 6100 contacts the guide ring 699 in a fully extended position so that the poppet hat 694 will not unnecessarily obstruct flow.

A further embodiment of a back-flow preventing jet flush valve 770 is shown in FIGS. 49-56. In this embodiment, the back-flow preventing mechanism 774 is a hook 7101. The hook 7101 is fitted on the front end of the cover 7102 of the jet flush valve 770 which is different from the other covers in the other embodiments as described below. The hook 7101 has an extending hook arm 7103 that meets a catch 7104 positioned on the outside of the jet valve body. The hook arm 7103 should have some gap g between it and the facing surface 7105 of the catch 7104, but the gap should be as small as possible to provide a tight closure against backflow but not so small that the hook cannot easily clear when the valve is opened, and swing around the catch 7104, preferably the gap is about 1 mm to about 5 mm.

A unique feature of the jet flush valve 770, aside from the back-flow preventer mechanism 774, is the cover 7102. The cover is not a simple lift-off flapper cover, but is a "peel-away" cover. This design enables opening of the jet valve from front of the cover along the edge towards the back of the cover. The structure is formed so as to be flexible or partly-flexible. An elastomer or other flexible polymer (such as a flexible silicone or polyvinyl chloride) or other similar material accepted and rated for plumbing use may be adapted for the flexible portion. The ability to more slowly peel the valve cover upward along the edge 7105 of the front 7106 of the valve cover 7102 towards the back 7107 by peeling is beneficial to reduce activation force as there is water above and below the cover. The applicants have discovered that use of a flexible or semi-flexible cover to allow peeling along the edge is beneficial to achieving a good self-priming aspect to the jet flush valve and closed jet path. A rigid flapper cover such as a hard cover with a standard disc seal may provide more difficulty in self priming. By peeling and slowly opening, the valve 770 allows any trapped air to escape. It is preferred that at least about 50% of the cover 7102 is flexible in the front 7106 of the cover half way back towards the back 7107 of the cover. The back half of the cover need not be flexible.

To operate the peel mechanism and lift the hook back-flow preventer mechanism, a first chain C1 operates with the toilet's flush actuation mechanism to lift the hook 7101 when the valve is being opened, and once lifted, the front 7106 of the cover peels and lifts upwards. As it lifts, the hinged arms 7108 (which may be formed using any suitable hinge/hinge connection materials and structures as noted above with respect to embodiment 570) are bent upwards. The hinged arms 7108 are mounted using hinge mounts 7109 to optional cover plates 7110 (which may be metallic, polymeric, or elastomeric) to assist in peeling the front 7106 of the cover 7102 upwards. Any suitable flush actuator may be used and/or modified to connect to the chains C1, C2. Once C1 has lifted the front of the cover upward peeling away at the end 7105, the back portion of the cover is lifted. A separate, float attachment, which may be a second chain C2 is provided which may have a float thereon as described above. Other variations of a float attachment for connecting a float to the back portion of the cover may also be used, including a float assembly as described in further detail below and shown in FIGS. 88-90. A string, cord, rope, stainless steel cable, rigid rod or wire may also be used along with a float as alternative embodiments of the float attachment.

The interior of the valve 770 preferably also has a "star" configuration using a structure formed of ribs 796 linking the body of the valve to a central hub 797 through which an opening 798 extends. Flow can easily pass through the rib structure, but the structure helps to support the weight of flush fluid on the valve by extending radially across the body of the valve. The flapper has two times the force requirement to open, so the supports assists in operation, and further are design to facilitate escape of air by using a shaped baffles or ribs as shown. The number of ribs can impact flow if there are too many ribs or the ribs are too large or shaped in an inconvenient manner.

FIGS. 64-68 show the same embodiment of valve 770 but with an optional overflow tube 791 incorporated thereon. Overflow tube 791 includes an upper housing 769 for incorporating therein any of a variety of standard valves V as a further check against back-flow through the jet valve and which can allow for air to enter and escape. The valve can be manually turned to the open position to break the prime and enable plunging without back flow. Breaking of the prime might also be desirable in other circumstances, such as before maintenance or repair. Any suitable valve such as a ball valve, disc valve or the like may be incorporate therein. A valve V is shown schematically in the partial sectional view of FIG. 67. The housing 769 is optional and other direct connection valves may be used. The valve is then manually reset by the user to the working position and the toilet can be returned to the primed state. Preferably, the valve can incorporate a check valve that automatically opens and remains open when a positive pressure, exceeding that experienced during a normal flush cycle, is experienced in the closed jet channel, allowing air to enter the channel and break the prime. This check valve is then manually reset by the user to the working position, and the toilet can be returned to the primed state. Most preferably, the check valve returns to the closed position after a delay of about 5 seconds to about 60 seconds, not requiring manual intervention on the part of the user. This can be accomplished electromechanically or mechanically with, for example, a flapper-type valve with liquid-dampened hinges.

Figure 59:
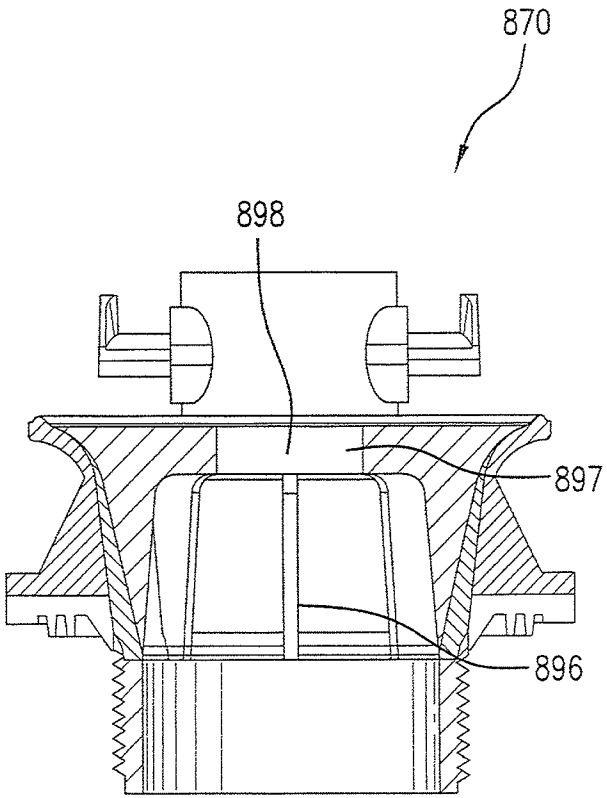
FIG. 59 is a longitudinal cross-sectional view taken along line 59-59 of FIG. 58.
Figure 58:
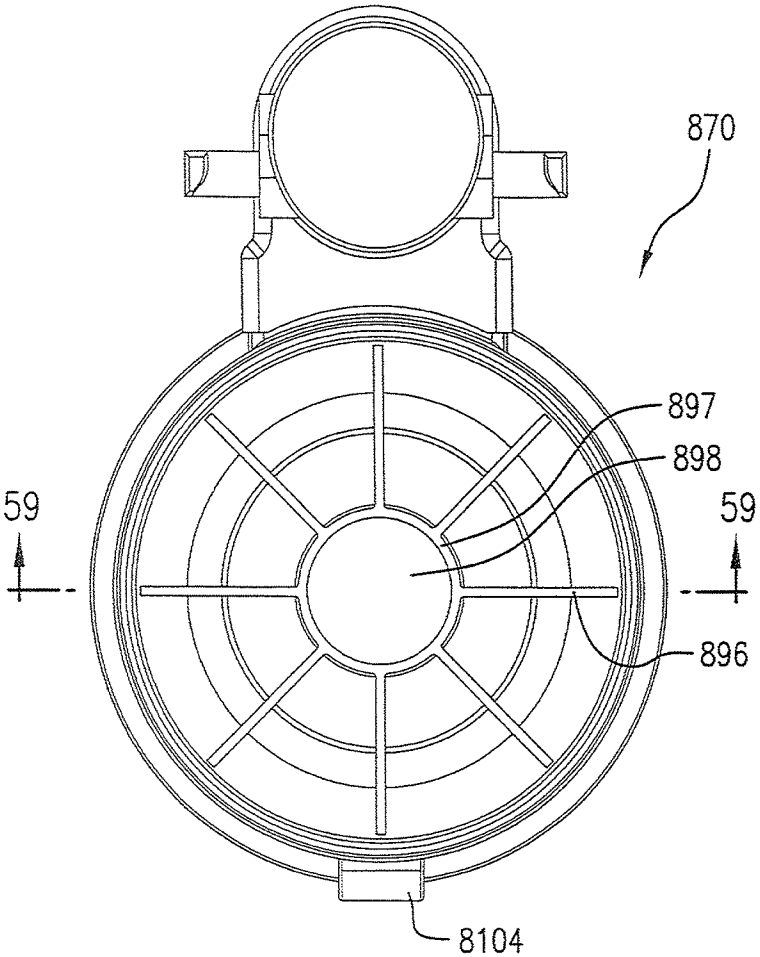
FIG. 58 is a top plan view of the body of the jet valve of FIG. 57 showing the internal start-configuration ribs.
Figure 61:
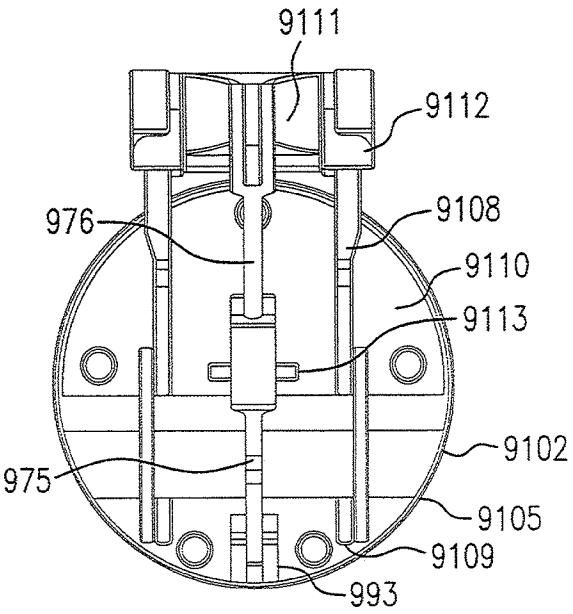
FIG. 61 is a top plan view of the jet valve of FIG. 60.
Figure 60:
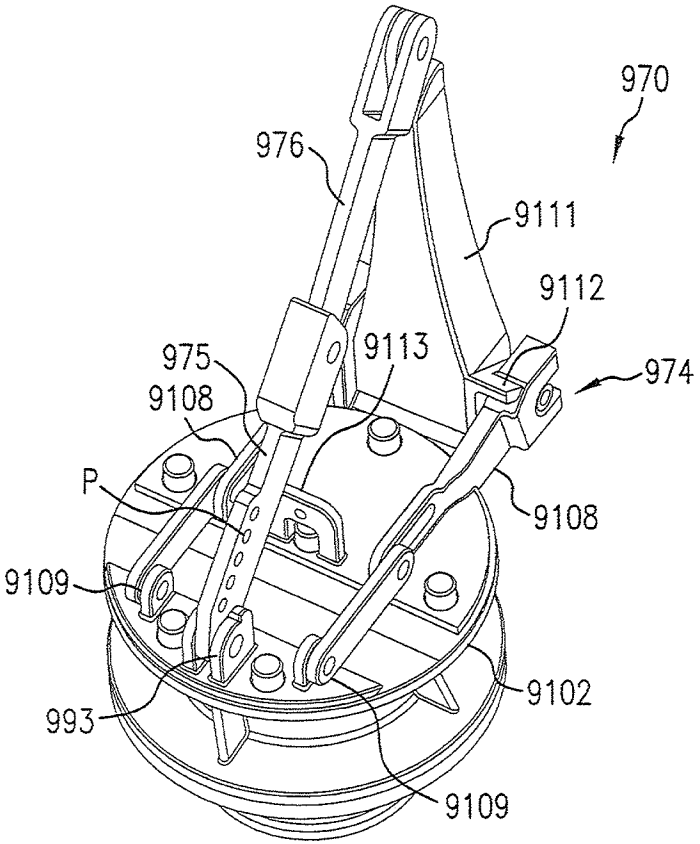
FIG. 60 is a top perspective view of a further jet valve for use in the embodiments of the invention herein shown in a closed state and having a back-flow preventer mechanism including a peel-back flapper cover and a hold-down linkage.
Figure 63:
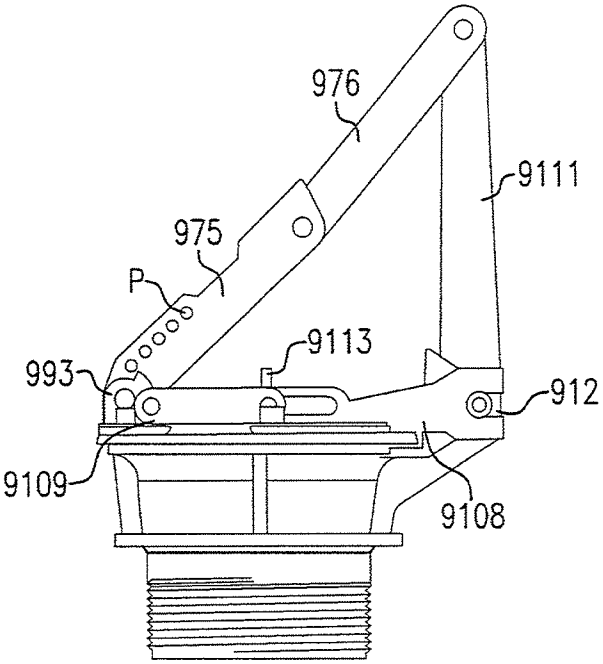
FIG. 63 is a right side elevational view of the jet valve of FIG. 60.
Figure 62:
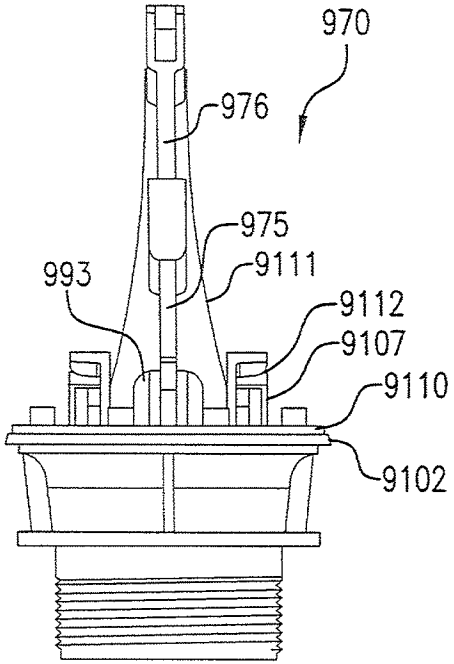
FIG. 62 is a front elevational view of the jet valve of FIG. 60.
Figure 64:
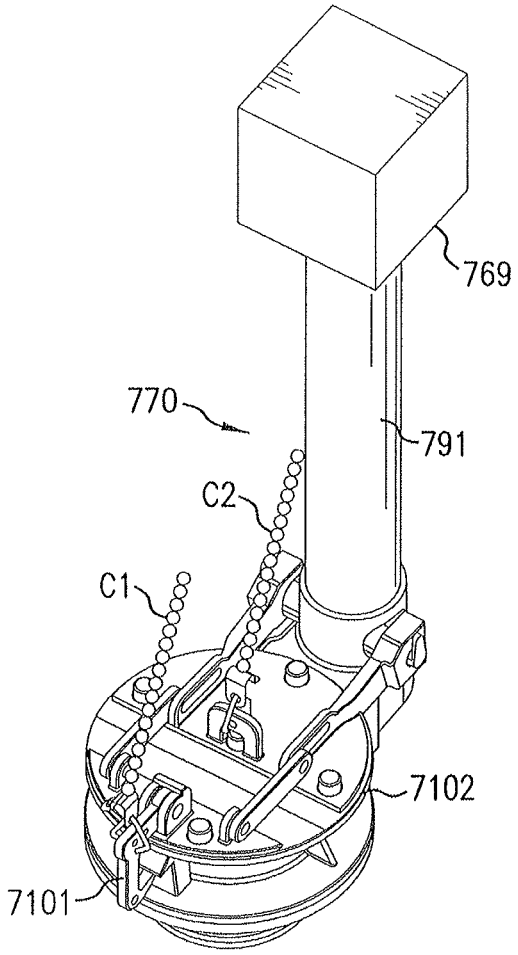
FIG. 64 is a perspective view of a modification of the jet valve of FIG. 49 for use in the embodiments of the invention herein shown in a closed state and having a back-flow preventer mechanism including a peel back cover, but including an optional feature of an overflow tube for housing a further back-flow prevention device such as a check valve.
Figure 65:
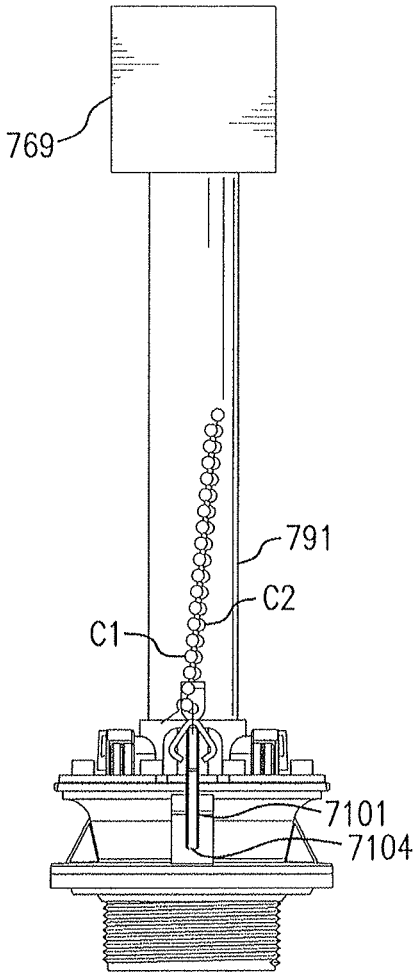
FIG. 65 is a front elevational view of the jet valve of FIG. 64.
Figure 66:
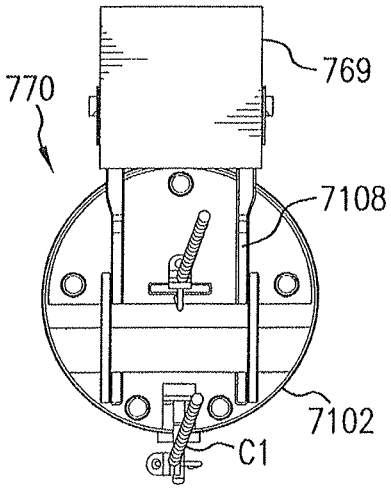
FIG. 66 is a top elevational view of the jet valve of FIG. 64.
Figure 68:
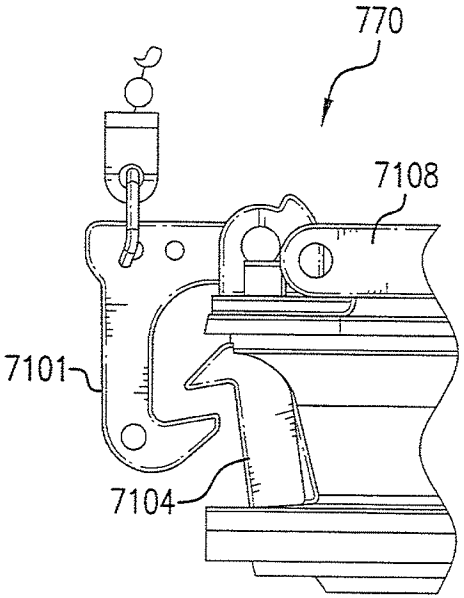
FIG. 68 is an enlarged portion of the jet valve of FIG. 67 showing the lifting hook mechanism.
Figure 67:
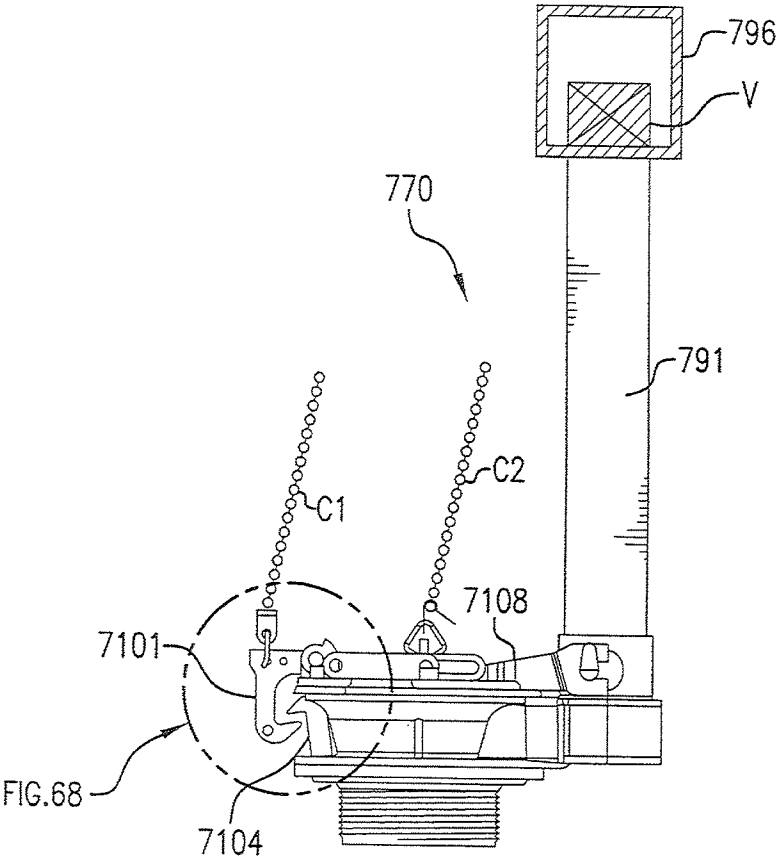
FIG. 67 is a right side elevational view of the jet valve of FIG. 64.

FIGS. 58 and 59 show an identical embodiment 870 to that of jet flush valve 770 having like reference numbers referring to identical parts therein with the exception that in flush valve 870, the star configuration of the support structure has 8 ribs instead of 4 as shown in valve 770. It should be understood by one of ordinary skill in the art that the number and variation of such ribs can be modified to provide varying degrees of structural support without unnecessarily inhibiting flow through the valve and to maximize and facilitate air expulsion.

FIGS. 60-63 show an embodiment of a flush valve 970 having a the backflow-preventer mechanism 974 which is a hold-down linkage configuration similar to that of valve 570 with the exception that instead of a single downward third linkage arm, the embodiment 970 includes a bridging structure 9111 that is larger in width as it extends downwardly. The bridging structure 9111 acts as a third linkage arm, but divides the downward resistance toward hinged mounts 9108. Such hinged arms 9108 attach at hinge mounts 9109 and operate to provide the cover 9102 with the ability to "peel" upward like embodiments 770 and 870. The front portion of the back-flow preventer mechanism 974 includes first and second hinged linkage arms 975, 976 similar to those of embodiment 570. The second linkage arm is linked through a standard hinge connection to the top of the bridging structure 9111 which then engages through a hinge structure 9112 the rear of the hinged arms 9108. The first linkage arm is connected to the front 9106 of the cover 9102 through a hinge mount 993. A chain (not shown) may be attached at point P as described in embodiment 570 to lift the front of the cover 9102, but unlike the embodiment 570, the cover 9102 is flexible like cover 7102 in embodiment 710 and so may be peeled upward. Further an additional chain may be used to hold the float in embodiment 710 to raise the back half of the cover 9102 at the position of grommet 9113 or a similar structure as is shown for chain C2 in embodiment 710. Grommet 9113, or a similar structure may also be used to secure a float attachment, including the float assembly as shown in FIGS. 88-90, a string, a cord, a rope, a stainless steel cable, a rigid rod or a wire.

FIGS. 69 and 70 show another embodiment of the jet valve assembly 1170 that is similar to jet valve assembly embodiments 770, 870 and 970. This embodiment may also be used without a backflow prevention mechanism, or may include the backflow prevention mechanisms as shown in any of the above embodiments 570, 670, 770, 870, 970, etc. As presented in embodiment 770, a solution to overcome the additional force required to open the primed jet valve is to provide a valve that gradually opens, wherein a section of the valve "peels" open to allow some water access to the jet, equalizing the pressure prior to the valve being completely opened. One or more valve assemblies, preferably at least the jet valve assembly 1170 has a valve cover 1173 and a valve body 1121 and is configured to "peel" open. It is also understood that multiple valve assemblies within a single tank, including the rim valve assembly, may have similar configurations. It is also understood that although the valve assemblies are described herein as used with a siphonic toilet, the valve assemblies may also be used with any flush toilet, including washdown toilets.

Figure 73:
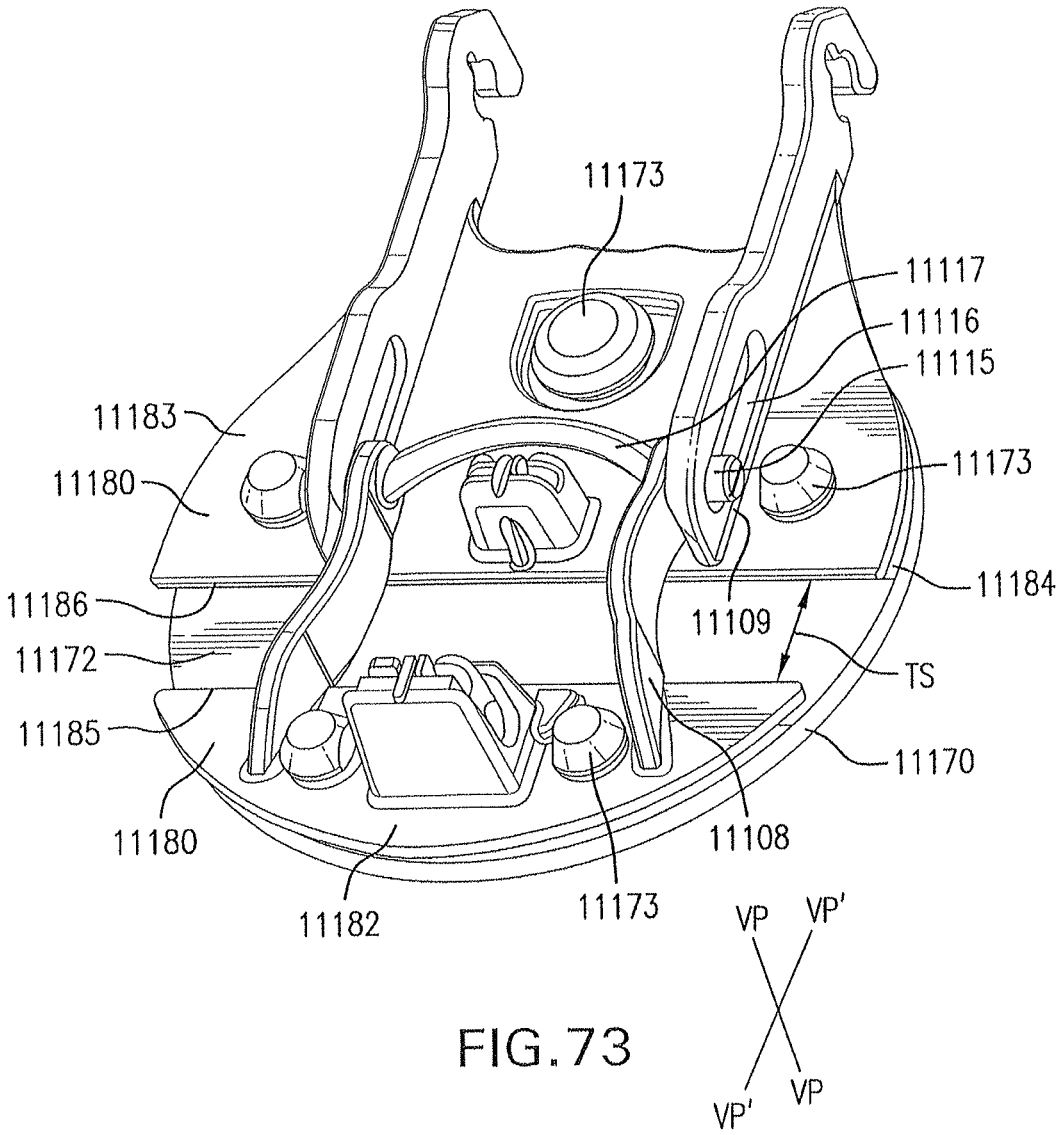
FIG. 73 is a perspective view of a valve cover used in the assembly kit of FIG. 69.
Figure 74:
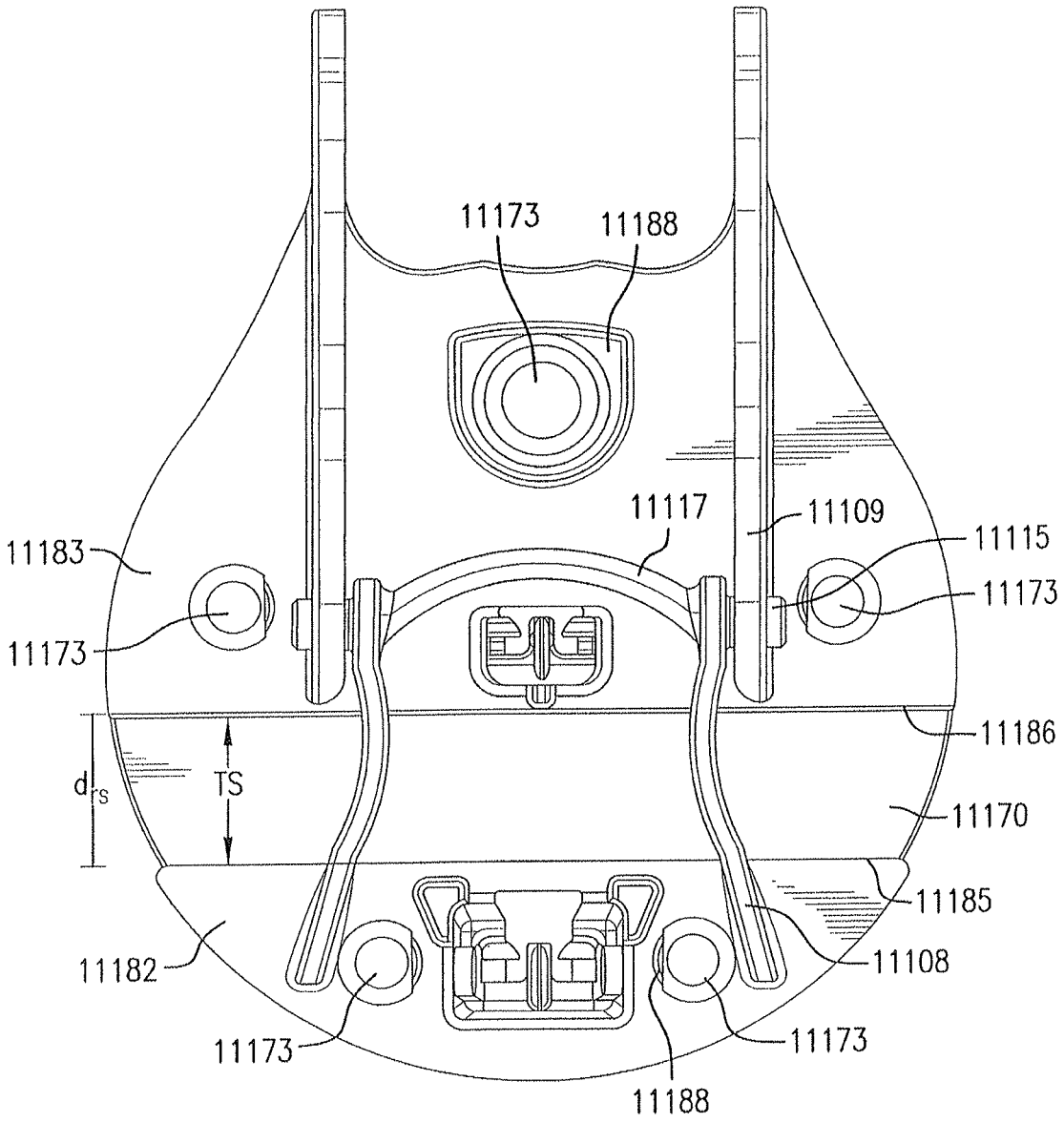
FIG. 74 is a top plan view of the valve cover of FIG. 73.
Figure 75:
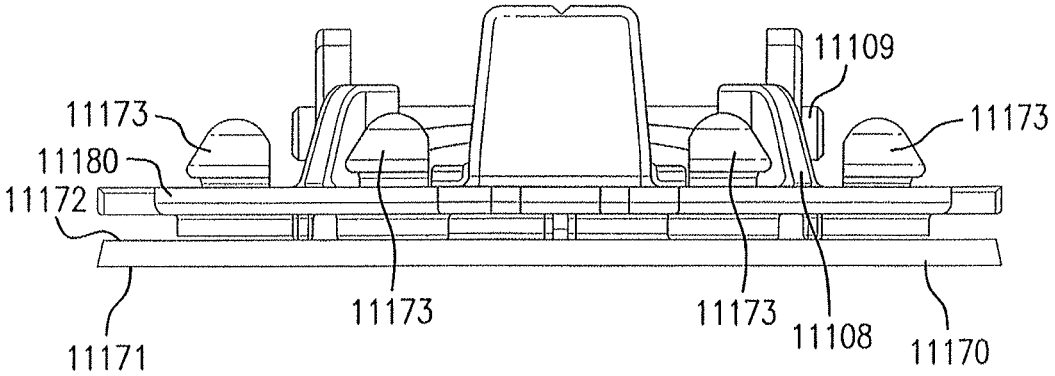
FIG. 75 is a front elevational view of the valve cover of FIG. 73.

FIGS. 73-75 show one such embodiment of a valve cover 1173, which is similar to the cover 7102 of embodiment 770 and preferably has a seal 11170 and a rigid cover 11180. The rigid cover 11180 is preferably capable of bending with the seal 11170 for gradual opening of the valve cover 1173. The rigid cover 11180 may have a peeling section 11182 and a lifting section 11183, which are preferably transversely separated from each other. The peeling section 11182 preferably has at least one hinged mount 11108 configured to connect with the lifting section 11183. The configuration of the connection between the hinged mount 11108 and the lifting section 11183 is preferably a rotatable connection. Such configuration for the rotatable connection will be described in further detail below and is shown in FIGS. 73 and 74.

The rigid cover 11180 may operate similarly to the cover plates 7110 of embodiment 770 discussed above. Preferably the back edge 11185 of the peeling section 11182 and the front edge 11186 of the lifting section 11183 are substantially parallel to each other and also substantially perpendicular to a central longitudinal plane defined by VP and VP' of the valve cover 1173. There may be a transverse separation TS between the edges 11185 and 11186. The distance $d_{TS}$ from the back edge 11185 of the peeling section 11182 to the front edge 11186 of the lifting section 11183 is preferably between 10 mm to 20 mm, but this distance may depend on the size of the valve cover 1173. Any separation distance $d_{TS}$, as well as no separation is also contemplated, so long as the peeling section 11182 is capable of lifting from the valve body 1121 for some distance without the lifting section 11183 moving and there is sufficient clearance to bend the seal 11170 without each section interfering with that process.

A chain C1 may be used to connect the peeling section 11182 of the rigid cover 11180 to the flush activation bar 1175. When the flush activation bar 1175 is lifted, the peeling section 11182 of the valve cover 1173 is capable of lifting from the valve body 1121. The peeling section 11182 may be associated with the lifting section 11183 through hinged arms 11108. The hinged arms 11108 are preferably non-movable at their connection with the peeling section 11182 and are configured to connect to the lifting section 11183 with a rotatable connection. The hinged arms 11108 may be integrally formed with the peeling section 11182 during the molding process and preferably have two pegs 11115 that extend from the outside of each of the hinged arms 11108. The pegs 11115 are preferably cylindrical and sized to be inserted into a slot 11116 on the hinged mounts 11109. Although two hinged arms 11108 are preferable and shown in the Figures, it is understood that one or more hinged arms 11108 may be used. An elastically deformable support member 11117 may be located between the preferable two hinged arms 11108. The elastically deformable support member 11117 is not necessary as the hinged arms 11108 may be sized and shaped to be elastically deformable themselves.

The hinged arms 11108 preferably connect to the lifting section 11183 through hinged mounts 11109 with a connection that is rotatable about a line parallel to the front edge 11186 of the lifting section 11183. The hinged mounts 11109 each preferably have a longitudinally extending slot 11116, which preferably has an oval shape, but it is understood that any shape is possible, such as rectangular, circular, or hexagonal. The pegs 11115 on the hinged arms 11108 may be inserted within the slots 11116 through the use of the elastic deformation of the elastically deformable support member 11117. The oval shape allows the pegs 11115 to move rotationally, as well as longitudinally within their respective slots 11116. This movement permits the peeling section 11182 to optimally interact with the lifting section 11183. It is understood that any rotatable connection may be used for the connection of the hinged arms 11108 to the lifting section 11183 and that longitudinal movement is not necessary. Possible rotatable connectors may include any hinged-type joint, such as a projection on one element that snaps into an opening on the other element, or the use of a pin inserted into openings located within each element. Other types of connections that are capable of rotation about the same axis are also contemplated, including a ball-and-socket-type joint.

As the peeling section 11182 continues to lift, the hinged arms 11108 preferably rotate about the connection with the hinged mounts 11109, allowing the peeling section 11182 to lift from the valve body 1121 without moving the lifting section 11183 for a short period of time. Once the peeling section 11182 has been lifted to a sufficient angle by the chain C1 and the flush activation bar 1175, the hinged mounts 11109 preferably act on the lifting section 11183 causing the lifting section 11183 of the rigid cover 11180 to open, fully lifting the entire valve cover 1173 from the valve body 1121. A float F may also be attached to the valve cover 1173 through the use of a chain C2, the float assembly 11270 described below, or other connection device. The float may provide buoyancy to reduce the force required for opening the valve cover 1173, and/or to control the time of closure of the valve through the drop in water level in the tank during the flush. A lower positioning of the float along the chain may result in a later closure of the valve and an increase in flush volume.

An assembly kit 1100 having a first valve assembly, a second valve assembly and a flush activation assembly without any additional tools and with the second valve assembly having a float attachment in the form of a float assembly 11270 is shown in FIG. 88. The float assembly 11270 comprises a float F and a float connector 11280, which is configured to connect the float to the second valve assembly 1170. A float attachment according to this variation may be used in place of a chain C2 to connect a float to the second valve assembly. FIGS. 89-90 show an enlarged view of the second valve assembly 1170 comprising a float assembly 11270. FIG. 89 shows the valve cover 1173 in the closed position and FIG. 90 shows the valve cover 1173 in the open position. The float connector 11280 may be a rigid, or semi-rigid structure, which is preferably made of a polymeric material. However, it is understood that the float connector may be constructed of any material having a suitable density to not interfere with the operation of the float F in providing buoyancy to the valve cover 1173. The length $l_{FA}$ of the float connector may be varied to adjust the speed that valve cover fully opens. The length $l_{FA}$ may range from about 4 cm to about 14 cm.

The float connector 11280 has a first end 11271 and a second end 11272. A float F is secured on the first end 11271 of the float connector 11280. The second end 11272 of the float connector is hingedly connected to the lifting section 11183 of the second valve assembly 1170 through the use of a clip 11273 that is snapped onto an elevated bar 11274 located on the lifting section 11183 of the second valve assembly 1170. The clip 11273 allows for the float assembly 11270 to rotate about the longitudinal axis of the elevated bar 11274. The longitudinal axis of the bar should be parallel to the axis about which the valve hinges 11275 rotate. It is understood that any rotational connection such as a pin inserted through holes in one or both elements, a ball-and-socket joint, or any other known rotational or hinged connection may be used to connect the float assembly to the lifting section of the valve assembly such that the rotational connection is rotatable about an axis parallel to the axis about which the valve hinge(s) 11275 rotate.

The first end 11271 of the float connector may include a clasp 11276 for holding a float F. The clasp 11276 is somewhat elastically deformable so that when the float is inserted within the opening the force trying to return the clasp to its resting position causes the float F to be held securely in place by friction. For use with a standard float, the opening of the clasp at its smallest height $h_{SC}$ is preferably about 0 cm to about 4 cm high at rest and about 1 cm to about 5 cm high (the height of the float) when a float is inserted therein. The height $h_{TC}$ of the tallest height of the opening of the clasp is about 2 cm to about 6 cm both at rest and when a float is inserted therein. The bottom of the clasp may have a flat platform 11277 with a similar shape as the bottom of the float and the top 11278 of the clasp may be curved, such that the entire first end 11271 is shaped similar to a cotter pin. The elastically deformable nature of the clasp allows for the use of a variety of different floats so that the buoyancy of the valve cover is adjustable and also allows for easy replacement of the float, if necessary.

Once the peeling section is lifted to the point that upward forces are increased on the lifting section, the float provides assistance so that less force is required to fully open the lifting section. When the valve opens, the connection between the second end 11272 of the float assembly 11270 and the lifting section 11183 allows the float F to remain in the vertical position thought the opening of the valve cover. One or more stops 11279 can be located on either side of the clip 11273 so that when the water level falls below the level of the float F, the float assembly 11270 will not completely fall with the water level. It will be understood by one skilled in the art based on this disclosure that the stops are not necessary for the float to function properly, but they may prevent the float assembly from interfering with the operation of other parts of the valve assembly.

Although the second or jet valve assembly is described as having the float attachment, it is understood that the jet valve assembly and/or the rim valve assembly may contain a float attachment, and either or both valve assemblies may behave in a similar manner.

Figure 76:
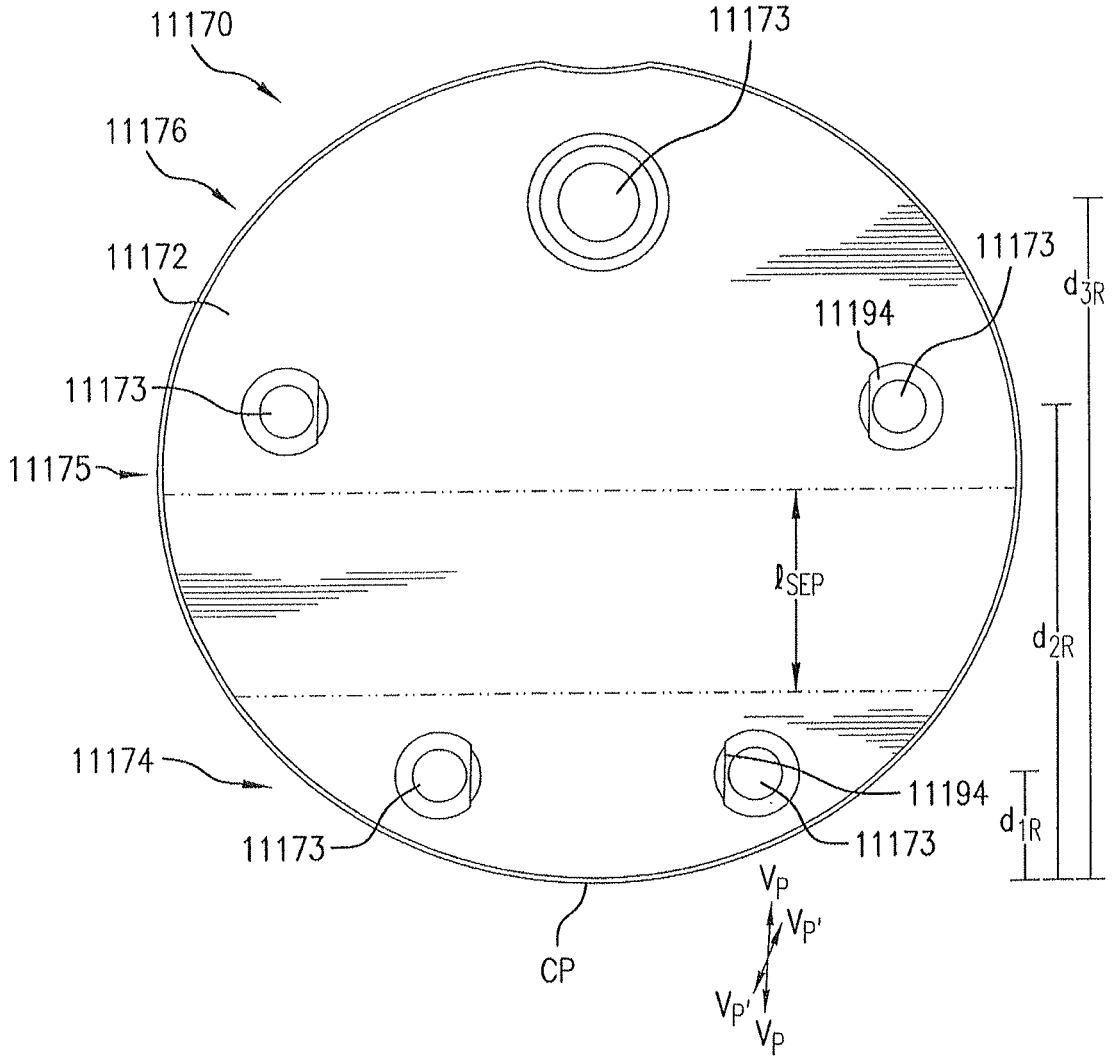
FIG. 76 is a top plan view of a seal as used in the valve cover of FIG. 73.

FIGS. 76 and 77 show an embodiment of a seal 11170 that may be used with the rigid cover to prevent liquid from entering the jet inlet when it is not desired and also move with the rigid cover 11180 to gradually open the valve cover 1173. The seal 11170 may have a sealing surface 11171 and a locking surface 11172. The locking surface 11172 may include a plurality of locking lugs 11173 that may help secure the seal 11170 to the rigid cover 11180, as seen in FIGS. 73-75. The seal 11170 is preferably positioned in facing engagement with the peeling section 11182 and the lifting section 11183. The seal is preferably attached to the rigid cover 11180 through the use of a plurality of locking lugs 11173 alone or in conjunction with an adhesive or other securing method. The locking lugs 11173 may act as additional features that help to prevent the force of the liquid flow from pulling the seal 11170 off of the rigid cover 11180. Although the use of locking lugs 11173 may be preferable, it is understood that the use of an adhesive or other securing method alone is also possible.

The locking lugs 11173 may help with the peeling aspect of the valve cover 1173. The arrangement of the locking lugs 11173 across the seal 11170 may permit one or more locking lugs 11173 to be located within the peeling section 11182 and one or more locking lugs 11173 to be located within the lifting section 11183, as will be described in further detail below. As the peeling section 11182 is lifted, force may be applied to the seal 11170 in a direction opposite of the movement, which will pull the seal 11170 away from the rigid cover 11180 and might allow it to keep the valve closed for longer than desired. The delay may affect the timing between the opening of the rim valve and the opening of the jet valve and/or could reduce the benefit of the peeling section opening prior to the lifting section. The locking lugs 11173 preferably supply a counterforce to the liquid on the seal 11170, which should be sufficient to lift it from the valve body 1121 and maintain the proper timing of the opening of the valves.

A plurality of locking lugs 11173 may be arranged about the locking surface 11172 and may be positioned to engage with a plurality of corresponding openings 11188 in the rigid cover 11180. A preferable arrangement, for example, may include three rows of locking lugs 11173, with one or more locking lug(s) 11173 located in each row. Preferably, a first row 11174 may have at least one locking lug(s) 11173 configured to connect to the peeling section 11182, a second row 11175 may have at least one locking lug(s) 11173 configured to connect to the front of the lifting section 11183 and a third row 11176 may have at least one locking lug(s) 11173 configured to connect to the back of the lifting section 11183. The configuration of the connection of the lugs 11173 is such that the size and shape of each lug 11173 allows it to be inserted relatively easily through the opening and be more difficult to remove from the opening. The configuration of the connection between the locking lugs and the respective peeling and lifting sections may depend on the location and shape of the specific locking lug. The preferable specific features of the configuration will be discussed in further detail below.

The specific location of each locking lug is dependent on the size and/or shape of the valve cover 1173. The rows 11174-11176 may be located at varying distances from a point CP located on the front edge of the seal 11170 on a central vertical longitudinal plane VP and VP' through the valve cover 1173. Preferably for standard valve cover sizes, the first row 11174 may be located at a distance $d_{1R}$ about 5 mm to about 15 mm from the point CP, the second row 11175 may be located at a distance $d_{2R}$ about 40 mm to about 60 mm from the point CP and the third row 11176 may be located at a distance $d_{3R}$ about 60 mm to about 80 mm from the point CP. This configuration should allow sufficient securing of the seal 11170 to the rigid cover 11180, and also allow the peeling section 11182 and the lifting section 11183 to open at different times.

Other configurations for the plurality of locking lugs 11173 are also contemplated. For example, only a single row of locking lugs may be used, wherein the row is preferably located about 5 mm to about 30 mm from the point CP. Such location allows the lug to secure the seal to the rigid cover as the peeling section is being lifted. A single row may also be located about 30 mm to about 90 mm from the point CP. The use of two rows of locking lugs is understood wherein one row is located about 5 mm to about 30 mm from the point CP and the second row is located about 35 mm to about 90 mm from the point CP. In general, the use of none, one or more rows located between about 5 mm and about 30 mm from the point CP, along with the use of none, one, or more rows located about 35 mm to about 90 mm from the point CP in any combination, including the use of no rows of lugs, is understood. The location of the lugs may also be dependent on the size and/or shape of the valve cover 1173. Preferably at least one row is located within the peeling section 11182 and at least one row is located within the lifting section 11183.

A preferable shape for each of the locking lugs 11173 may include a head 11190 and a neck 11191. The head 11190 is preferably slightly larger than the neck 11191, such that when the head 11190 is inserted into a corresponding opening 11188 in the rigid cover 11180, the seal 11170 is locked adjacent to the rigid cover 11180. The head 11190 is preferably generally cone-shaped with a rounded top surface and the neck 11191 preferably has a generally cylindrical shape. Although the shape of the locking lugs 11173 has been described has having a generally circular cross section taken parallel to the seal based on the preferable shapes discussed above, it is understood that this cross section of the head 11190 and/or the neck 11191 may have any shape, such as oval, triangle, square, etc. Other shapes having a circular cross-section, such as a spherical head are also understood.

The distance $d_{TH}$ measured along a transverse line across a cross-section of the bottom surface 11192 of the head 11190 may be larger than the distance $d_{TN}$ measured along a transverse line across a cross section of the top surface 11193 of the neck 11191. Additionally, the circumference of the bottom surface 11192 of the head 11190 is preferably larger than the circumference of the corresponding opening 11188 in the rigid cover 11180 so that the head 11190 performs a locking function with respect to the rigid cover 11180. The circumference of the top surface 11193 of the neck 11191 is preferably smaller than the circumference of the opening 11188 in the rigid cover 11180 so that it fits within the opening 11188. The neck 11191 may also be made of a compressible material that deforms when inserted within the opening 11188. In such instances it is possible for the circumference of the top surface 11193 of the neck 11191 to be larger than the circumference of the opening 11188 in the rigid cover 11180. Moreover, with the use of a compressible material for the neck or the entire locking lug, it is possible that the head and neck could be shaped as a single cylinder, or other shape with a uniform cross section, as the deformation of the neck section when inserted within the opening may provide sufficient locking.

A preferred shape for the locking lugs 11173 in the first 11174 and second 11175 rows may include a generally flat surface 11194 along a side facing the central vertical longitudinal plane VP-VP' of the valve cover 1173. The flat surface 11194 may extend along both the head 11190 and the neck 11191. The flat surface 11194 on the locking lugs 11173 is optional and may be used to help with installation, but is not a necessary element of the seal 11170.

The dimensions of the head 11190 and the neck 11191 of each of the lugs 11173 may be uniform, but one or more lugs 11173 may have one or more unique dimension(s). As shown in FIGS. 76 and 77 one or more of the lugs 11173 may have a larger head 11190 and/or larger neck 11191 than the other locking lugs 11173. Preferably the locking lug 11173 located in the third row 11176 is larger than the other locking lugs 11173 and has a different shape than the other locking lugs 11173. For example, in FIGS. 76 and 77 this locking lug does not share a flat surface 11194 with the other locking lugs 11173. The different size and shape of the locking lug in the third row may create a more secure connection between the seal 11170 and the rigid cover 11180 due to its larger size and continuous contact with the top of the opening. One or more locking lugs 11173 may have a different shape and all of the locking lugs 11173 may have unique dimensions and/or shapes.

A method of locking the seal 11170 onto the rigid cover 11180 preferably includes inserting each locking lug 11173 through and within its corresponding opening 11188 in the rigid cover 11180. The head 11190 should elastically compress as it is inserted through the opening 11188, such that it expands once it is through the opening 11188 to provide its locking function. All of the locking lugs 11173 may be inserted into their respective openings 11188 at the same time, or one or more at a time may be inserted into its respective opening 11188. An adhesive may be optionally applied to the locking surface 11172 of the seal 11170, and/or the adjacent surface of the rigid cover 11180, prior to inserting the locking lugs 11173 into their respective openings 11188. When the seal 11170 is locked to the rigid cover 11180, the head 11190 of the locking lug 11173 may be located on the opposite side of the rigid cover 11180 from the locking surface 11172 and the neck 11191 may be located within the opening 11188 in the rigid cover 11180 and may align and connect the locking surface 11172 to the head 11191. As shown in the figures for embodiment 770, the use of a locking lug 11173 with a head 11190 and neck 11191 is also not necessary and the lugs 11173 may only have a neck 11191 for inserting within the corresponding openings 11188 in the rigid cover 11180 for alignment purposes. The use of a seal 11170 attached to the rigid cover 11180 through only an adhesive without any locking lugs is also contemplated.

The sealing surface 11171 is preferably made from any material known to seal valves that is sufficiently flexible to allow for bending between the peeling section 11182 and the lifting section 11183 without lifting the lifting section 11183 until desired. Such a material is preferably silicone, but may also include any other known polymer with sufficient sealing properties, such as vinyls, rubbers, and other elastomers. The locking surface 11172 and the locking lugs 11173 are also preferably made from these materials with the most preferable material for these elements also being silicone. The entire seal 11170 including the sealing surface 11171, the locking surface 11172 and the locking lugs 11173 are preferably made from the same material with all parts created at the same time using injection molding, compression molding, or three dimensional printing. The materials used for one element may be different from the material used for each of the other elements. Additionally, each element may be created separately by one or more of the included processes and then affixed to each other to form the seal 11170.

Each of the described elements of the embodiments listed herein may be supplied individually, as part of one or more kit(s), or installed within an assembled toilet. An assembly kit 1100 may be supplied to be installed within a new toilet or used to repair or replace the components of an existing toilet. The assembly kit 1100 may include one or more elements and preferably includes a flush activation assembly 11144 according to the embodiment included above and one or more valve assemblies 1170 and 1180 also according to the embodiments included above.

Figure 82:
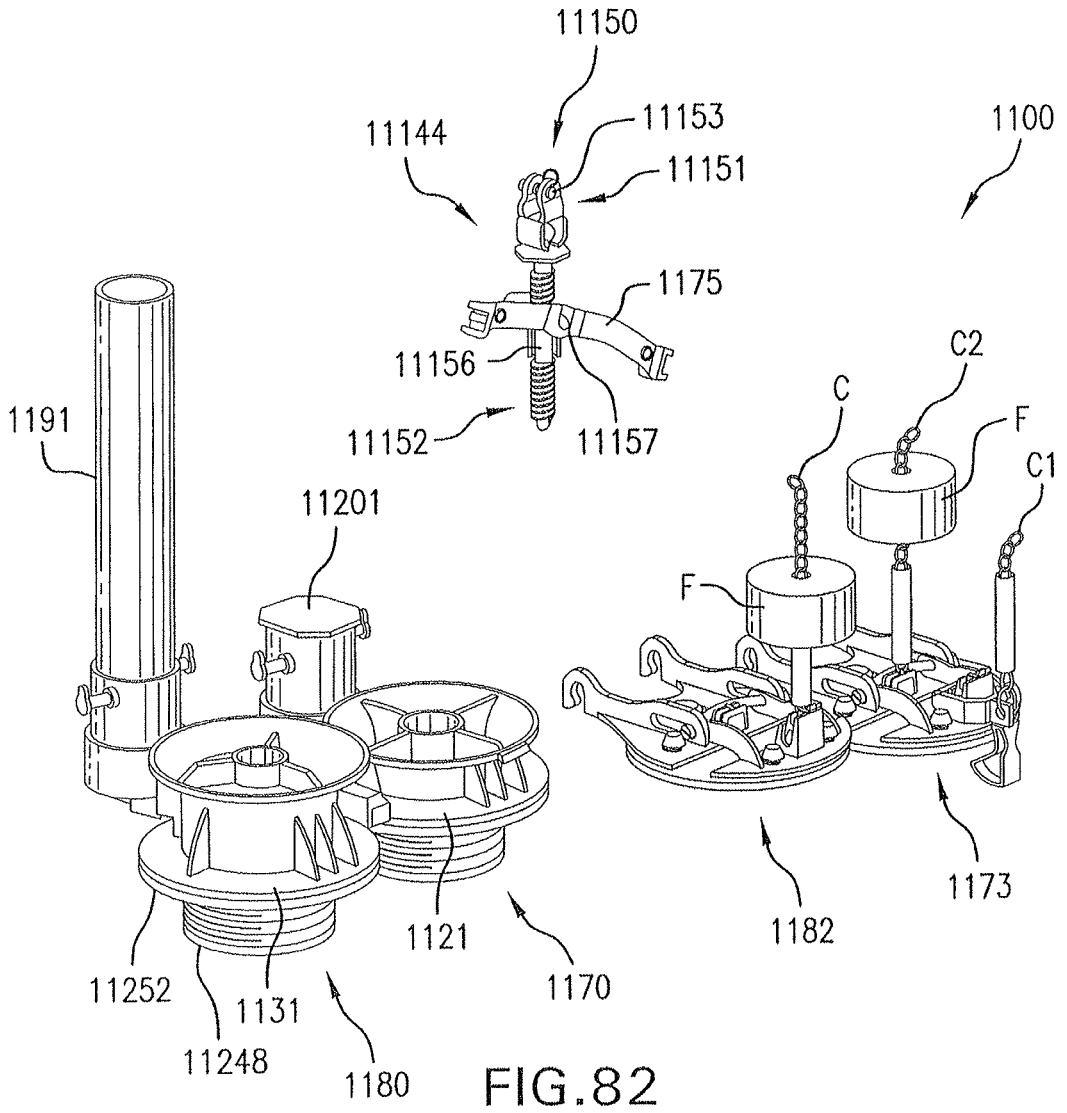
FIG. 82 is an exploded view of the assembly kit of FIG. 69, according to a first embodiment herein.

FIG. 69 shows an assembly kit 1100 according to a first embodiment. The assembly kit 1100 preferably includes a rim valve assembly 1180, a jet valve assembly 1170, a flush activation assembly 11144 and a tank to bowl gasket kit 11241 (seen in FIGS. 83 and 84). The rim valve assembly 1180 may include the rim valve body 1131, an overflow tube 1191, and a rim valve cover 1182. The rim valve cover 1182 may have a chain C with a float F attached to it for connecting the rim valve cover 1182 to the flush activation bar 1175. It is also understood that the jet valve assembly may not have an overflow tube, or that the overflow tube may be permanently sealed closed. The jet valve assembly 1170 may have a jet valve body 1121, an optional removable cap 11201 on the overflow tube 1191, and a jet valve cover 1173. The jet valve cover 1173 preferably has a first chain C1 and a second chain C2, the first chain C1 connects the peeling section 11182 to the flush activation bar 1175 and the second chain C2 may attach a float F to the lifting section 11183. The flush activation assembly 11144 may include an adjustable flush connector 11150, a flush activation bar 1175 and a pivot rod P. The components of the flush activation assembly 11144 may be assembled and interact with one another according to the flush activation assembly embodiment 11144 described above. The assembly kit 1100 is shown in more detail in FIG. 82. In this Figure the assembly kit 1100 is pictured without the pivot rod P. As seen in FIG. 82, both the rim valve assembly 1180 and the jet valve assembly 1170 preferably have a valve to tank gasket 11252 to prevent liquid from leaking around the valve from inside of the tank.

Figure 83:
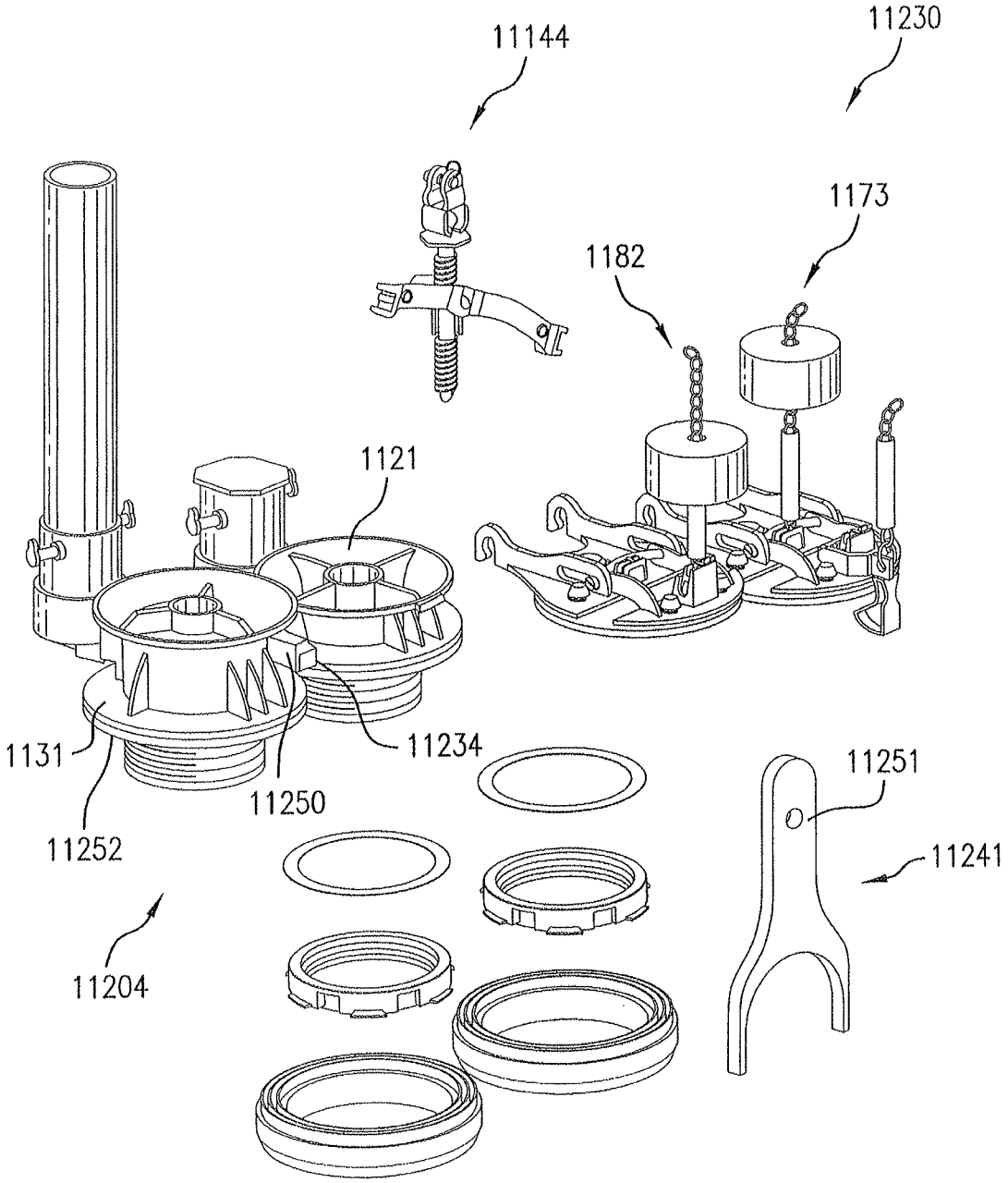
FIG. 83 is an exploded view of the assembly kit of FIG. 69, according to a second embodiment herein.

FIG. 83 shows a second embodiment of an assembly kit 11250. The second assembly kit 11250 may differ from the first assembly kit 1100 in the valve assemblies 1180 and 1170 that are provided. The second assembly kit 11250 may include a multiple flush valve assembly 11205 or 11206, according to the embodiments discussed above. The multiple flush valve assembly 11205 may have a first valve assembly 1170 and a second valve assembly 1180. The first valve assembly may have a first valve cover 1182 and a first link 11210. The second valve assembly may have a second valve cover 1173 and a second link 11220. The first link 11210 and the second link 11220 may interlock to associate the first valve assembly 1170 with the second valve assembly 1180. The second embodiment of an assembly kit 11250 may also include a flush activation assembly 11144 as shown in FIG. 69.

Figure 84:
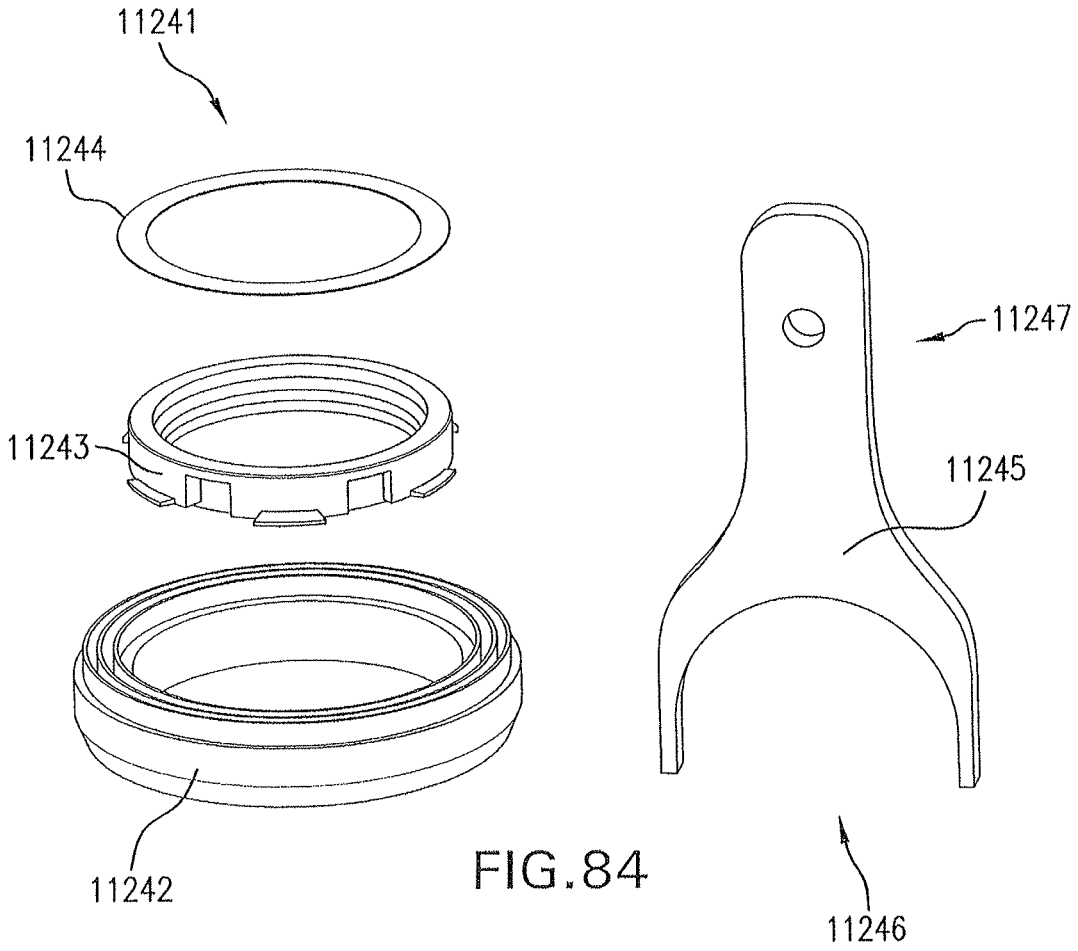
FIG. 84 is an exploded view of a tank to bowl gasket kit, according to an embodiment of the invention.

The tank to bowl gasket kit 11241 may be a separate kit as shown in FIG. 84, or it may be provided within one of the larger assembly kits 1100 or 11250. As shown in FIG. 83 the second assembly kit 11250 may also comprise the tank to bowl gasket kit 11241, forming a larger tank assembly kit 11251. The tank to bowl gasket kit 11241 may include a tank to bowl gasket 11242, a securing nut 11243 and a sealing washer 11244. Additionally, a specific wrench tool 11245 may be included for use in attaching the components to the tank as they may be formed in standard or non-standard sizes. The wrench tool 11245 is preferably simple with an open end 11246 for surrounding the securing nut 11243 and an extension arm 11247 for grasping and providing leverage to secure the nut 11243 onto the threaded surface 11248 which may be located at the bottom of the valve body 1121 or 1131. The tank to bowl gasket 11242 and valve to tank gasket 11252 are preferably molded of a thermoplastic elastomer, such as a SEBS material for good sealing and chemical stability. The securing nut 11243 and the sealing washer 11244 are preferably formed from acetal.

It is contemplated that either the first embodiment of the assembly kit 1100 and/or the second embodiment of the assembly kit 11250 may include two or more of the items described in the preferred embodiment above, in any combination with or without the inclusion of a tank to bowl gasket kit 11241. Additionally, either assembly kit 1100 or 11250 may include additional elements such as a flush actuator, which may include a handle H and a pivot rod P. It is also understood that the pivot rod P may also be excluded from the assembly kits 1100 and/or 11250, as it may be provided with a handle in a separate trip lever assembly kit as is done in other assemblies in the art.

An additional toilet embodiment is also provided which includes an embodiment of the flush activation assembly 11144 as described above by itself or along with one or more valves assemblies 1170 or 1180 according to one of the embodiments described above. Specifically, the toilet may be similar to the toilet of any of the embodiments discussed herein, 10, 110, 210, 310, 410, 1010, etc. and the toilet may be as shown in either FIG. 1 or 16. One embodiment of a toilet preferably has a toilet with a first valve assembly 1180, a second valve assembly 1170 and a flush activation assembly 11144. The flush activation assembly 11144 may include a flush activation bar 1175, a pivot rod P and an adjustable flush connector 11150, as described above. Additionally, the first valve assembly 1180 may be a rim valve assembly and the second valve assembly 1170 may be a jet valve assembly. Moreover, the flush valve assemblies comprising the toilet may be a multiple flush valve assembly 11205, wherein the first valve assembly 1180 is interlocked with the second valve assembly 1170 using a first link 11210 and second link 11220, respectively. As described above, the first link 11210 may have a downward hook shape and the second link 11220 may have a corresponding upward protrusion. However, it would be understood by one skilled in the art that based on this disclosure any connection between the first 1131 and second 1121 valve bodies is contemplated such that the first and second valve bodies 1131 and 1121 stay aligned with one another through the use of the linking device 11200, including the first and second valve assemblies being formed as a single unit.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A valve assembly for a flush toilet, comprising a valve body comprising a link for associating the valve body with a second valve body of a second valve assembly; and a valve cover positioned over the valve body, wherein the valve cover comprises a seal and a rigid cover capable of bending with the seal for gradual opening of the valve cover.

2. The valve assembly according to claim 1, wherein the flush toilet is a siphonic flush toilet.

3. The valve assembly according to claim 1 further comprising an overflow tube connected to the valve body, the overflow tube configured to allow liquid to enter the valve body when the valve cover is closed.

4. The valve assembly according to claim 1, wherein the seal comprises a sealing surface and a locking surface, wherein the locking surface comprises a plurality of locking lugs positioned on the locking surface so as to engage a plurality of corresponding openings in the rigid cover.

5. A multiple flush valve assembly comprising a first valve assembly comprising a first valve body, a first link, and a first valve cover; and a second valve assembly comprising a second valve body, a second link, and a second valve cover, wherein the first valve assembly and the second valve assembly are configured so as to associate with each other through interlocking the first link and the second link.

6. The multiple flush valve assembly according to claim 5, wherein the first link has a downward hook shape and the second link has an upward protrusion, the upward protrusion configured to interlock with the downward hook shape to maintain alignment of the first valve assembly with the second valve assembly.

7. A flush toilet comprising a toilet;

a flush activation assembly; and a multiple flush valve assembly comprising a first valve assembly comprising a first valve body comprising a first link, and a first valve cover; and a second valve assembly comprising a second valve body comprising a second link, and a second valve cover, wherein the first valve assembly and the second valve assembly are configured so as to associate with each other through interlocking the first link and the second link.

8. The toilet according to claim 7, wherein the flush toilet is a siphonic toilet.

9. The toilet according to claim 7, wherein the first link has a downward hook shape and the second link has an upward protrusion, the upward protrusion configured to interlock with the downward hook shape to maintain alignment of the first valve assembly with the second valve assembly.

* * * * *